US010252519B2

(12) United States Patent
Yoshida

(10) Patent No.: US 10,252,519 B2
(45) Date of Patent: Apr. 9, 2019

(54) LIQUID EJECTING APPARATUS AND LIQUID USAGE AMOUNT CALCULATION METHOD FOR LIQUID EJECTING APPARATUS

(71) Applicant: SEIKO EPSON CORPORATION, Tokyo (JP)

(72) Inventor: Takeshi Yoshida, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/422,208

(22) Filed: Feb. 1, 2017

(65) Prior Publication Data

US 2017/0225454 A1 Aug. 10, 2017

(30) Foreign Application Priority Data

Feb. 5, 2016 (JP) ..... 2016-020847

(51) Int. Cl.
*B41J 2/045* (2006.01)
*B41J 2/175* (2006.01)
*B41J 2/14* (2006.01)

(52) U.S. Cl.
CPC ..... *B41J 2/0451* (2013.01); *B41J 2/04578* (2013.01); *B41J 2/04581* (2013.01); *B41J 2/17566* (2013.01); *B41J 2002/14354* (2013.01); *B41J 2002/17569* (2013.01)

(58) Field of Classification Search
CPC .. B41J 2/0451; B41J 2/04581; B41J 2/17566; B41J 2002/17569
See application file for complete search history.

(56) References Cited

U.S. PATENT DOCUMENTS 6,174,042 B1 * 1/2001 Kobayashi ..... B41J 2/1652 347/23
9,211,700 B1 * 12/2015 Sato ..... B41J 2/04541
9,415,601 B1 * 8/2016 Tsukida ..... B41J 2/17566
2002/0089555 A1 7/2002 Kobayashi et al.
2002/0158925 A1 * 10/2002 Hara ..... B41J 2/17566 347/7
2003/0020951 A1 * 1/2003 Minowa ..... B41J 2/17566 358/1.15

(Continued)

FOREIGN PATENT DOCUMENTS

JP 09-011491 1/1997
JP 09-030006 2/1997

(Continued)

*Primary Examiner* — Shelby L Fidler
(74) *Attorney, Agent, or Firm* — Workman Nydegger

(57) ABSTRACT

A liquid ejecting apparatus includes a liquid ejecting unit that has a plurality of nozzles and performs a recording process by ejecting liquid drops from the nozzles to a recording medium, an ejection abnormality detecting unit that detects ejection abnormality in the nozzles, a counting unit that counts the number of liquid ejections to be performed using the nozzles in the recording process as the number of scheduled ejections, and a calculation unit that calculates a usage amount of liquid in the recording process as a liquid usage amount on the basis of the number of scheduled ejections which is counted by the counting unit and a state of the ejection abnormality which is detected by the ejection abnormality detecting unit.

11 Claims, 48 Drawing Sheets

(56) References Cited

U.S. PATENT DOCUMENTS

2004/0150682 A1* 8/2004 Sakamoto ..... B41J 2/17566 347/14
2007/0257954 A1* 11/2007 Nishizaka ..... B41J 2/17509 347/14
2008/0018692 A1* 1/2008 Endo ..... B41J 2/0451 347/19
2010/0238217 A1* 9/2010 Matsushita ..... B41J 2/04541 347/10
2012/0050359 A1* 3/2012 Koganehira ..... B41J 2/17509 347/6
2013/0002752 A1* 1/2013 Shiraiwa ..... G06Q 30/04 347/19
2013/0083107 A1* 4/2013 Nishikawa ..... B41J 2/0451 347/10
2013/0147867 A1* 6/2013 Kobayashi ..... B41J 2/17566 347/7
2013/0286061 A1* 10/2013 Nakamura ..... B41J 2/175 347/6
2013/0321501 A1* 12/2013 Igarashi ..... B41J 2/175 347/7
2013/0321505 A1* 12/2013 Nishihara ..... B41J 2/125 347/14
2014/0232773 A1 8/2014 Hamazaki et al.
2014/0267480 A1* 9/2014 Yoshida ..... B41J 2/12 347/10
2016/0221352 A1* 8/2016 Ejiri ..... B41J 2/17546
2017/0087821 A1* 3/2017 Sakurai ..... B41J 2/04586

FOREIGN PATENT DOCUMENTS

JP 09-169118 6/1997
JP 2002-046289 2/2002
JP 2002-273906 9/2002
JP 2010-201879 9/2010
JP 2014-159144 9/2014
JP 2015-116776 6/2015

* cited by examiner

TEST VALUE AND CALCULATED VALUE OF RESIDUE VIBRATION (BUBBLES)

TEST VALUE AND CALCULATED VALUE OF RESIDUE VIBRATION (DRY)

TEST VALUE AND CALCULATED VALUE OF RESIDUE VIBRATION (PAPER DUST)

BEFORE PAPER DUSTS ARE ATTACHED

AFTER PAPER DUSTS ARE ATTACHED

FIG. 50

| PRINT MODE | WAVE FORM | EJECTION AMOUNT FOR EACH SECTION [ng] | MAXIMUM INK EJECTION AMOUNT [ng] | HIGHEST SETTABLE FREQUENCY [1/s] | PRINTING SPEED | MAIN SCANNING SPEED | RESOLUTION | ADVANTAGE | | DISADVANTAGE | |
|---|---|---|---|---|---|---|---|---|---|---|---|
| HIGHEST IMAGE QUALITY | (A) | 12+8+0 | 20 | 10 | SLOW | SLOW | LOW | ·ABNORMALITY CAN BE DETECTED WITHOUT EJECTING INK.<br>·SINCE PERIOD CAPABLE OF DETECTING RESIDUAL VIBRATION CAN BE SET TO BE LONGER, DETAILED INFORMATION OF NOZZLES CAN BE OBTAINED. | ·SINCE TIME CAPABLE OF DETECTING RESIDUAL VIBRATION CAN BE SET TO BE LONGER, DETAILED INFORMATION OF NOZZLES CAN BE OBTAINED.<br>·VOLTAGE WHEN DETECTING ABNORMALITY IS LOW, RESIDUAL VIBRATION CAN BE REDUCED.<br>·SINCE RESOLUTION IS LOW, IT IS DIFFICULT TO BE INFLUENCED BY RESIDUAL VIBRATION. | ·SINCE AMOUNT FOR DRIVING PZT ELEMENT WHEN DETECTING ABNORMALITY IS SMALL, THERE IS POSSIBILITY THAT ERRONEOUS DETECTION OCCURS WITHOUT CORRECTLY OUTPUTTING DETECTION SIGNAL. | ·SINCE DRIVING FREQUENCY IS SMALL, HIGH SPEED DRIVING CANNOT BE PERFORMED. |
| HIGH SPEED AND HIGH IMAGE QUALITY | (B) | 12+8+0 | 20 | 14.8 | FAST | FAST | HIGH | | ·RESOLUTION IS HIGH. | | |
| NORMAL | (C) | 12+8+12 | 32 | 9.8 | SLOW | SLOW | LOW | ·TYPING AND ABNORMALITY DETECTION CAN BE PERFORMED AT HIGH SPEED.<br>·RESIDUAL VIBRATION CAN BE DETECTED WHILE PERFORMING TYPING. | ·SINCE TIME FOR DETECTING RESIDUAL VIBRATION CAN BE SET TO BE LONGER, DETAILED INFORMATION OF NOZZLES CAN BE OBTAINED.<br>·SINCE RESOLUTION IS LOW, IT IS DIFFICULT TO BE INFLUENCED BY RESIDUAL VIBRATION. | ·ABNORMALITY CANNOT BE DETECTED WITHOUT EJECTING INK.<br>·SINCE INK EJECTION AND ABNORMALITY DETECTION ARE CONCURRENTLY PERFORMED, EJECTION STABILITY AT THAT POINT IS POOR. | |
| HIGH SPEED DRAFT | (D) | 12+8+8 | 28 | 10.2 | FAST | FAST | HIGH | | ·SINCE VOLTAGE FOR TEST IS LOW, INFLUENCE OF RESIDUAL VIBRATION AFTER TEST IS SMALL.<br>·RESOLUTION IS HIGH. | | ·SINCE PIEZO ELEMENT DRIVING AMOUNT AT THE TIME OF DETECTION IS NOT SUFFICIENT IN SOME CASES, THERE IS POSSIBILITY THAT ERRONEOUS DETECTION OCCURS WITHOUT CORRECTLY OUTPUTTING DETECTION SIGNAL. |

LIQUID EJECTING APPARATUS AND LIQUID USAGE AMOUNT CALCULATION METHOD FOR LIQUID EJECTING APPARATUS

BACKGROUND

1. Technical Field

The present invention relates to a liquid ejecting apparatus such as a printer and a liquid usage amount calculation method for a liquid ejecting apparatus.

2. Related Art

As an example of the liquid ejecting apparatus, there is an ink jet-type printer that calculates a residual amount of ink from a total amount of ink in an ink cartridge which receives ink and from a count value of the number of ink ejection commands when printing is performed with ink drops ejected from a plurality of nozzles which are provided in a print head (for example, JP-A-9-30006).

Meanwhile, in a case where a portion of the nozzles provided in the print head is clogged, ink drops are not ejected from the nozzles while the number of ejection commands to the nozzles is counted. Therefore, the calculated residual amount of ink becomes smaller than an actual residual amount of ink. In this case, an ink cartridge is replaced with a new one even when there is remaining ink in the ink cartridge, which results in wasteful use of the remaining ink.

Such a problem is not limited to a printer that performs printing with ejection of ink received in an ink cartridge, and is a common problem for liquid ejecting apparatuses that calculate a residual amount or usage amount of liquid from a count value of the number of liquid ejection commands.

SUMMARY

An advantage of some aspects of the invention is to provide a liquid ejecting apparatus that can accurately calculate a usage amount of liquid and a liquid usage amount calculation method for a liquid ejecting apparatus.

Hereinafter, means of the invention and operation effects thereof will be described.

According to an aspect of the invention, there is provided a liquid ejecting apparatus including a liquid ejecting unit that has a plurality of nozzles and performs a recording process by ejecting liquid drops from the nozzles to a recording medium, an ejection abnormality detecting unit that detects ejection abnormality in the nozzles, a counting unit that counts the number of liquid ejections to be performed using the nozzles in the recording process as the number of scheduled ejections, and a calculation unit that calculates a usage amount of liquid in the recording process as a liquid usage amount on the basis of the number of scheduled ejections which is counted by the counting unit and a state of the ejection abnormality which is detected by the ejection abnormality detecting unit.

In this configuration, since the usage amount of liquid is calculated on the basis of the number of liquid ejections to be performed in the recording process and a state of the ejection abnormality in a nozzle, it is possible to accurately calculate a usage amount of liquid taking the amount of liquid not ejected due to the ejection abnormality into account.

In the liquid ejecting apparatus, the ejection abnormality detecting unit may detect an ejection operation in the recording process, in which ejection abnormality occurs, as a faulty ejection, and the calculation unit may calculate a usage amount of liquid to be used in the recording process as a scheduled usage amount by multiplying the number of scheduled ejections in the recording process by a liquid amount per liquid drop, calculate an amount of unused liquid by multiplying the total number of faulty ejections in the recording process by a liquid amount per liquid drop, and calculate the liquid usage amount by subtracting the amount of unused liquid from the scheduled usage amount.

In this configuration, since the liquid usage amount is calculated by subtracting the amount of unused liquid, which is calculated by multiplying the total number of faulty ejections by a liquid amount per liquid drop, from the scheduled usage amount, which is calculated by multiplying the number of scheduled ejections by a liquid amount per liquid drop, it is possible to accurately calculate a usage amount of liquid taking the number of ejection operations in each of which the ejection abnormality occurs into account.

In the liquid ejecting apparatus, the ejection abnormality detecting unit may detect a nozzle in which ejection abnormality occurs, as a faulty nozzle, and the calculation unit may calculate a usage amount of liquid to be used in the recording process as a scheduled usage amount by multiplying the number of scheduled ejections in the recording process by a liquid amount per liquid drop, calculate an amount of unused liquid by multiplying the scheduled usage amount by a proportion of the number of faulty nozzles, which are detected by the ejection abnormality detecting unit before the recording process is performed, to the total number of nozzles, and calculate the liquid usage amount by subtracting the amount of unused liquid from the scheduled usage amount.

In this configuration, since the liquid usage amount is calculated by subtracting the amount of unused liquid, which is calculated on the basis of a proportion of the number of faulty nozzles in each of which ejection abnormality occurs to the total number of nozzles, from the scheduled usage amount, which is calculated by multiplying the number of scheduled ejections by a liquid amount per liquid drop, it is possible to calculate a usage amount of liquid in a simple manner taking the number of faulty nozzles in each of which ejection abnormality occurs into account.

In the liquid ejecting apparatus, the ejection abnormality detecting unit may detect a nozzle in which ejection abnormality occurs, as a faulty nozzle, and the calculation unit may calculate a usage amount of liquid to be used in the recording process as a scheduled usage amount by multiplying the number of scheduled ejections in the recording process by a liquid amount per liquid drop, calculate an amount of unused liquid by multiplying the number of scheduled ejections in the recording process of faulty nozzles, which are detected by the ejection abnormality detecting unit before the recording process is performed, by a liquid amount per liquid drop, and calculate the liquid usage amount by subtracting the amount of unused liquid from the scheduled usage amount.

In this configuration, since the liquid usage amount is calculated by subtracting the amount of unused liquid, which is calculated on the basis of the number of scheduled ejections of faulty nozzles, from the scheduled usage amount, which is calculated by multiplying the number of scheduled ejections by a liquid amount per liquid drop, it is possible to accurately calculate a usage amount of liquid taking the number of faulty nozzles and the number of scheduled ejections of the faulty nozzles into account.

The liquid ejecting apparatus may further include a liquid receiving portion that can receive liquid drops ejected from the liquid ejecting unit in a non-recording area that is on the outside of a recording area in which the recording medium is arranged. The liquid ejecting unit may reciprocate between the recording area and the non-recording area and perform the recording process by ejecting liquid drops onto the recording medium when entering the recording area, and the liquid ejecting unit may move to the non-recording area between ejection operations of liquid drops on the recording medium, and when the liquid ejecting unit is arranged in a position in which the liquid receiving portion can receive the liquid drops ejected from the nozzles, the ejection abnormality detecting unit may detect the ejection abnormality.

In this configuration, since the ejection abnormality detecting unit detects the ejection abnormality when the liquid ejecting unit is arranged in a position in which the liquid receiving portion can receive the liquid drops ejected from the nozzles, even when a liquid drop is ejected from a nozzle accompanying a detection operation, it is possible to prevent the liquid drop from adhering to the recording medium.

In the liquid ejecting apparatus, the liquid ejecting unit may include a pressure chamber that communicates with the nozzles, and an actuator that causes liquid drops to be ejected from the nozzles by causing the pressure chamber to vibrate, and the ejection abnormality detecting unit may detect the ejection abnormality on the basis of vibration waveforms of the pressure chamber that vibrates due to driving of the actuator.

In this configuration, since the ejection abnormality detecting unit detects the ejection abnormality on the basis of vibration waveforms of the pressure chamber that vibrates due to driving of the actuator, it is possible to detect the ejection abnormality while driving the actuator to cause a liquid drop to be ejected from a nozzle and it is also possible to detect the ejection abnormality while vibrating the pressure chamber with no liquid drop ejected from the nozzles.

According to another aspect of the invention, there is provided a liquid usage amount calculation method for a liquid ejecting apparatus that performs a recording process by ejecting liquid drops from a plurality of nozzles to a recording medium, the method including detecting ejection abnormality in the nozzles, counting the number of liquid ejections to be performed using the nozzles in the recording process as the number of scheduled ejections, and calculating a usage amount of liquid in the recording process as a liquid usage amount on the basis of the number of scheduled ejections which is counted in the counting and a state of the ejection abnormality which is detected in the detecting, in which, in the counting, the liquid usage amount is calculated by subtracting an amount of unused liquid, which is an amount of ink unused in the recording process due to the ejection abnormality, from a scheduled usage amount, which is calculated by multiplying the number of scheduled ejections in the recording process by a liquid amount per liquid drop.

In this configuration, since the usage amount of liquid is calculated on the basis of the number of liquid ejections to be performed in the recording process and a state of the ejection abnormality in a nozzle, it is possible to accurately calculate a usage amount of liquid taking the amount of liquid not ejected due to the ejection abnormality into account.

BRIEF DESCRIPTION OF THE DRAWINGS

The invention will be described with reference to the accompanying drawings, wherein like numbers reference like elements.

FIG. 41A is a diagram illustrating a nozzle surface of the typing section (head unit), and FIG. 41B is a diagram illustrating the wiper.

FIG. 50 is a table illustrating printing modes according to a fourth embodiment.

DESCRIPTION OF EXEMPLARY EMBODIMENTS

Hereinafter, a liquid ejecting apparatus is described with reference to the drawings.

The liquid ejecting apparatus is, for example, an ink jet printer that performs printing by ejecting ink, which is an example of liquid, onto a medium such as a recording sheet.

First Embodiment

Figure 1:
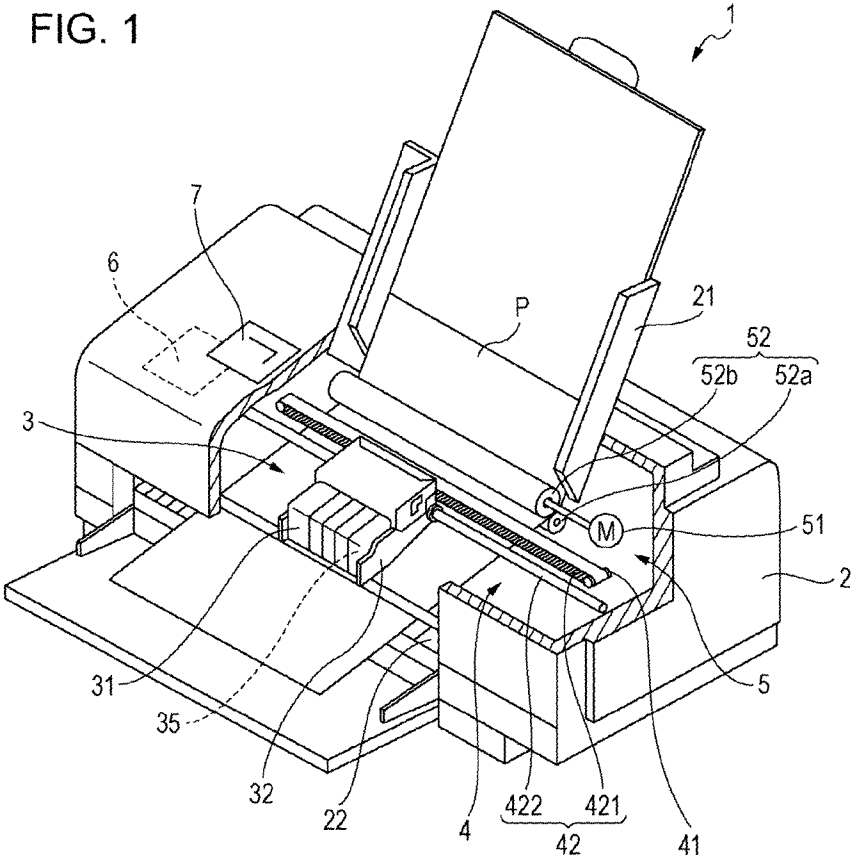
FIG. 1 is a diagram schematically illustrating a configuration of an ink jet printer which is a kind of a liquid ejecting apparatus.

FIG. 1 is a diagram schematically illustrating a configuration of an ink jet printer 1 which is a kind of a liquid ejecting apparatus according to a first embodiment. Further, in the description below, in FIG. 1, an upper side in a vertical direction is referred to as an "upper portion", and a lower side in the vertical direction is referred to as a "lower portion". Firstly, a configuration of the ink jet printer 1 is described.

The ink jet printer 1 illustrated in FIG. 1 includes an apparatus main body 2, and a tray 21 to which a recording sheet P is installed is provided in the backward upper portion, a paper discharging opening 22 that discharges the recording sheet P is provided in the forward lower portion, and an operation panel 7 is provided on the upper surface.

The operation panel 7 is configured with, for example, a liquid crystal display, an organic EL display, and an LED lamp, and includes a display portion (not illustrated) that displays an error message or the like, and an operation portion (not illustrated) configured with various kinds of switches. The display portion of the operation panel 7 functions as a notification section.

In addition, inside the apparatus main body 2, mainly, a printing apparatus (printing section) 4 including a reciprocating typing section (moving body) 3, a paper feeding apparatus (liquid receiving body transporting section) 5 that feeds and discharges the recording sheet P to and from the printing apparatus 4, and a control portion (control section) 6 that controls the printing apparatus 4 and the paper feeding apparatus 5 are included.

The paper feeding apparatus 5 intermittently transmits the recording sheet P under the control of the control portion 6. The recording sheet P passes through a portion near the lower portion of the typing section 3. At this point, the typing section 3 reciprocates in a direction substantially orthogonal to the direction of transmitting the recording sheet P, and performs printing on the recording sheet P. That is, the reciprocating of the typing section 3 and the intermittent transmission of the recording sheet P become main scanning and subscanning, to perform ink jet-type printing.

The printing apparatus 4 includes the typing section 3, a carriage motor 41 that becomes a driving source that causes the typing section 3 to move (to reciprocate) in the main scanning direction, and a reciprocating driving mechanism 42 that receives the rotation of the carriage motor 41, and causes the typing section 3 to reciprocate.

The typing section 3 includes a plurality of head units 35, an ink cartridge (I/C) 31 that supplies ink to the respective head units 35, and a carriage 32 to which the respective head units 35 and an ink cartridge 31 are mounted. Further, in the case of the ink jet printer that consumes a lot of ink, the ink cartridge 31 may not be mounted on the carriage 32, and instead may be installed in another location, and communicate with the head units 35 through a tube so that the ink is supplied (not illustrated).

Further, full color printing becomes possible by using cartridges filled with four colors of ink of yellow, cyan, magenta, and black, as the ink cartridges 31. In this case, the head units 35 (the configuration thereof is described below) respectively corresponding to the colors are provided in the typing section 3. Here, the four ink cartridges 31 corresponding to 4 colors of ink are illustrated in FIG. 1, but the typing section 3 may be configured so as to further include the ink cartridges 31 including ink of other colors such as light cyan, light magenta, dark yellow, and special colors.

The reciprocating driving mechanism 42 includes carriage guide shafts 422 supported by a frame (not illustrated) on both ends, and a timing belt 421 extending in parallel to the carriage guide shafts 422.

The carriage 32 is supported by the carriage guide shafts 422 of the reciprocating driving mechanism 42 in a reciprocating manner, and is fixed to a portion of the timing belt 421.

If the timing belt 421 is forwardly and backwardly driven through a pulley by an operation of the carriage motor 41, the typing section 3 moves in a reciprocating manner, by being guided by the carriage guide shafts 422. Also, in the reciprocating, ink drops are appropriately ejected from respective ink jet heads 100 of the head units 35 according to the image data to be printed (printing data), and printing on the recording sheet P is performed.

The paper feeding apparatus 5 includes a paper feeding motor 51 that becomes a driving source thereof, and paper feeding rollers 52 that rotate by the operation of the paper feeding motor 51.

The paper feeding rollers 52 are configured with a driven roller 52*a* and a driving roller 52*b* that interpose a transportation route of the recording sheet P (the recording sheet P) and face each other, and the driving roller 52*b* is connected to the paper feeding motor 51. Accordingly, the paper feeding rollers 52 transmit multiple sheets of recording sheet P installed in the tray 21 toward the printing apparatus 4 one by one, and discharge the multiple sheets of recording sheet P from the printing apparatus 4 one by one. Further, instead of the tray 21, a configuration in which a paper feeding cassette that accommodates the recording sheet P is mounted in a detachable manner is possible.

Moreover, the paper feeding motor 51 is interlocked with a reciprocating movement of the typing section 3, and transmits the recording sheet P according to a resolution of an image. A paper feeding movement and a paper transmitting movement may be performed by respective different motors, or may be performed by the same motor using a part that switches torque transmission such as an electromagnetic clutch.

The control portion 6 performs a printing process on the recording sheet P by controlling the printing apparatus 4, the paper feeding apparatus 5, and the like based on data to be printed, which is input from a host computer 8 such as a personal computer (PC) or a digital camera (DC). In addition, the control portion 6 causes respective portions to perform corresponding processes based on a signal which is input from an operation portion, and generated by pressing various kinds of switches, together with causing a display portion of the operation panel 7 to display an error message or the like, causing an LED lamp to be turned on/off, or the like. Moreover, the control portion 6 transmits information such as an error message or ejection abnormality to the host computer 8, if necessary.

Figure 2:
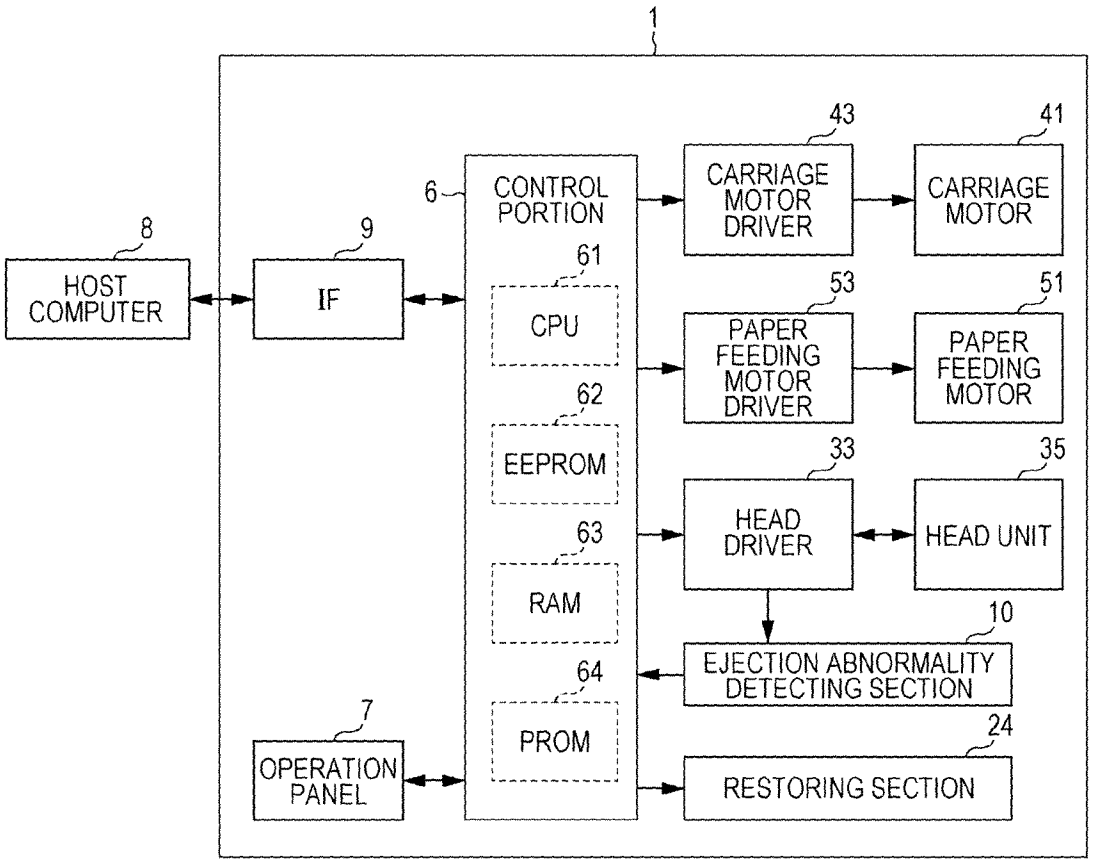
FIG. 2 is a block diagram schematically illustrating main portions of the ink jet printer.

As illustrated in FIG. 2, the ink jet printer 1 includes an interface (IF) 9 that receives data to be printed or the like which is input from the host computer 8, the control portion 6, the carriage motor 41, a carriage motor driver 43 that controls the driving of the carriage motor 41, the paper feeding motor 51, a paper feeding motor driver 53 that controls the driving of the paper feeding motor 51, the head units 35, a head driver 33 that controls the driving of the head units 35, an ejection abnormality detecting section (ejection abnormality detecting unit) 10, a restoring section 24, and the operation panel 7. Further, details of the ejection abnormality detecting section 10, the restoring section 24, and the head driver 33 are described below.

In FIG. 2, the control portion 6 includes a central processing unit (CPU) 61 that performs various kinds of processes such as a printing process or an ejection abnormality detecting process, an electrically erasable programmable read-only memory (EEPROM) (storage section) 62 which is a kind of non-volatile semiconductor memory that stores the data to be printed which is input from the host computer 8 through the IF 9 in a data storage area (not illustrated), a random access memory (RAM) 63 that temporarily stores various kinds of data for performing the ejection abnormality detecting process described below, or temporarily stores an application program for the printing process or the like, and a PROM 64 that is a kind of non-volatile semiconductor memory that stores a control program that controls respective portions. Further, respective elements of the control portion 6 are electrically connected to each other through a bus (not illustrated).

As described above, the typing section 3 includes the plurality of head units 35 corresponding to respective colors of ink. In addition, the head units 35 each include a plurality of nozzles 110, and electrostatic actuators 120 respectively corresponding to the nozzles 110. That is, the head unit 35 is configured to include the plurality of ink jet heads 100 (liquid ejecting heads) each of which has one set of the nozzles 110 and the electrostatic actuator 120. Also, the head driver 33 is configured with a driving circuit 18 that controls ejection timings of ink by driving the electrostatic actuators 120 of the respective ink jet heads 100, and switching sections 23 (see FIG. 16). Further, a configuration of the electrostatic actuator 120 is described below.

In addition, though not illustrated in the drawings, various kinds of sensors, for example, that can detect residual amounts of ink in the ink cartridges 31, a position of the typing section 3, and a printing environment such as a temperature and humidity are respectively connected to the control portion 6.

If the control portion 6 receives the data to be printed from the host computer 8 through the IF 9, the control portion 6 stores the data to be printed in the EEPROM 62. Also, the CPU 61 performs a predetermined process on the data to be printed, and outputs a driving signal to the respective drivers 33, 43, and 53 based on the processed data and the input data from the various kinds of sensors. If a driving signal is input through the respective drivers 33, 43, and 53, the plurality of electrostatic actuators 120 of the head units 35, the carriage motor 41 of the printing apparatus 4, and the paper feeding apparatus 5 are respectively operated. Accordingly, a printing process (recording process) is performed on the recording sheet P.

Figure 3:
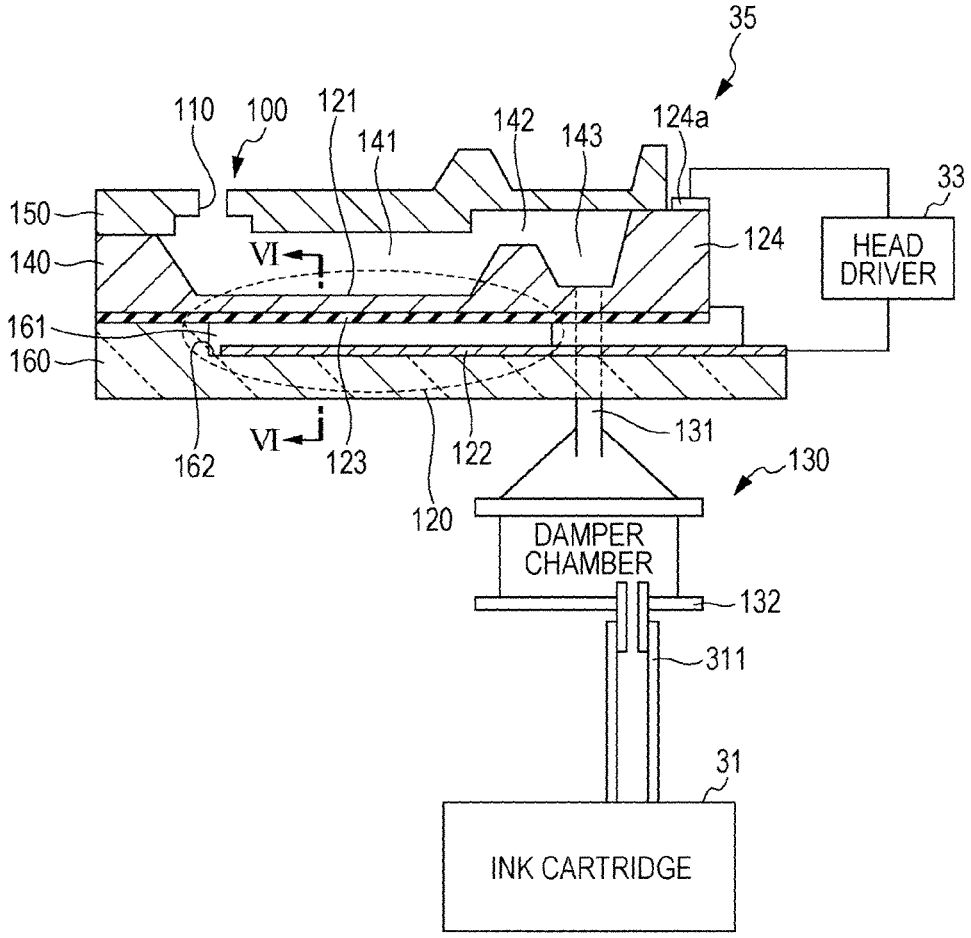
FIG. 3 is a cross-sectional view schematically illustrating a head unit (ink jet head) in the ink jet printer illustrated in FIG. 1.
Figure 4:
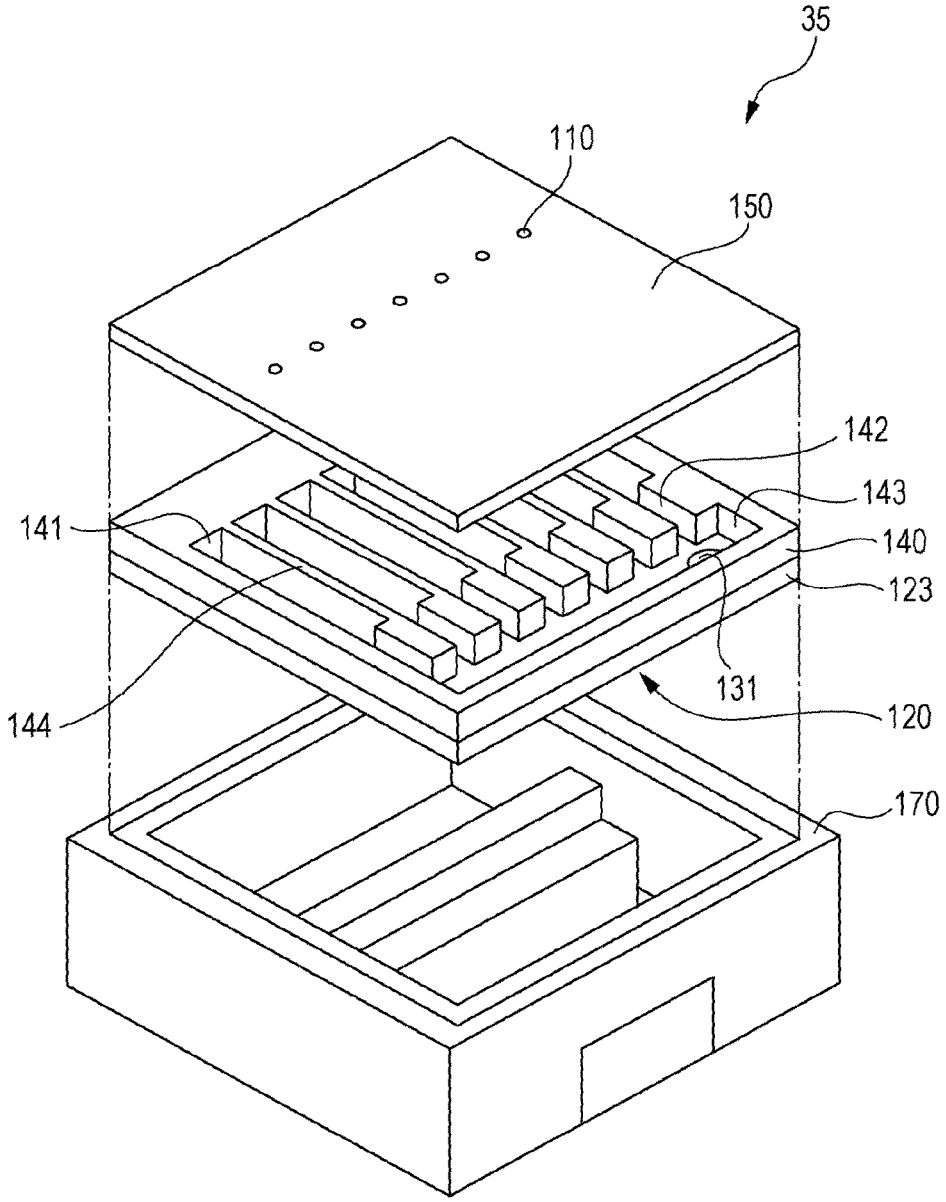
FIG. 4 is an exploded perspective view schematically illustrating a configuration of the head unit illustrated in FIG. 3.
Figure 5:
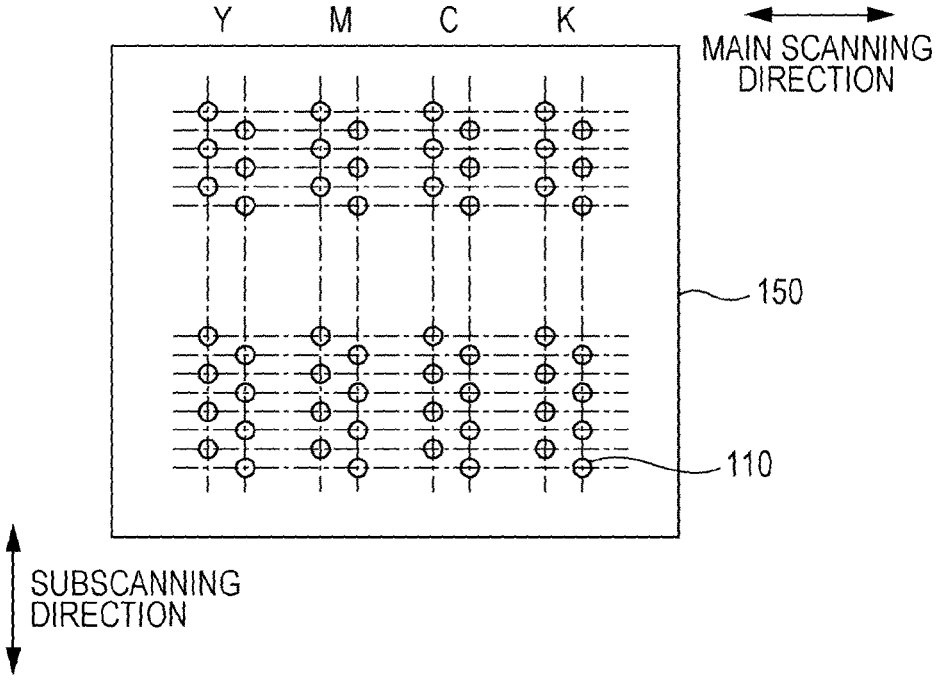
FIG. 5 is a diagram illustrating an exemplary nozzle arrangement pattern of a nozzle plate of the head units using four colors of ink.

Next, configurations of the respective head units 35 in the typing section 3 are described. FIG. 3 is a cross-sectional view schematically illustrating the head unit 35 (the ink jet head 100) illustrated in FIG. 1, FIG. 4 is an exploded perspective view schematically illustrating a configuration of the head unit 35 corresponding to a color of ink, and FIG. 5 is a plan view illustrating an example of a nozzle surface of the typing section 3 to which the head units 35 illustrated in FIGS. 3 and 4 are applied. Further, FIGS. 3 and 4 are illustrated in a state of being turned upside down from the state of being generally used.

As illustrated in FIG. 3, the head unit 35 is connected to the ink cartridge 31 through an ink intake opening 131, a damper chamber 130, and an ink supplying tube 311. Here, the damper chamber 130 includes a damper 132 made of rubber. Since the damper chamber 130 can absorb the shaking of ink and the change of ink pressure caused when the carriage 32 reciprocates, it is possible to stably supply a predetermined amount of the ink to the head unit 35.

In addition, the head unit 35 has a three-layer structure in which a silicon substrate 140 is interposed therebetween, a nozzle plate 150 made of silicon in the same manner is stacked on the upper side, and a glass substrate (glass substrate) 160 made of borosilicate having a similar coefficient of thermal expansion is stacked on the lower side. Grooves functioning as a plurality of independent cavities (pressure chamber) 141 (7 cavities are illustrated in FIG. 4), one reservoir (common ink chamber) 143, and ink supplying openings (orifices) 142 that communicate the reservoir 143 with the cavities 141 are formed in the silicon substrate 140 in the center. Respective grooves are, for example, formed by performing an etching process on the surface of the silicon substrate 140. The nozzle plate 150, the silicon substrate 140, and the glass substrate 160 are bonded in this sequence, and the cavities 141, the reservoir 143, the respective ink supplying openings 142 are partitioned and formed.

The cavities 141 are respectively formed in a strip shape (rectangular shape), the capacities thereof are changed according to vibrations (displacements) of vibration plates 121 described below, and the cavities 141 are configured so that ink (liquid material) is ejected from the nozzles 110 according to the changes of the capacities. In the nozzle plate 150, the nozzles 110 are formed at positions corresponding to portions on the distal end sides of the respective cavities 141, and these are communicated with the respective cavities 141. In addition, the ink intake opening 131 is formed that is communicated with the reservoir 143 in a portion of the glass substrate 160 in which the reservoir 143 is positioned. The ink is supplied from the ink cartridge 31 to the reservoir 143 through the ink supplying tube 311, the damper chamber 130, and the ink intake opening 131. The ink supplied to the reservoir 143 is supplied to the respective independent cavities 141 through the respective ink supplying openings 142. Further, the respective cavities 141 are partitioned and formed by the nozzle plate 150, side walls (partitions) 144, and bottom walls 121.

With respect to the respective independent cavities 141, the bottom walls 121 thereof are formed with thin walls, the bottom walls 121 are configured to function as vibration plates (diaphragms) that can be elastically deformed (elastically displaced) in the off-plate direction (thickness direction), that is, in the vertical direction in FIG. 3. Accordingly, for convenience of explanation below, the portions of the bottom walls 121 are described by being called the vibration plates 121 (that is, hereinafter, both of the "bottom walls" and the "vibration plates" use the reference numeral 121).

Shallow concave portions 161 are formed at positions corresponding to the respective cavities 141 of the silicon substrate 140 on the surface on the silicon substrate 140 side of the glass substrate 160. Accordingly, the bottom walls 121 of the respective cavities 141 are opposed to surfaces of facing walls 162 of the glass substrate 160 on which the concave portions 161 are formed with the predetermined gaps interposed therebetween. That is, apertures having a predetermined thickness (for example, about 0.2 microns) exist between the bottom walls 121 of the cavities 141 and segment electrodes 122. Further, the concave portions 161 can be formed by, for example, etching.

Here, the respective bottom walls (vibration plates) 121 of the cavities 141 configure a portion of common electrodes 124 on the cavities 141 side respectively for accumulating electric charges by driving signals supplied from the head driver 33. That is, the respective vibration plates 121 of the cavities 141 also function as a portion of corresponding facing electrodes (facing electrodes of capacitor) of the electrostatic actuators 120. Also, the segment electrodes 122 that are electrodes respectively facing the common electrodes 124 are formed so as to oppose the respective bottom walls 121 of the cavities 141 on the surfaces of the concave portions 161 of the glass substrate 160. In addition, as illustrated in FIG. 3, the respective surfaces of the bottom walls 121 of the cavities 141 are covered with an insulation layer 123 made of a silicone oxide film ($SiO_2$). In this manner, the respective bottom walls 121 of the cavities 141, that is, the vibration plates 121 and the respective segment electrodes 122 corresponding thereto form (configure) facing electrodes (facing electrodes of capacitor) with the insulation layer 123 formed on the surface on the lower side of the bottom walls 121 of the cavities 141 in FIG. 3 and apertures in the concave portions 161. Accordingly, main portions of the electrostatic actuators 120 are configured with the vibration plates 121, the segment electrodes 122, and the insulation layer 123 and the apertures interposed therebetween.

As illustrated in FIG. 3, the head driver 33 including the driving circuit 18 for applying a driving voltage between the facing electrodes charges and discharges electricity between the facing electrode according to a typing signal (typing data) input from the control portion 6. An output terminal on one side of a head driver (voltage applying section) 33 is connected to the respective segment electrodes 122, and the other output terminal is connected to input terminals 124*a* of the common electrodes 124 formed on the silicon substrate 140. Further, impurities are injected into the silicon substrate 140, and the silicon substrate 140 itself has conductivity. Therefore, it is possible to supply a voltage from the terminals 124*a* of the common electrodes 124 to the common electrodes 124 of the bottom walls 121. In addition, for example, a thin film made of a conductive material such as gold or copper may be formed on one surface of the silicon substrate 140. Accordingly, it is possible to supply a voltage (charge) to the common electrodes 124 with low electric resistance (effectively). The thin film may be formed by, for example, evaporation or sputtering. Here, according to the embodiment, since the silicon substrate 140 and the glass substrate 160 are joined (bonded), for example, by anode joining, a conductive film used as an electrode in the anode joining is formed on a path forming surface side of the silicon substrate 140 (upper portion of the silicon substrate 140 illustrated in FIG. 3). Also, the conductive film is used as the terminal 124*a* of the common electrode 124. Further, for example, the terminal 124*a* of the common electrodes 124 may be omitted, and also the method of bonding the silicon substrate 140 and the glass substrate 160 is not limited to the anode joining.

As illustrated in FIG. 4, the head unit 35 includes the nozzle plate 150 in which the plurality of nozzles 110 are formed, the silicon substrate (ink chamber substrate) 140 in which the plurality of cavities 141, the plurality of ink supplying openings 142, and the one reservoir 143 are formed, and the insulation layer 123, and these are stored in a base body 170 including the glass substrate 160. The base body 170 is configured with, for example, various kinds of resin materials, and various kinds of metal materials, and the silicon substrate 140 is fixed to and supported by the base body 170.

Further, the nozzles 110 formed in the nozzle plate 150 are linearly arranged in parallel to the reservoir 143 as schematically illustrated in FIG. 4, but the arrangement pattern of the nozzles is not limited thereto, and may be generally arranged in a manner of being deviated by step, for example, as in a nozzle arrangement pattern illustrated in FIG. 5. In addition, pitches between the nozzles 110 are appropriately set according to a printing resolution (dot per inch (dpi)). Further, in FIG. 5, the arrangement pattern of the nozzles 110 to which four colors of ink (the ink cartridges 31) are applied is illustrated.

Figure 6A:
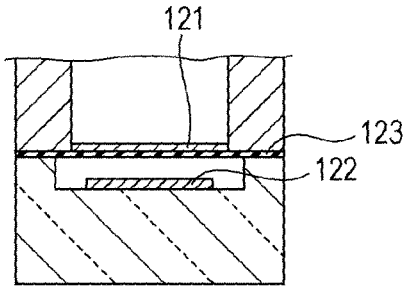
FIGS. 6A to 6C are diagrams illustrating respective states of the cross section taken along lines VIA-VIA, VIB-VIB, and VIC-VIC in FIG. 3 when a driving signal is input.
Figure 6B:
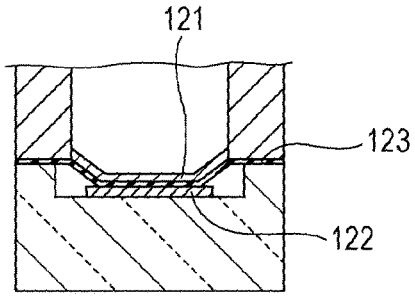
Figure 6C:
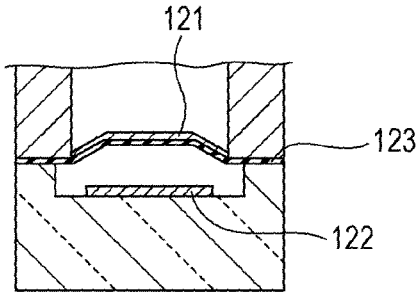

FIGS. 6A to 6C are diagrams illustrating respective states of the cross section taken along lines VIA-VIA, VIB-VIB, and VIC-VIC in FIG. 3 when a driving signal is input. If the driving voltage is applied between facing electrodes from the head driver 33, Coulomb force is generated between the facing electrodes, and the bottom wall (vibration plate) 121 bends toward the segment electrode 122 side from the initial state (FIG. 6A) so that the capacity of the cavity 141 increases (FIG. 6B). In this state, under the control of the head driver 33, if charges between the facing electrode are suddenly discharged, the vibration plate 121 is restored upwardly in FIGS. 6A and 6B by the elastic restoration force, and moves to the upper portion passing a position of the vibration plate 121 in the initial position, so that the capacity of the cavity 141 rapidly shrinks (FIG. 6C). At this point, a portion of the ink (liquid material) that fills the cavity 141 is ejected from the nozzle 110 communicating with the cavity 141 as an ink drop by the compression pressured generated in the cavity 141.

The respective vibration plate 121 of the cavity 141 performs damped vibrations by a series of operations (an ink ejection operation by a driving signal of the head driver 33) until a next driving signal (driving voltage) is input, and a next ink drop is ejected. Hereinafter, the damped vibration is referred to as a residue vibration. It is assumed that the residue vibration of the vibration plate 121 has a unique vibration frequency determined by an acoustic resistance r determined by shapes of the nozzles 110 or the ink supplying openings 142, or a coefficient of viscosity of the ink, inertance m determined by a weight of the ink in the path, and a compliance Cm of the vibration plate 121.

Figure 7:
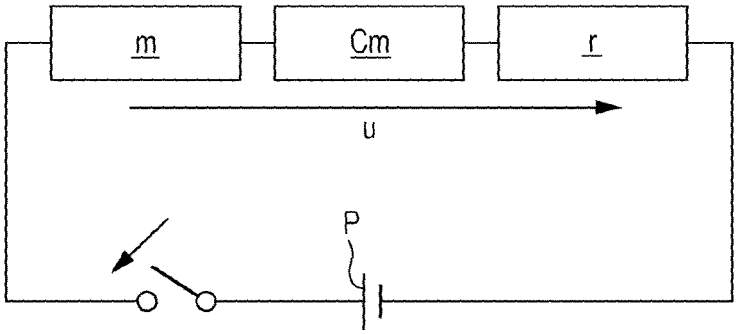
FIG. 7 is a circuit diagram illustrating a calculation model of a simple harmonic vibration assuming the residue vibration of a vibration plate in FIG. 3.

A calculation model of the residue vibration of the vibration plate 121 based on the above assumption is described. FIG. 7 is a circuit diagram illustrating a calculation model of the simple harmonic vibration assuming the residue vibration of the vibration plate 121. In this manner, the calculation model of the residue vibration of the vibration plate 121 is expressed by an acoustic pressure P, the inertance m, the compliance Cm, and the acoustic resistance r which are described above. Also, if a step response with respect to a volume velocity u when the acoustic pressure P is applied to a circuit in FIG. 7 is calculated, the following expressions can be obtained.

$$u = \frac{P}{\omega \cdot m} e^{-\omega t} \cdot \sin \omega t \tag{1}$$

$$\omega = \sqrt{\frac{1}{m \cdot C_m} - \alpha^2} \tag{2}$$

$$\alpha = \frac{r}{2m} \tag{3}$$

Figure 8:
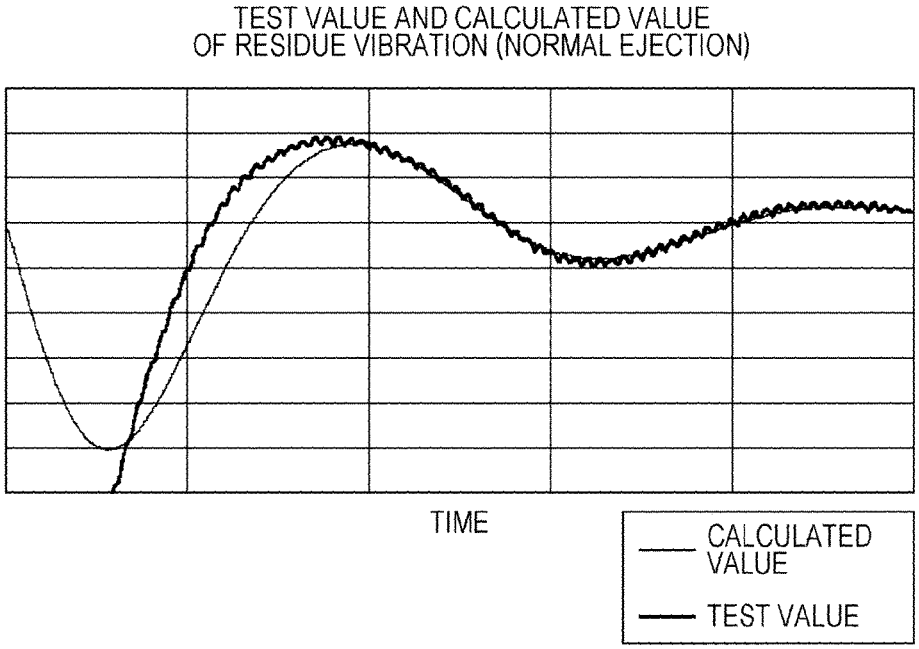
FIG. 8 is a graph illustrating a relationship between a test value and a calculated value of the residue vibration of the vibration plate in the case of the normal ejection in FIG. 3.

The calculation results obtained from the expressions above and the test results in separately performed tests of the residue vibrations of the vibration plate 121 after the ejection of ink drops are compared. FIG. 8 is a graph illustrating a relationship between the test value and the calculated value of the residue vibration of the vibration plate 121. As can be understood from the graph illustrated in FIG. 8, two waveforms of the test value and the calculated value are substantially identical to each other.

However, in the respective ink jet heads 100 of the head units 35, a phenomenon in which ink drops are not normally ejected from the nozzles 110 though the ejection operation described above is performed, that is, ejection abnormality of the liquid drop may be generated. As a cause of the generation of the ejection abnormality, as described below, (1) the mixture of bubbles into the cavity 141, (2) the drying and the thickening (adherence) of the ink near the nozzle 110, (3) the attachment of the paper dust near the outlets of the nozzles 110, and the like are included.

When the ejection abnormality is generated, the liquid drop typically is not ejected from the nozzles 110 as a result, that is, the non-ejection phenomenon of the liquid drop is performed. In this case, dot omission in an image printed (drawn) on the recording sheet P occurs. In addition, if the ejection abnormality occurs, even if the liquid drop is ejected from the nozzles 110, since an amount of the liquid drop is too small, or the direction of flight (trajectory) of the liquid drop is deviated, the liquid drop does not impact on an appropriate portion. Therefore, dot omission in the image occurs. Accordingly, in the description below, the ejection abnormality of the liquid drop may also be referred to as "dot omission".

Hereinafter, based on the comparison results illustrated in FIG. 8, values of the acoustic resistances r and/or the inertances m are adjusted according to causes of the dot omission (ejection abnormality) phenomenon (non-ejection phenomenon of liquid drop) in the printing processes that are generated in the nozzles 110 of the ink jet heads 100, so that the calculated values and the test values of the residue vibrations of the vibration plates 121 match with each other.

Figure 9:
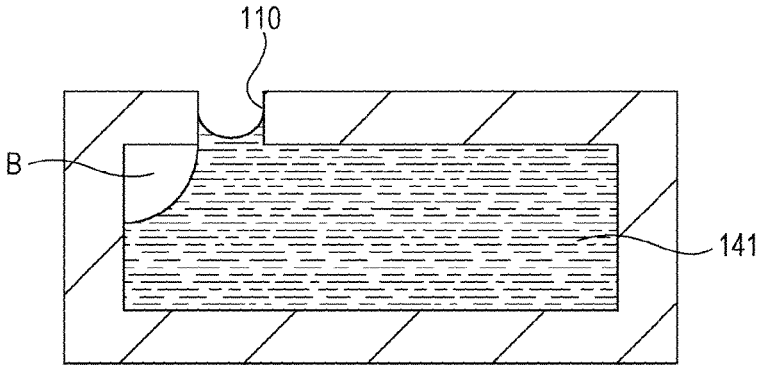
FIG. 9 is a conceptual diagram illustrating a portion near the nozzle when a bubble is mixed into a cavity in FIG. 3.

First, the mixture of the bubbles into the cavities 141 which is one of the causes of the dot omission is discussed. FIG. 9 is a conceptual diagram illustrating a portion near the nozzle 110 when a bubble B is mixed into the cavity 141 in FIG. 3. As illustrated in FIG. 9, it is assumed that the generated bubble B is generated and attached on a wall surface of the cavity 141 (as an example of the attachment position of the bubble B, FIG. 9 illustrates a case in which the bubble B is attached near the nozzle 110).

In this manner, it is considered that, if the bubble B is mixed into the cavity 141, the total weight of the ink that fills the cavity 141 is reduced, and the inertance m is decreased. In addition, since the bubble B is attached to the wall surface of the cavity 141, the state becomes as if the diameter of the nozzle 110 increases by a size of the diameter thereof, so that the acoustic resistance r is decreased.

Figure 10:
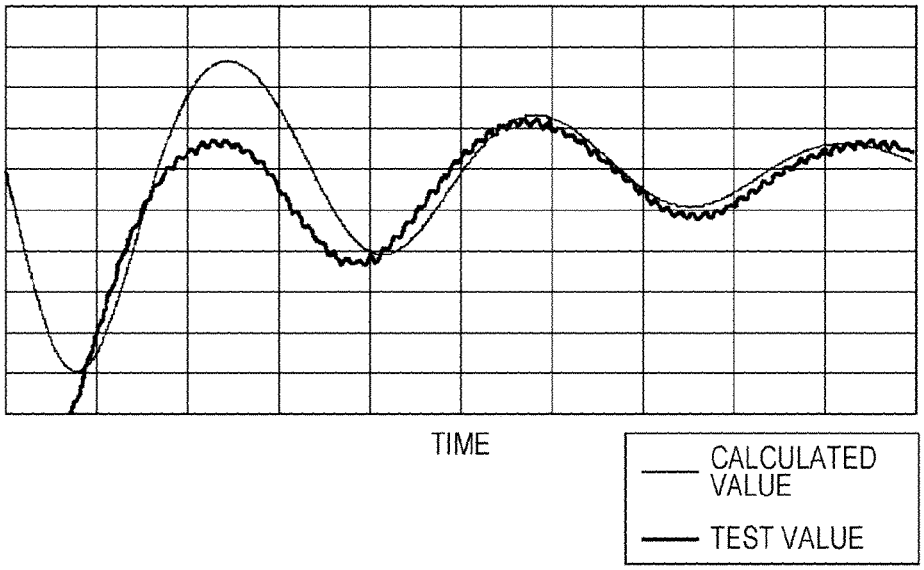
FIG. 10 is a graph illustrating a calculated value and a test value of the residue vibration when the ink drops cannot be ejected due to the bubble mixture into the cavity.

Accordingly, the acoustic resistance r and the inertance m match with the test values of the residue vibration when the bubble is mixed by setting the acoustic resistance r and the inertance m to be smaller than those in the case of FIG. 8 in which the ink is normally ejected so that the result (graph) as illustrated in FIG. 10 can be obtained. As can be understood from the graphs of FIGS. 8 and 10, when the bubble is mixed into the cavity 141, a characteristic residue vibration waveform in which a frequency becomes higher than in the normal ejection can be obtained. Further, a damping rate of amplitude of the residue vibration is decreased by the decrease of the acoustic resistance r or the like. Therefore, it is confirmed that the amplitude of the residue vibration is slowly decreased.

Figure 11:
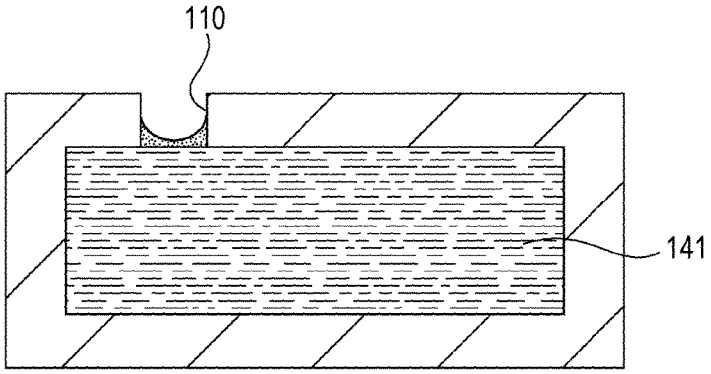
FIG. 11 is a conceptual diagram illustrating a portion near the nozzle when the ink is dried and adhered near the nozzle in FIG. 3.

Next, the drying (adherence or thickening) of the ink near the nozzle 110 which is another reason for the dot omission is discussed. FIG. 11 is a conceptual diagram illustrating a portion near the nozzle 110 when the ink is dried and adhered near the nozzle 110 in FIG. 3. As illustrated in FIG. 11, when the ink near the nozzle 110 is dried and adhered, the state becomes as if the ink in the cavity 141 is trapped in the cavity 141. In this manner, if the ink near the nozzle 110 is dried and thickened, it is considered that the acoustic resistance r increases.

Figure 12:
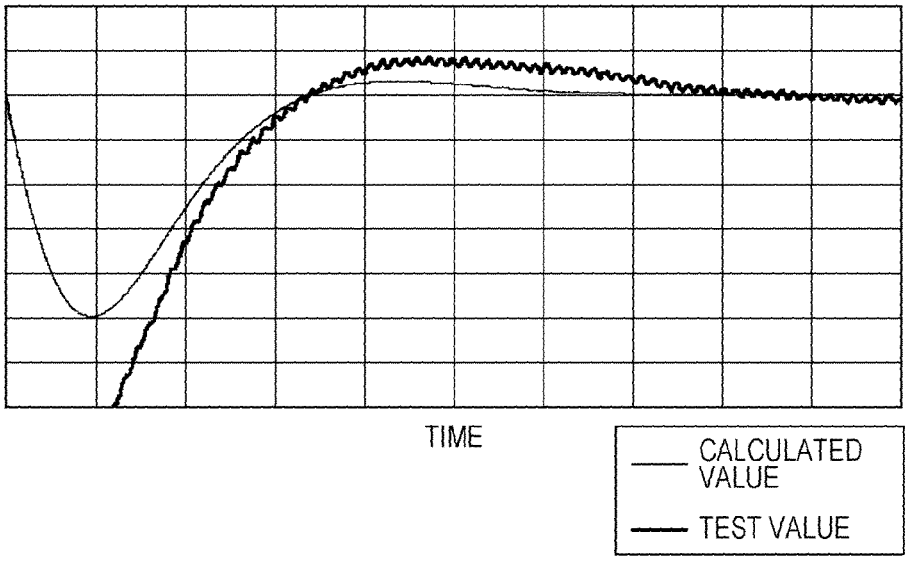
FIG. 12 is a graph illustrating a calculated value and a test value of the residue vibration when the ink is dried and thickened near the nozzle.

Accordingly, the acoustic resistance r matches with the test values of the residue vibration when the ink is dried, and adhered (thickened) near the nozzle 110 by setting the acoustic resistance r to be greater than that in the case of FIG. 8 in which the ink is normally ejected so that the result (graph) as illustrated in FIG. 12 can be obtained. Further, the test value expressed in FIG. 12 is obtained by measuring the residue vibration of the vibration plate 121 in a state in which the head unit 35 without mounting a cap (not illustrated) is left for several days, and the ink near the nozzle 110 is dried and thickened so that the ink is not ejected (the ink is adhered). As can be understood from the graphs of FIGS. 8 and 12, when the ink near the nozzle 110 is dried and adhered, a characteristic residue vibration waveform in which the frequency is excessively lowered, and also the residue vibration is excessively decreased compared with the normal ejection can be obtained. This is because after the ink flows from the reservoir 143 into the cavity 141 by gravitating the vibration plate 121 downwardly in FIG. 3 in order to eject ink drops, when the vibration plate 121 moves upwardly in FIG. 3, the ink in the cavity 141 has nowhere to go, and thus the vibration plate 121 cannot quickly vibrate (excessively damped).

Figure 13:
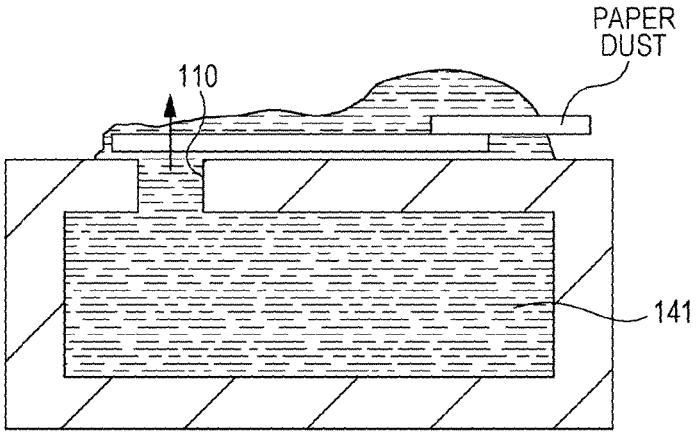
FIG. 13 is a conceptual diagram illustrating a portion near the nozzle when paper dust is attached near an outlet of the nozzle in FIG. 3.

Next, the paper dust attachment near an outlet of the nozzle 110 which is still another cause of the dot omission is discussed. FIG. 13 is a conceptual diagram illustrating a portion near the nozzle 110 when the paper dust is attached near the outlet of the nozzle 110 in FIG. 3. As illustrated in FIG. 13, if the paper dust is attached near the outlet of the nozzle 110, the ink leaks through the paper dust from the inside of the cavity 141, and also the ink does not eject from the nozzle 110. In this manner, if the paper dust is attached near the outlet of the nozzle 110, and the ink leaks from the nozzle 110, when viewed from the vibration plate 121, the ink in the cavity 141 and the leaked ink are more than in the normal state, so it is considered that the inertance m increases. In addition, it is considered that the acoustic resistance r increases by the fiber of the paper dust attached near the outlet of the nozzle 110.

Figure 14:
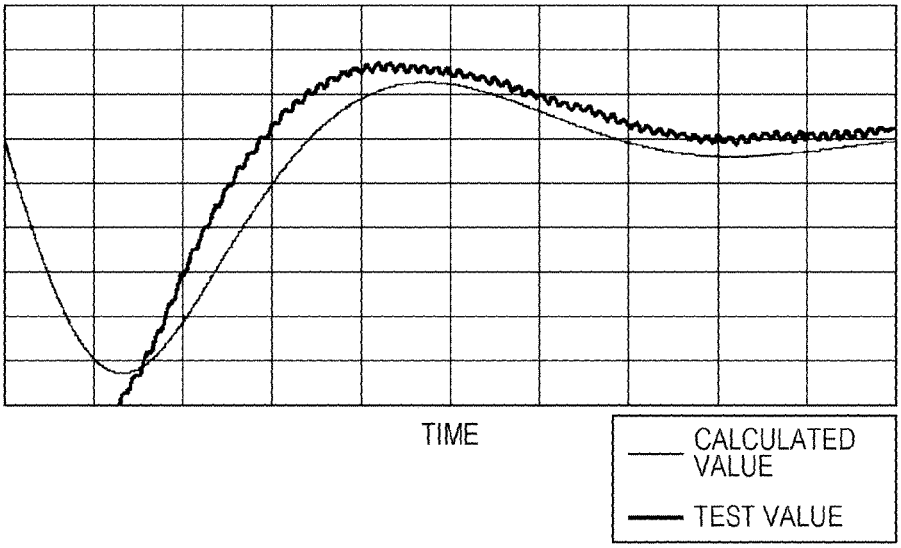
FIG. 14 is a graph illustrating a calculated value and a test value of the residue vibration when the paper dust is attached to the outlet of the nozzle.
Figure 15A:
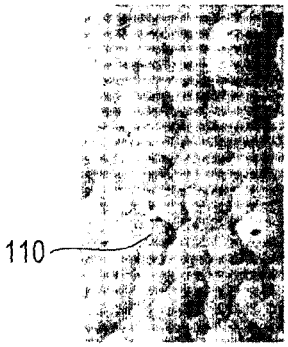
FIGS. 15A and 15B are pictures illustrating states of the nozzle before and after paper dust is attached near the nozzle.
Figure 15B:
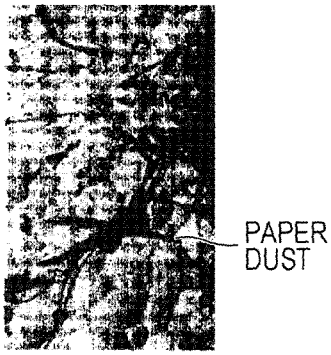

Accordingly, the inertance m and the acoustic resistance r matches with the test values of the residue vibration when the paper dust is attached near the outlet of the nozzle 110 by setting the inertance m and the acoustic resistance r to be greater than that in the case of FIG. 8 in which the ink is normally ejected so that the result (graph) as illustrated in FIG. 14 can be obtained. As can be understood from the graph of FIGS. 8 and 14, a characteristic residue vibration waveform in which when the paper dust is attached near the outlet of the nozzle 110, the frequency is lower than in the normal ejection can be obtained (here, in the paper dust attachment, it can be understood from the graphs of FIGS. 12 and 14, that the frequency of the residue vibration is higher than in the case of the drying of the ink). Further, FIGS. 15A and 15B are pictures illustrating states of the nozzles 110 before and after paper dust is attached. A state in which if the paper dust is attached near the outlet of the nozzle 110, the ink is leaked along the paper dust can be found from FIG. 15B.

Here, when the ink near the nozzle 110 is dried and thickened, and when the paper dust is attached near the outlet of the nozzle 110, the frequencies of damped vibrations are lower than those when the ink drops are normally ejected. The two causes of the dot omission (non-ejection of ink: ejection abnormality) from a waveform of a residue vibration of the vibration plate 121 can be specified, for example, by comparing a frequency, a cycle, a phase of the damped vibration with predetermined threshold values, or from damping rates of a cycle change or an amplitude change of the residue vibration (damped vibration). In this manner, it is possible to detect ejection abnormality of the respective ink jet heads 100 from the changes of the residue vibration of the vibration plates 121 when the ink drops are ejected from the nozzles 110 in the respective ink jet heads 100, especially the change of the frequencies thereof. In addition, it is possible to specify the cause of the ejection abnormality by comparing the frequencies of the residue vibration in that case, with the frequencies of the residue vibration in the normal ejection.

Figure 16:
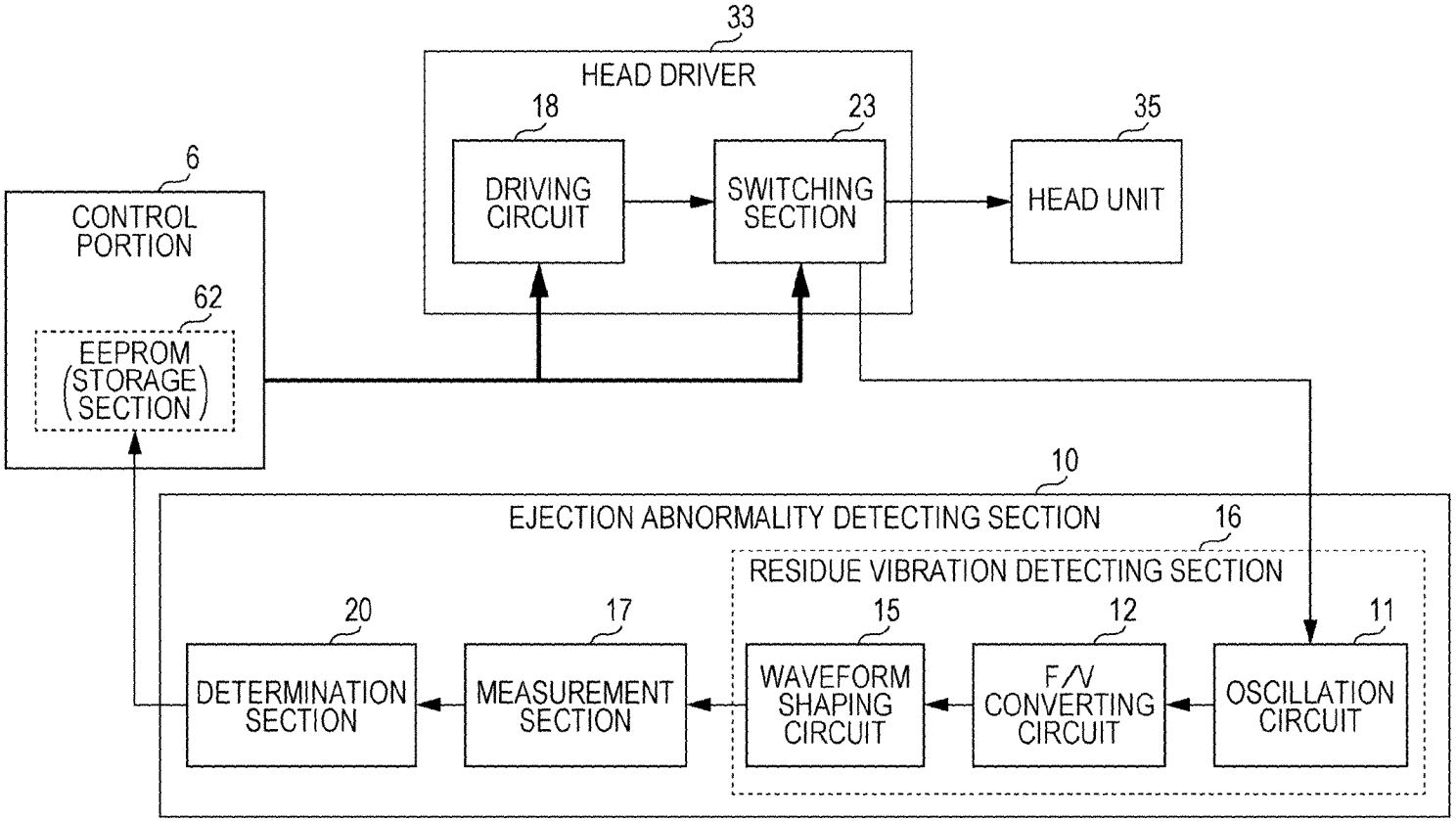
FIG. 16 is a block diagram schematically illustrating the ejection abnormality detecting section.

Next, the ejection abnormality detecting section 10 is described. FIG. 16 is a block diagram schematically illustrating the ejection abnormality detecting section 10 illustrated in FIG. 2. As illustrated in FIG. 16, the ejection abnormality detecting section 10 includes an oscillation circuit 11, an F/V converting circuit 12, a residue vibration detecting section 16 configured with a waveform shaping circuit 15, a measurement section 17 that measures a cycle, an amplitude, or the like from residue vibration waveform data detected by the residue vibration detecting section 16, and a determination section 20 that determines the ejection abnormality of the ink jet heads 100 based on the cycle or the like measured by the measurement section 17. In the ejection abnormality detecting section 10, the oscillation circuit 11 oscillates based on the residue vibrations of the vibration plate 121 of the electrostatic actuator 120, the F/V converting circuit 12 and the waveform shaping circuit 15 form vibration waveforms from the oscillation frequency, and the residue vibration detecting section 16 detects the vibration waveforms. Also, the measurement section 17 measures the cycle or the like of the residue vibration based on the detected vibration waveform, and the determination section 20 detects and determines the ejection abnormality of the respective ink jet heads 100 included in the respective head units 35 of the typing section 3 based on the cycle or the like of the measured residue vibration. Hereinafter, respective elements of the ejection abnormality detecting section 10 are described.

Figure 17:
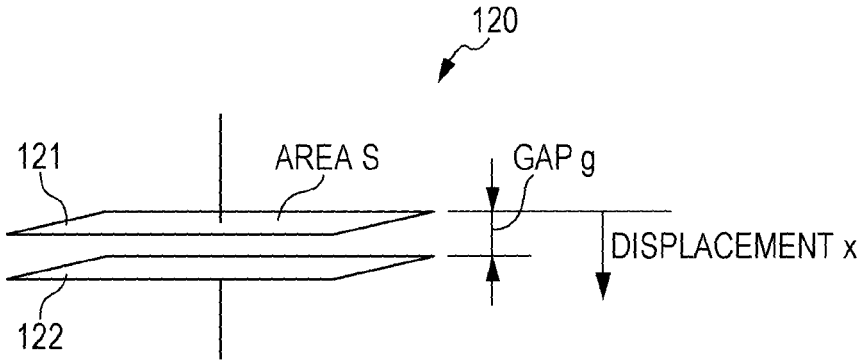
FIG. 17 is a conceptual diagram illustrating a case in which an electrostatic actuator in FIG. 3 is a parallel plate capacitor.
Figure 18:
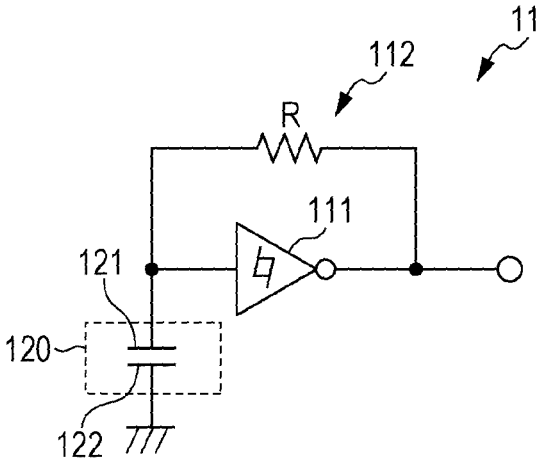
FIG. 18 is a circuit diagram illustrating an oscillation circuit including a capacitor configured with an electrostatic actuator in FIG. 3.

First, a method of using the oscillation circuit 11 in order to detect a frequency (the number of vibrations) of the residue vibrations in the vibration plates 121 of the electrostatic actuators 120 is described. FIG. 17 is a conceptual diagram illustrating a case in which the electrostatic actuator 120 in FIG. 3 is a parallel plate capacitor, and FIG. 18 is a circuit diagram illustrating the oscillation circuit 11 including a capacitor configured with the electrostatic actuator 120 in FIG. 3. Further, the oscillation circuit 11 illustrated in FIG. 18 is a CR oscillation circuit using a hysteresis property of a Schmitt trigger, but is not limited to such a CR oscillation circuit, and any oscillation circuit can be used as long as it is an oscillation circuit using an electrostatic capacity component (capacitor C) of an actuator (including vibration plate). The oscillation circuit 11 may be configured to use, for example, an LC oscillation circuit. In addition, according to the embodiment, an example of using a Schmitt trigger inverter is described, but a CR oscillation circuit, for example, using three steps of inverters may be configured.

In the ink jet head 100 in FIG. 3, as described above, the electrostatic actuator 120 in which the vibration plate 121 and the segment electrode 122 that are separated with an extremely short interval (aperture) form facing electrodes. It may be considered that the electrostatic actuators 120 can be a parallel plate capacitor as illustrated in FIG. 17. If the electrostatic capacity of the capacitor is C, the surface areas of the vibration plate 121 and the segment electrode 122 are respectively S, a distance between the two electrodes 121 and 122 (gap length) is g, a dielectric constant (if dielectric constant of vacuum is $\in_0$, and relative dielectric constant of aperture is $\in_r$, $\in=\in_0\cdot\in_r$) of a space (aperture) interposed between the two electrodes is $\in$, the electrostatic capacity C(x) of a capacitor (the electrostatic actuators 120) illustrated in FIG. 17 is expressed by the following expression.

$$C(x) = \varepsilon_0 \cdot \varepsilon_r \frac{S}{g - x}(F) \tag{4}$$

Further, x in Expression (4) indicates a displacement from a reference position of the vibration plate 121 generated by the residue vibration of the vibration plate 121 as illustrated in FIG. 17.

As it can be understood from Expression (4), if a gap length g (gap length g−displacement x) becomes small, the electrostatic capacity C(x) becomes great. On the contrary, if the gap length g (the gap length g−the displacement x) becomes great, the electrostatic capacity C(x) becomes small. In this manner, the electrostatic capacity C(x) is inversely proportional to (gap length g−displacement x) (gap length g when x is 0). Further, in the electrostatic actuator 120 illustrated in FIG. 3, since the aperture is filled with air, relative dielectric constant $\in_r=1$ is satisfied.

In addition, generally, as the resolution of the liquid ejecting apparatus (the ink jet printer 1 according to the embodiment) becomes higher, ejected ink drops (ink dot) become minute. Therefore, the density of the electrostatic actuator 120 becomes high, and the size of the electrostatic actuator 120 becomes small. Accordingly, a surface area S of the vibration plate 121 of the ink jet head 100 becomes small, and thus the small electrostatic actuator 120 can be configured. Moreover, the gap length g of the electrostatic actuator 120 that changes according to the residue vibration by the ejection of the ink drops is about 10% of an initial gap length $g_0$. Therefore, as it can be understood from Expression (4), the amount of the change in the electrostatic capacity of the electrostatic actuator 120 becomes an extremely small value.

In order to detect the amount of change in the electrostatic capacity of the electrostatic actuator 120 (varies according to vibration pattern of residue vibration), a method described below, that is, a method of configuring an oscillation circuit in FIG. 18 based on the electrostatic capacity of the electrostatic actuator 120 and analyzing a frequency (cycle) of the residue vibration based on the signal obtained by oscillation is used. The oscillation circuit 11 illustrated in FIG. 18 is configured with a capacitor (C) configured with the electrostatic actuator 120 and, a Schmitt trigger inverter 111, and a resistance element (R) 112.

When the output signal of the Schmitt trigger inverter 111 is a high level, the capacitor C is charged through the resistance element 112. If a charging voltage of the capacitor C (electrical potential difference between the vibration plates 121 and the segment electrodes 122) reaches an input threshold voltage $V_T+$ of the Schmitt trigger inverter 111, an output signal of the Schmitt trigger inverter 111 is inverted to a low level. Also, if the output signal of the Schmitt trigger inverter 111 is the low level, charges charged in the capacitor C through the resistance element 112 are discharged. If the voltage of the capacitor C reaches the input threshold voltage $V_T-$ of the Schmitt trigger inverter 111 by the discharging, the output signal of the Schmitt trigger inverter 111 is inverted again to the high level. Thereafter, the oscillation operation repeats.

Here, in order to detect the time change of the electrostatic capacity of the capacitor C according to the respective phenomenon (bubble mixture, drying, paper dust attachment, and normal ejection), it is required that the oscillation frequency by the oscillation circuit 11 is set to be an oscillation frequency capable of detecting a frequency when a bubble is mixed (see FIG. 10), which is the highest frequency of the residue vibration. Therefore, the oscillation frequency of the oscillation circuit 11 has to be set to be, for example, a frequency equal to or greater than several times to several ten times of the detected frequency of the residue vibration, that is, a frequency greater than the frequency when the bubble is mixed by 1 digit. In this case, since the frequency of the residue vibration when the bubble is mixed is preferably higher than the frequency in the normal ejection, the residue vibration frequency when the bubble is mixed may be set to be a detectable oscillation frequency. Otherwise, a correct frequency of the residue vibration against the ejection abnormality phenomenon may not be detected. Therefore, according to the embodiment, a time constant of CR of the oscillation circuit 11 is set according to the oscillation frequency. In this manner, a more correct residue vibration waveform can be detected based on the minute change of the oscillation frequency by setting the oscillation frequency of the oscillation circuit 11 to be high.

Further, the pulse is counted for each cycle (pulse) of the oscillation frequency of the oscillation signal output from the oscillation circuit 11, by using the count pulse (counter) for measurement, and the counted amount of the pulse of the oscillation frequency when oscillation is performed with the electrostatic capacity of the capacitor C in the initial gap $g_0$ is subtracted from the measured count amount, so that the digital information for each oscillation frequency with respect to the residue vibration waveform can be obtained. The schematic residue vibration waveform can be generated by performing digital/analog (D/A) conversion based on the digital information. The above method may be performed, but a waveform having a high frequency (high resolution) capable of measuring a minute change of the oscillation frequency is required in the count pulse (counter) for measuring. Since the count pulse (counter) like this increases the cost, the ejection abnormality detecting section 10 uses the F/V converting circuit 12 illustrated in FIG. 19.

Figure 19:
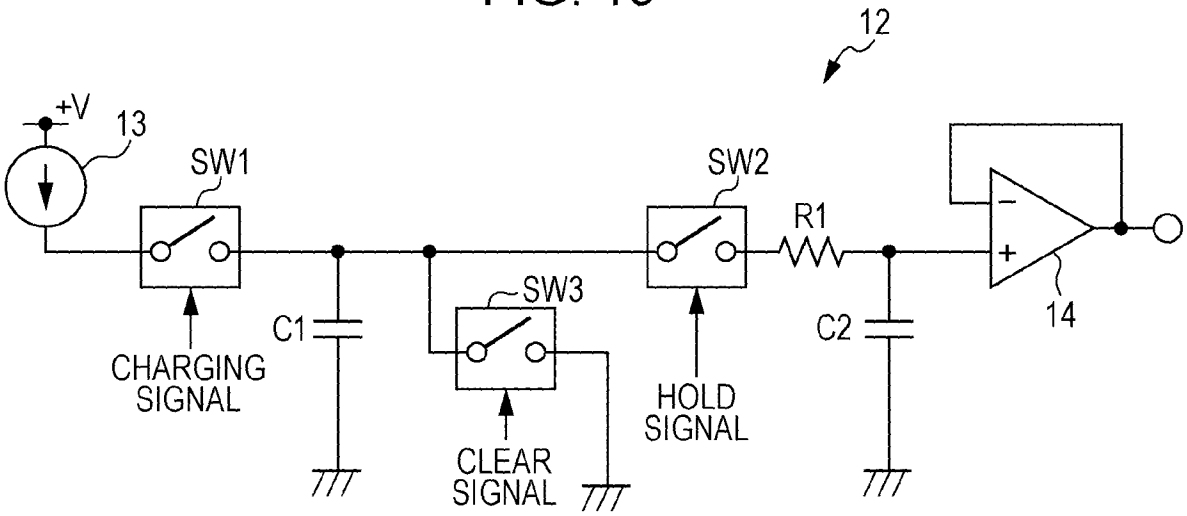
FIG. 19 is a circuit diagram illustrating an F/V converting circuit of the ejection abnormality detecting section illustrated in FIG. 16.

FIG. 19 is a circuit diagram illustrating the F/V converting circuit 12 of the ejection abnormality detecting section 10 illustrated in FIG. 16. As illustrated in FIG. 19, the F/V converting circuit 12 is configured with three switches SW1, SW2, and SW3, the two capacitors C1 and C2, a resistance element R1, a constant current source 13 that outputs a constant current Is, and a buffer 14. The operation of the F/V converting circuit 12 is described with reference to a timing chart of FIG. 20 and a graph of FIG. 21.

Figure 20:
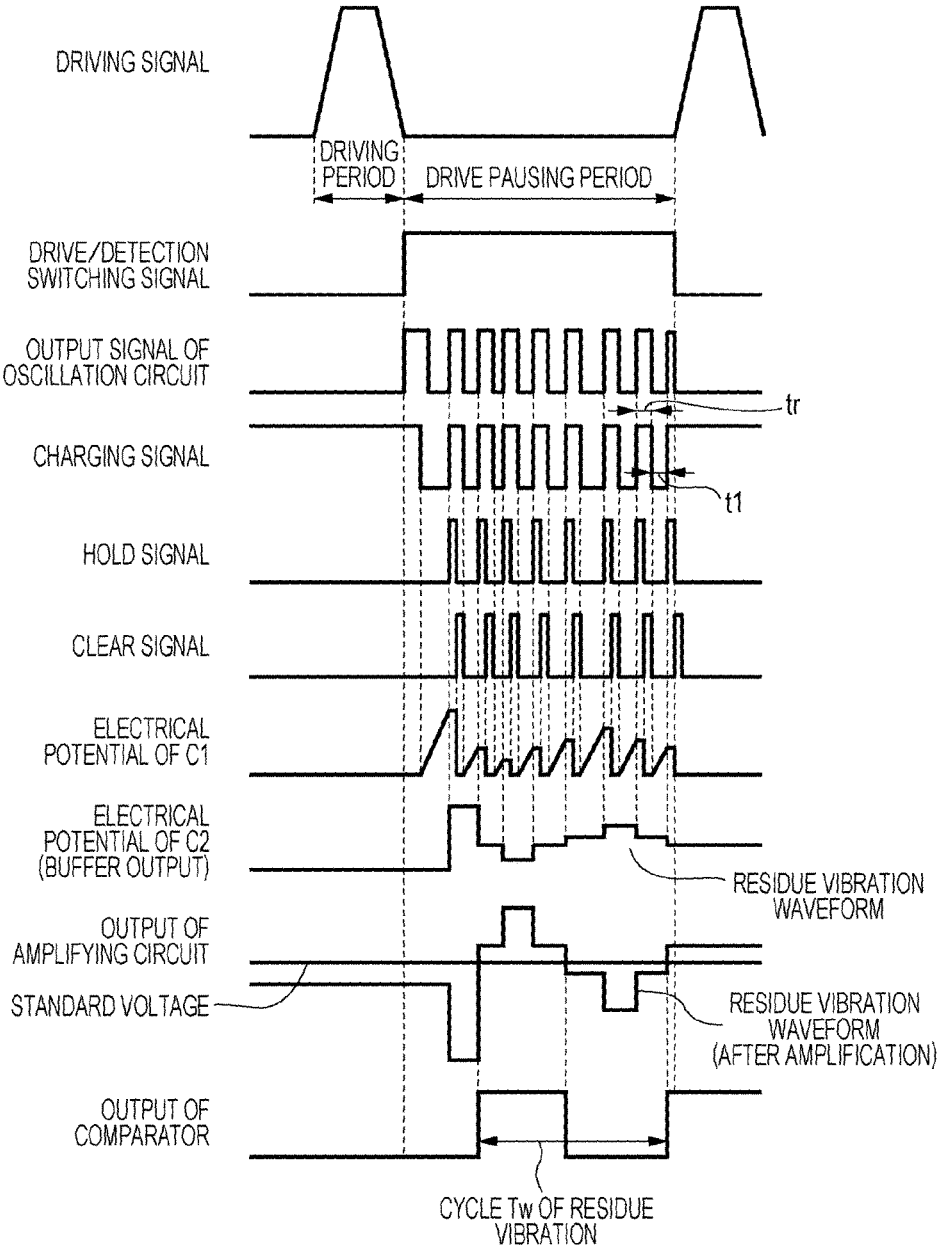
FIG. 20 is a timing chart illustrating timings of output signals of respective portions based on oscillation frequencies output from the oscillation circuit.

First, a method of generating a charging signal, a hold signal, and a clear signal illustrated in the timing chart of FIG. 20 is described. The charging signal is generated by setting a fixed time tr from a rising edge of the oscillation pulse of the oscillation circuit 11 so that the charging signal becomes the high level during the fixed time tr. The hold signal is generated to rise in synchronization with the rising edge of the charging signal, is held in the high level for a predetermined fixed time, and then fall to the low level. The clear signal is generated to rise in synchronization with the falling edge of the hold signal, is held in the high level for a predetermined fixed time, and fall to the low level. Further, as described below, since the movement of the charge from the capacitor C1 to the capacitor C2 and the discharging of the capacitor C1 are instantly performed, the hold signal and the clear signal each include one pulse until the next rising edge of the output signal of the oscillation circuit 11, and are not limited to the rising edge and the falling edge.

Figure 21:
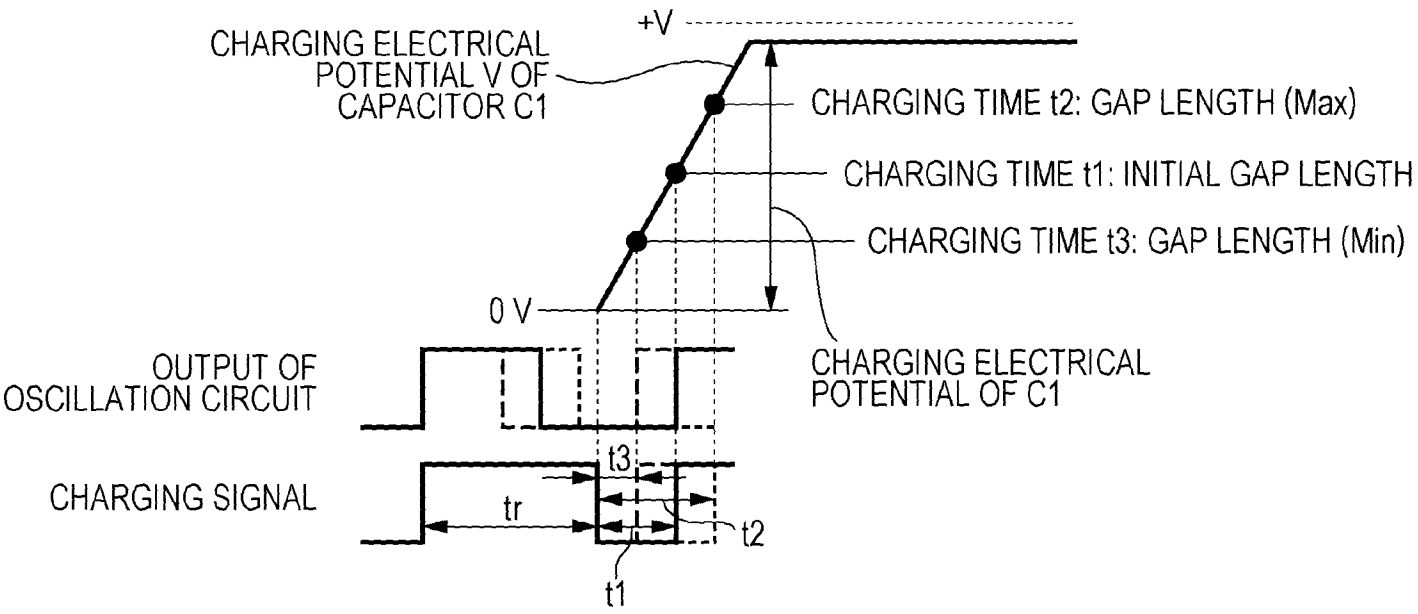
FIG. 21 is a diagram illustrating a method of setting fixed times tr and t1.

In order to obtain a clear waveform (voltage waveform) of the residue vibration, a method of setting the fixed times tr and t1 is described with reference to FIG. 21. The fixed time tr is adjusted from the cycle of the oscillation pulse in which the electrostatic actuator 120 oscillates with the electrostatic capacity C in the initial gap length $g_0$, and is set so that the charging electrical potential at the charging time t1 becomes about ½ of the charging scope of C1. In addition, the inclination of the charging electrical potential is set not to exceed the charging scope of the capacitor C1 between a charging time t2 at the position in which the gap length g becomes maximum (Max) and a charging time t3 at the position in which the gap length g becomes minimum (Min). That is, since the inclination of the charging electrical potential is determined by dV/dt=Is/C1, the output constant current Is of the constant current source 13 may be set to be an appropriate value. The minute change of the electrostatic capacity of the capacitor configured with the electrostatic actuator 120 can be detected by setting the output constant current Is of the constant current source 13 to be as high as possible within the scope. Therefore, the minute change of the vibration plate 121 of the electrostatic actuator 120 can be detected.

Figure 22:
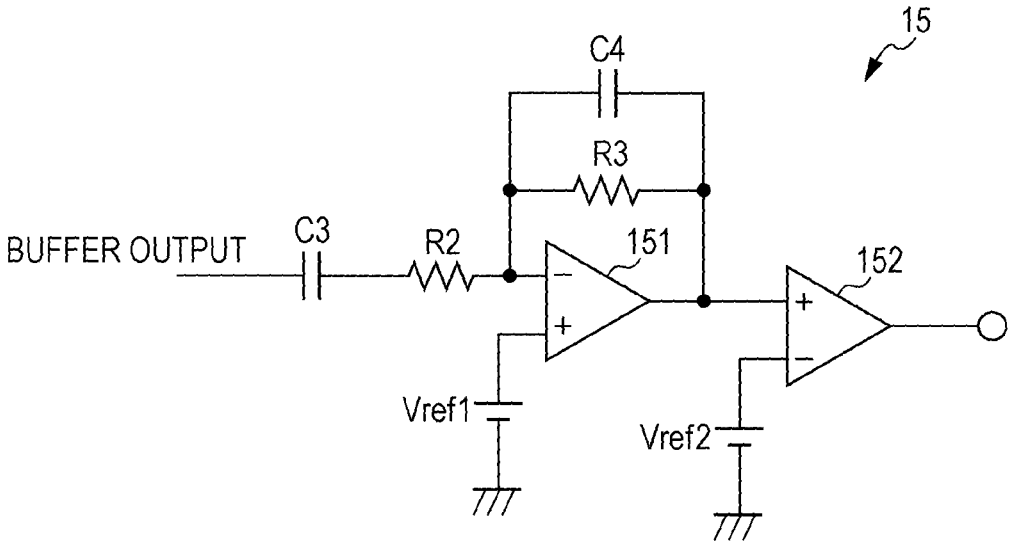
FIG. 22 is a circuit diagram illustrating a circuit configuration of a waveform shaping circuit in FIG. 16.

Next, the configuration of the waveform shaping circuit 15 illustrated in FIG. 16 is described with reference to FIG. 22. FIG. 22 is a circuit diagram illustrating a circuit configuration of the waveform shaping circuit 15 in FIG. 16. The waveform shaping circuit 15 outputs the residue vibration waveform to the determination section 20 as a square wave. As illustrated in FIG. 22, the waveform shaping circuit 15 is configured with two capacitors C3 (DC component removing section) and C4, two resistance elements R2 and R3, two direct current voltage sources Vref1 and Vref2, an amplifier (operational amplifier) 151, and a comparator 152. Further, the waveform shaping process of the residue vibration waveform may be configured so that the detected peak value is output without change, and the amplitude of the residue vibration waveform is measured.

The electrostatic capacity component of the DC component (direct current component) based on the initial gap $g_0$ of the electrostatic actuator 120 is included in the output of the buffer 14 of the F/V converting circuit 12. Since the direct current component varies due to the respective ink jet heads 100, the capacitor C3 removes the direct current component of the electrostatic capacity. Also, the capacitor C3 removes the DC component according to the output signal of the buffer 14, and outputs only the AC component of the residue vibration to the inverted input terminal of the operational amplifier 151.

The operational amplifier 151 is configured with a low pass filter that inverts and amplifies an output signal of the buffer 14 of the F/V converting circuit 12 removed by the direct current component, and also removes a high frequency of the output signal. Further, it is assumed that the operational amplifier 151 is a single power supply circuit. The operational amplifier 151 configures an inverted amplifier with the two resistance elements R2 and R3, and the input residue vibration (alternating current component) is amplified by −R3/R2 times.

In addition, the amplified residue vibration waveform of the vibration plate 121 that vibrates about the electrical potential set by the direct current voltage source Vref1 connected to the non-inverted input terminal is output for a single power supply operation of the operational amplifier 151. Here, the direct current voltage source Vref1 is set to be about ½ of the voltage scope in which the operational amplifier 151 can operate with a single power supply. Moreover, the operational amplifier 151 configures a low pass filter with the two capacitors C3 and C4, which satisfies on/off frequency $1/(2\pi \times C4 \times R3)$. Also, the residue vibration waveform of the vibration plate 121 amplified after the direct current component is removed is compared with the electrical potential of another direct current voltage source Vref2 in the comparator 152 in the next step as illustrated in the timing chart of FIG. 20, and the comparison result is output from the waveform shaping circuit 15 as a square wave. Further, another direct current voltage source Vref1 may be used as the direct current voltage source Vref2.

Next, with reference to the timing chart illustrated in FIG. 20, operations of the F/V converting circuit 12 in FIG. 19 and the waveform shaping circuit 15 are described. The F/V converting circuit 12 illustrated in FIG. 19 operates based on the charging signal, the clear signal, and the hold signal generated as described above. In the timing chart of FIG. 20, if the driving signal of the electrostatic actuator 120 is input to the ink jet head 100 through the head driver 33, the vibration plate 121 of the electrostatic actuator 120 can be drawn to the segment electrode 122 side as illustrated in FIG. 6B, and drastically shrinks upwardly in FIGS. 6A to 6C in synchronization with the falling edge of the driving signal (see FIG. 6C).

A drive/detection switching signal that switches the driving circuit 18 and the ejection abnormality detecting section 10 becomes the high level in synchronization with the falling edge of the driving signal. The drive/detection switching signal is held to be the high level during the drive pausing period of the corresponding ink jet head 100, and becomes the low level before the next driving signal is input. While the drive/detection switching signal is the high level, the oscillation circuit 11 in FIG. 18 oscillates while changing the oscillation frequency corresponding to the residue vibration of the vibration plate 121 of the electrostatic actuator 120.

As described above, the charging signal is held in the high level until the falling edge of the driving signal, that is, from the rising edge of the output signal of the oscillation circuit 11 until the fixed time tr set in advance so that the waveform of the residue vibration does not exceed the chargeable scope in the capacitor C1 passes. Further, while the charging signal is the high level, the switch SW1 is in the off state.

When the fixed time tr passes, and the charging signal becomes the low level, the switch SW1 is turned on in synchronization with the falling edge of the charging signal (see FIG. 19). Also, the constant current source 13 and the capacitor C1 are connected to each other, the capacitor C1 is charged with the inclination Is/C1 as described above. The capacitor C1 is charged during the period in which the charging signal is the low level, that is, until the charging signal becomes the high level in synchronization with the rising edge of the next pulse of the output signal of the oscillation circuit 11.

If the charging signal becomes the high level, the switch SW1 is turned off (open), and the constant current source 13 and the capacitor C1 are separated. At this point, the electrical potential (that is, ideally Is×t1/C1 (V)) charged during the period t1 in which the charging signal is in the low level is stored in the capacitor C1. In this state, if the hold signal becomes the high level, the switch SW2 is turned on (see FIG. 19), the capacitor C1 and the capacitor C2 are connected to each other through the resistance element R1. After the switch SW2 is connected, the two capacitors C1 and C2 are charged and discharged from each other by the charging electrical potential difference of the two capacitors C1 and C2, and charges move from the capacitor C1 to the capacitor C2 so that the electrical potential differences of the two capacitors C1 and C2 are substantially the same.

Here, with respect to the electrostatic capacity of the capacitor C1, the electrostatic capacity of the capacitor C2 is set to be equal to or lower than about 1/10. Therefore, the charge amount that moves (is used) by the charging and discharging generated by the electrical potential difference between the two capacitors C1 and C2 becomes equal to or lower than 1/10 of the charges charged in the capacitor C1. Accordingly, after the charges move from the capacitor C1 to the capacitor C2, the electrical potential difference of the capacitor C1 does not change very much (is not decreased not very much). Further, in the F/V converting circuit 12 of FIG. 19, a preliminary low pass filter is configured with the resistance element R1 and the capacitor C2, so that the charging electrical potentials do not drastically jump by inductance of wiring of the F/V converting circuit 12 when being charged in the capacitor C2, or the like.

After charging electrical potentials substantially the same as the charging electrical potentials of the capacitor C1 is held in the capacitor C2, the hold signal becomes the low level, and the capacitor C1 is separated from the capacitor C2. Moreover, the clear signal becomes the high level, and the switch SW3 is turned on so that the capacitor C1 is connected to a ground GND, and performs a discharging operation to cause the charges charged in the capacitor C1 to be 0. After the capacitor C1 is discharged, the clear signal becomes the low level, and the switch SW3 is turned off so that the electrode of the capacitor C1 on the upper portion of FIG. 19 is separated from the ground GND, and the capacitor C1 stands by until the next charging signal is input, that is, the charging signal becomes the low level.

The electrical potential held in the capacitor C2 is updated for each timing of the rising of the charging signal, that is, timing at which the charging of the capacitor C2 is completed, is output to the waveform shaping circuit 15 of FIG. 22, as the residue vibration waveform of the vibration plate 121 through the buffer 14. Accordingly, if the electrostatic capacity of the electrostatic actuator 120 (in this case, a variation width of the electrostatic capacity by the residue vibration has to be considered) and the resistance value of the resistance element 112 are set so that the oscillation frequency of the oscillation circuit 11 increases, the respective steps of the electrical potential (output of the buffer 14) of the capacitor C2 illustrated in the timing chart in FIG. 20 become more minute. Therefore, it is possible to detect the change of the electrostatic capacity in time by the residue vibration of the vibration plate 121 in great detail.

In the same manner, hereinafter, the charging signal repeats from the low level to the high level, to the low level, and the like, and the electrical potential held in the capacitor C2 at the predetermined timing is output to the waveform shaping circuit 15 through the buffer 14. In the waveform shaping circuit 15, the direct current component of the voltage signal (electrical potential of the capacitor C2 in the timing chart of FIG. 20) input from the buffer 14 is removed by the capacitor C3, and input to the inverted input terminal of the operational amplifier 151 through the resistance element R2. The alternating current (AC) component of the input residue vibration is inverted and amplified by the operational amplifier 151, and output to the input terminal on one side of the comparator 152. The comparator 152 compares the electrical potential (reference voltage) set by the direct current voltage source Vref2 in advance and the electrical potential of the residue vibration waveform (alternating current component), and outputs the square wave (outputs of comparator circuit in timing chart of FIG. 20).

Figure 23:
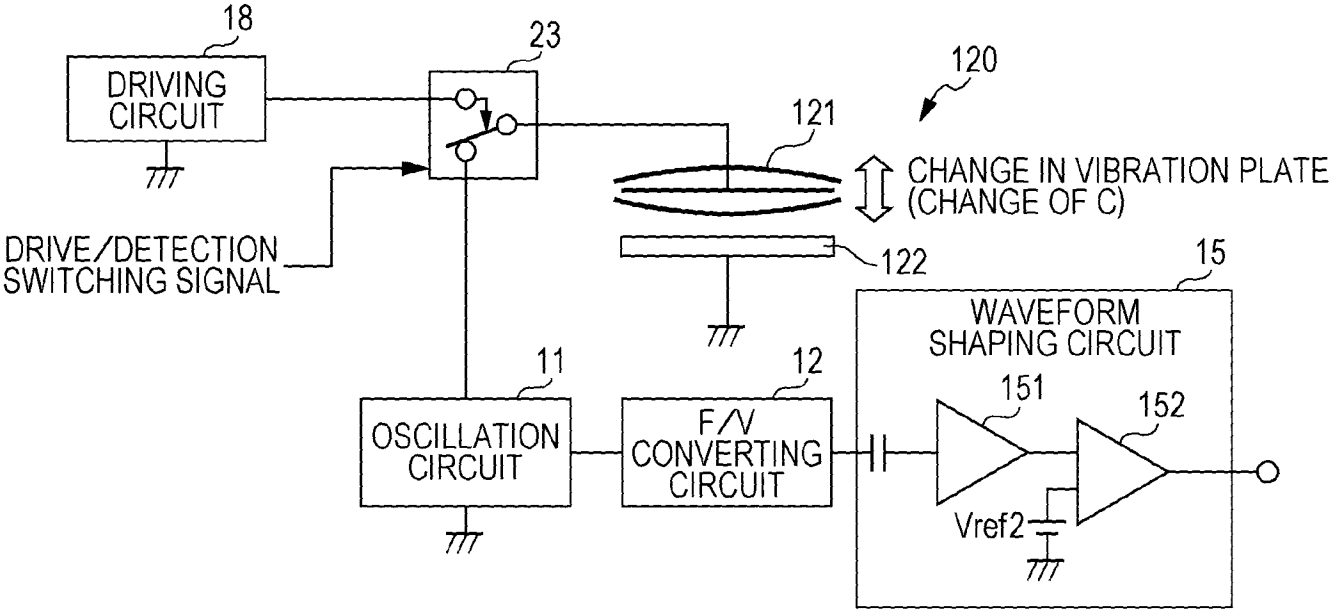
FIG. 23 is a block diagram schematically illustrating a switching section between a driving circuit and a detection circuit.

Next, a switching timing of an ink drop ejection operation (drive) and the ejection abnormality detecting operation (drive stop) by the ink jet head 100 is described. FIG. 23 is a block diagram schematically illustrating the switching section 23 between the driving circuit 18 and the ejection abnormality detecting section 10. Further, in FIG. 23, the driving circuit 18 in the head driver 33 illustrated in FIG. 16 is described as the driving circuit of the ink jet head 100. As illustrated in the timing chart of FIG. 20, the ejection abnormality detecting process is performed between the driving signals of the ink jet head 100, that is, during the drive pausing period.

In FIG. 23, the switching section 23 is initially connected to the driving circuit 18 side, in order to drive the electrostatic actuators 120. As described above, if the driving signal (voltage signal) from the driving circuit 18 is input to the vibration plate 121, the electrostatic actuator 120 is driven, and the vibration plate 121 can be drawn to the segment electrode 122 side. If the application voltage becomes 0, the vibration plate 121 is drastically displaced in a direction of being separated from the segment electrode 122, and the vibration (residue vibration) starts. At this point, the ink drop is ejected from the nozzle 110 of the ink jet head 100.

If the pulse of the driving signal falls, the drive/detection switching signal (refers to the timing chart of FIG. 20) is input to the switching section 23 in synchronization with the falling edge, the switching section 23 switches from the driving circuit 18 to the ejection abnormality detecting section (detection circuit) 10 side, and the electrostatic actuator 120 (using capacitor as the oscillation circuit 11) is connected to the ejection abnormality detecting section 10.

Also, the ejection abnormality detecting section 10 performs the ejection abnormality detection process (dot omission) as described above, and digitizes the residue vibration waveform data (square wave data) of the vibration plate 121 output from the comparator 152 of the waveform shaping circuit 15 such as the cycle or the amplitude of the residue vibration waveform with the measurement section 17. According to the embodiment, the measurement section 17 measures a specific vibration cycle from the residue vibration waveform data, and outputs the measurement result (numerical value) to the determination section 20.

Specifically, the measurement section 17 counts the pulse of the reference signal (predetermined frequency) by using a counter (not illustrated) in order to measure time (cycle of residue vibration) from the initial rising edge to the next rising edge of the waveform (square wave) of the output signal of the comparator 152, and measures the cycle of the residue vibration (specific vibration cycle) from the counted value. Further, the measurement section 17 may measure the time from the initial rising edge to the next falling edge, and may output twice the measured time as the cycle of the residue vibration to the determination section 20. Hereinafter, the cycle of the residue vibration obtained in this manner is set to be Tw.

The determination section 20 determines the existence or the non-existence of the ejection abnormality of the nozzle, the cause of ejection abnormality, the comparison deviation amount, and the like based on the specific vibration cycle (measurement result) of the residue vibration waveform measured by the measurement section 17 or the like, and outputs the determination result to the control portion 6. The control portion 6 stores the determination result in a predetermined storage area of the EEPROM (storage section) 62. Also, the drive/detection switching signal is input to the switching section 23 again at the timing at which the next driving signal is input from the driving circuit 18, and the driving circuit 18 and the electrostatic actuator 120 are connected to each other. If the driving voltage is applied once, the driving circuit 18 maintains the ground (GND) level, so the switching is performed as described above by the switching section 23 (see timing chart of FIG. 20). Accordingly, the residue vibration waveform of the vibration plate 121 of the electrostatic actuator 120 can be detected without being influenced by the disturbance from the driving circuit 18 or the like.

Further, the residue vibration waveform data is not limited to be converted into the square wave by the comparator 152. For example, it may be configured that the residue vibration amplitude data output from the operational amplifier 151 is occasionally digitized by the measurement section 17 that performs the A/D conversion without performing the comparison process by the comparator 152, the existence or the non-existence of the ejection abnormality is determined by the determination section 20 based on the data digitized, and the determination result is stored in the storage section 62.

In addition, since the meniscus of the nozzle 110 (surface on which the ink in the nozzle 110 comes into contact with the air) vibrates in synchronization with the residue vibration of the vibration plates 121, the ink jet heads 100 waits for the damping of the residue vibration of the meniscus by the acoustic resistance r for a roughly determined time after the ejection operation of the ink drops (waits for a predetermined time), and performs the next ejection operation. According to the embodiment, since the residue vibration of the vibration plate 121 is detected by effectively using the waiting time, ejection abnormality detection that does not influence the driving of the ink jet head 100 can be performed. That is, the ejection abnormality detecting process of the nozzle 110 of the ink jet head 100 can be performed without being decreased the throughput of the ink jet printer 1 (liquid ejecting apparatus).

As described above, when the bubbles are mixed into the cavity 141 of the ink jet head 100, the frequencies are higher than those of the residue vibration waveform of the vibration plate 121 in the normal ejection, so the cycle is conversely shorter than the cycle of the residue vibration in the normal ejection. In addition, when the ink near the nozzle 110 is dried, thickened, and adhered, the residue vibration is excessively damped, so the frequency is considerably lowered compared with the residue vibration waveform in the normal ejection. Therefore, the cycle thereof is quite longer than that of the residue vibration in the normal ejection. In addition, when the paper dust is attached near the outlet of the nozzle 110, the frequency of the residue vibration is lower than the frequency of the residue vibration in the normal ejection, but is higher than the frequency of the residue vibration when the ink is dried. The cycle becomes longer than the cycle of the residue vibration in the normal ejection, and becomes shorter than the cycle of the residue vibration when the ink is dried.

Accordingly, as the cycle of the residue vibration in the normal ejection, a predetermined scope Tr is provided. In addition, in order to differentiate the cycle of residue vibration when the paper dust is attached at the outlet of the nozzle 110, and the cycle of the residue vibration when the ink is dried near the outlet of the nozzle 110, a predetermined threshold value T1 is set. Therefore, the cause of the ejection abnormality of the ink jet head 100 can be determined. The determination section 20 determines whether the cycle Tw of the residue vibration waveform detected in the ejection abnormality detecting process is in the cycle of the predetermined scope, and also whether the cycle Tw is longer than a predetermined threshold value, and accordingly determines the cause of the ejection abnormality.

Figure 24:
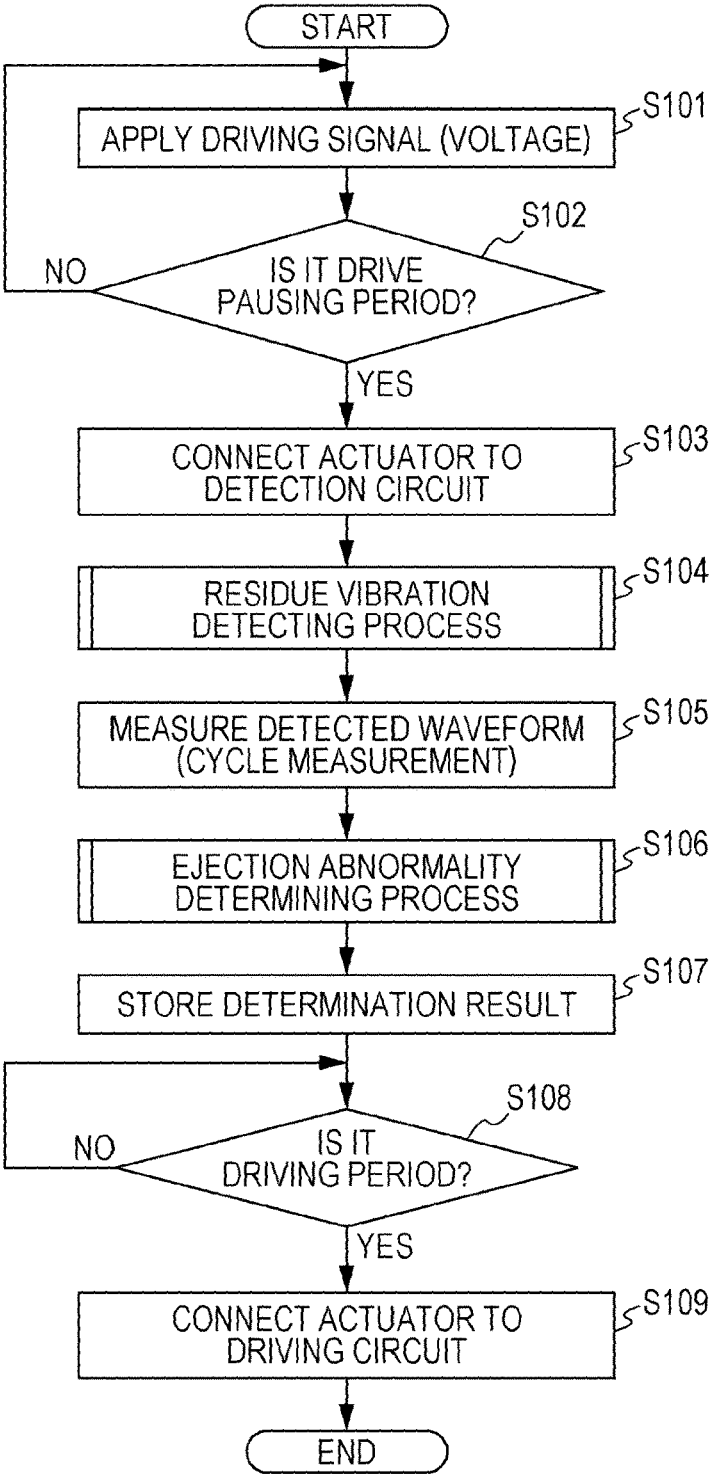
FIG. 24 is a flowchart illustrating an ejection abnormality detecting and determining process.

Next, an operation of the liquid ejecting apparatus according to the embodiment is described based on the configuration of the ink jet printer 1 described above. First, the ejection abnormality detecting process (including driving/detecting switching process) on the one nozzle 110 of the ink jet head 100 is described. FIG. 24 is a flowchart illustrating the ejection abnormality detecting and determining process. If the typing data to be printed (or may be ejection data in the flushing operation) is input from the host computer 8 through the interface (IF) 9 to the control portion 6, the ejection abnormality detecting process is performed at a predetermined timing. Further, for convenience of explanation, the ejection abnormality detecting process corresponding to the ejection operation corresponding to one ink jet head 100, that is, one nozzle 110 is illustrated in the flowchart illustrated in FIG. 24.

First, if the driving signal corresponding to the typing data (ejection data) is input from the driving circuit 18 of the head driver 33, the driving signal (voltage signal) is accordingly applied between both electrodes of the electrostatic actuator 120 based on the timing of the driving signal as illustrated in timing chart of FIG. 20 (Step S101). Also, the control portion 6 determines whether the ink jet head 100 to perform ejection is in the drive pausing period or not based on the drive/detection switching signal (Step S102). Here, the drive/detection switching signal becomes the high level in synchronization with the falling edge of the driving signal (see FIG. 20), and is input from the control portion 6 to the switching section 23.

If the drive/detection switching signal is input to the switching section 23, the electrostatic actuator 120, that is, a capacitor that configures the oscillation circuit 11 is separated from the driving circuit 18 by the switching section 23, is connected to the ejection abnormality detecting section 10 (detection circuit) side, that is, the oscillation circuit 11 of the residue vibration detecting section 16 (Step S103). Also, the residue vibration detecting process described below is performed (Step S104), the measurement section 17 measures a predetermined numerical value from the residue vibration waveform data detected in the residue vibration detecting process (Step S105). Here, as described above, the measurement section 17 measures the cycle of the residue vibration thereof from the residue vibration waveform data.

Subsequently, the ejection abnormality determining process described below is performed by the determination section 20, based on the measurement result of the measurement section (Step S106), and the determination result is stored in a predetermined storage area of the EEPROM (storage section) 62 of the control portion 6. Also, in Step S108, the determination section 20 determines whether the ink jet head 100 is in the driving period or not. That is, the determination section 20 stands by in Step S108, until the drive pausing period is ended, and the driving signal is input by determining whether the next driving signal is input.

At the timing when the pulse of the next driving signal is input, if the drive/detection switching signal becomes the low level in synchronization with the rising edge of the driving signal (Yes in Step S108), the switching section 23 switches the connection of the electrostatic actuator 120, from the ejection abnormality detecting section (detection circuit) 10 to the driving circuit 18 (Step S109), and the ejection abnormality detecting process is ended.

Further, the flowchart illustrated in FIG. 24 illustrates a case in which the measurement section 17 measures the cycle from the residue vibration waveform detected by the residue vibration detecting process (the residue vibration detecting section 16), but the invention is not limited to this case. For example, the measurement section 17 may measure the phase difference or the amplitude of the residue vibration waveform from the residue vibration waveform data detected in the residue vibration detecting process.

Figure 25:
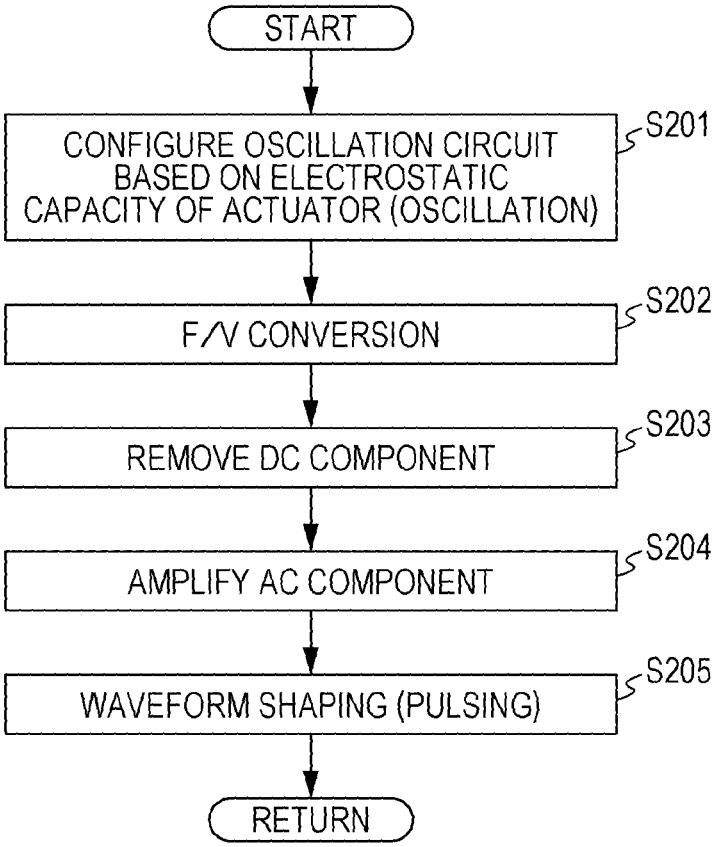
FIG. 25 is a flowchart illustrating a residue vibration detecting process.

Next, the residue vibration detecting process (subroutine) in Step S104 of the flowchart illustrated in FIG. 24 is described. FIG. 25 is a flowchart illustrating the residue vibration detecting process. As described above, if the electrostatic actuator 120 and the oscillation circuit 11 are connected to each other by the switching section 23 (Step S103 of FIG. 24), the oscillation circuit 11 configures the CR oscillation circuit, and oscillates based on the change of the electrostatic capacity of the electrostatic actuator 120 (residue vibration of the vibration plate 121 of the electrostatic actuator 120) (Step S201).

As illustrated in the timing chart described above, the charging signal, the hold signal, and the clear signal are generated in the F/V converting circuit 12 based on the output signal (pulse signal) of the oscillation circuit 11, and the F/V converting process for converting the frequency of the output signal of the oscillation circuit 11 to the voltage by the F/V converting circuit 12 is performed (Step S202), the residue vibration waveform data of the vibration plate 121 is output from the F/V converting circuit 12. The DC component (direct current component) is removed from the residue vibration waveform data output from the F/V converting circuit 12 by the capacitor C3 of the waveform shaping circuit 15 (Step S203), the residue vibration waveform (AC component) from which the DC component is removed is amplified by the operational amplifier 151 (Step S204).

The residue vibration waveform data after the amplification is subjected to the waveform shaping by the predetermined process, and is pulsed (Step S205). That is, according to the embodiment, the voltage value (predetermined voltage value) set by the direct current voltage source Vref2 is compared with the output voltage of the operational amplifier 151, in the comparator 152. The comparator 152 outputs the binarized waveform (square wave) based on the comparison result. The output signal of the comparator 152 is the output signal of the residue vibration detecting section 16 and is output to the measurement section 17 in order to perform the ejection abnormality determining process, and the residue vibration detecting process is ended.

Figure 26:
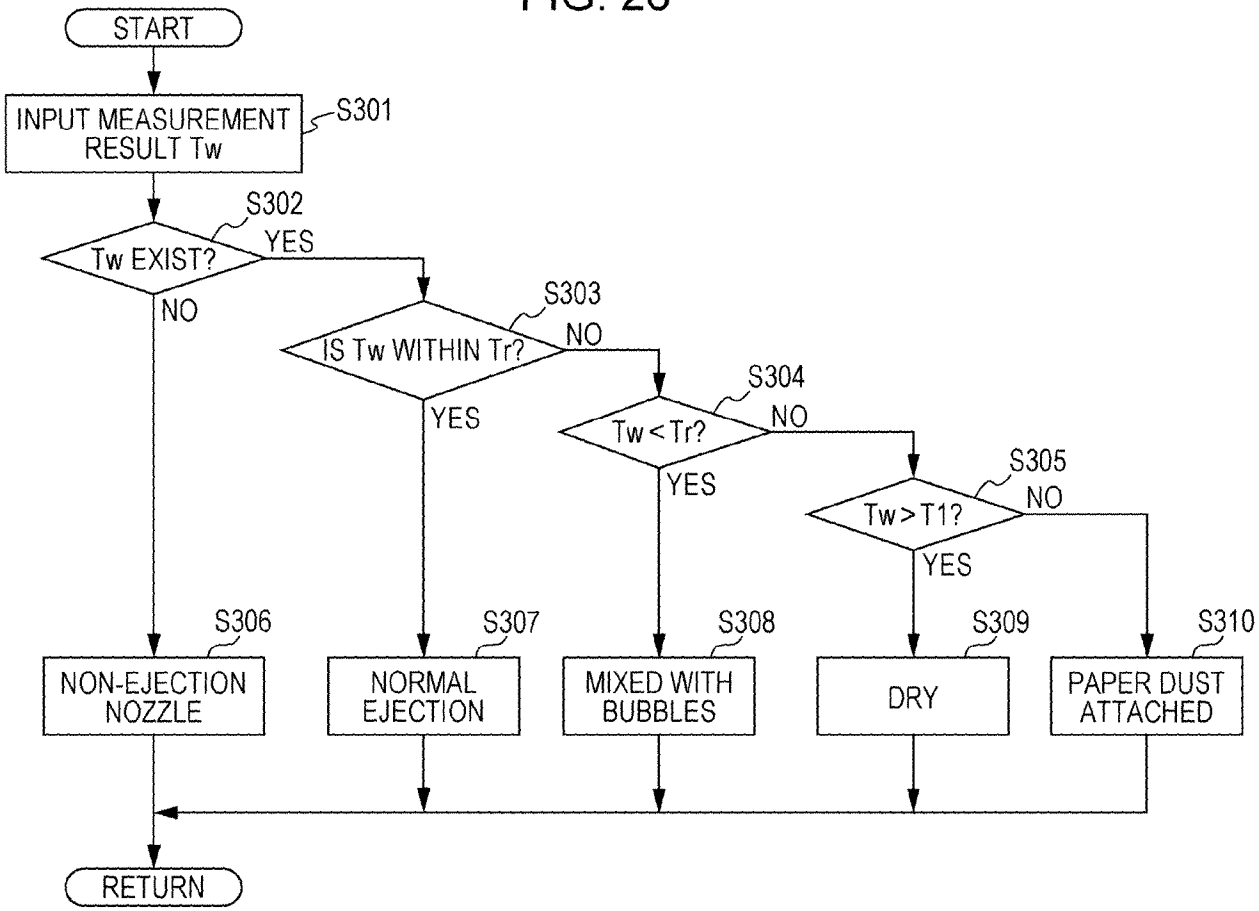
FIG. 26 is a flowchart illustrating an ejection abnormality determining process.

Next, the ejection abnormality determining process (subroutine) in Step S106 of the flowchart illustrated in FIG. 24 is described. FIG. 26 is a flowchart illustrating the ejection abnormality determining process performed by the control portion 6 and the determination section 20. The determination section 20 determines whether the ink drops are normally ejected from the corresponding ink jet head 100 based on the measurement data (measurement result) such as the cycle, which is measured by the measurement section 17 described above, and if the ink drops are not normally ejected, that is, if the ejection abnormality occurs, the determination section 20 determines what is the cause thereof.

First, the control portion 6 outputs the predetermined scope Tr of the cycle of the residue vibration saved in the EEPROM 62 and the predetermined threshold value T1 of the cycle of the residue vibration to the determination section 20. The predetermined scope Tr of the cycle of the residue vibration has an acceptable scope that can determine that the residue vibration cycle in the normal ejection is normal. The data is stored in a memory (not illustrated) of the determination section 20, and the subsequent processes are performed.

The measurement result measured by the measurement section 17 in Step S105 of FIG. 24 is input to the determination section 20 (Step S301). Here, according to the embodiment, the measurement result is the cycle Tw of the residue vibration of the vibration plate 121.

In Step S202, the determination section 20 determines whether the cycle Tw of the residue vibration exists or not, that is, whether the residue vibration waveform data is not obtained by the ejection abnormality detecting section 10. If it is determined that the cycle Tw of the residue vibration does not exist, the determination section 20 determines that the nozzle 110 of the ink jet head 100 is a non-ejection nozzle that does not eject an ink drop, in the ejection abnormality detecting process (Step S306). In addition, if it is determined that the residue vibration waveform data exists, the determination section 20 subsequently determines whether the cycle Tw is within the predetermined scope Tr which is considered to be the cycle in the normal ejection in Step S303.

If it is determined that the cycle Tw of the residue vibration is within the predetermined scope Tr, it means that an ink drop is normally ejected from the corresponding ink jet head 100, and the determination section 20 determines that the nozzle 110 of the ink jet head 100 normally ejects an ink drop (normal ejection) (Step S307). In addition, when it is determined that the cycle Tw of the residue vibration is not within the predetermined scope Tr, the determination section 20 subsequently determines whether the cycle Tw of the residue vibration is shorter than the predetermined scope Tr in Step S304.

If it is determined that the cycle Tw of the residue vibration is shorter than the predetermined scope Tr, it means that the frequency of the residue vibration is high, so it is considered that bubbles are mixed into the cavity 141 of the ink jet head 100 as described above. Therefore, the determination section 20 determines that the bubbles are mixed into the cavity 141 of the ink jet head 100 (bubble mixture) (Step S308).

In addition, if it is determined that the cycle Tw of the residue vibration is longer than the predetermined scope Tr, the determination section 20 subsequently determines that the cycle Tw of the residue vibration is longer than the predetermined threshold value T1 (Step S305). When it is determined that the cycle Tw of the residue vibration is longer than the predetermined threshold value T1, it is considered that the residue vibration is excessively damped. Therefore, the determination section 20 determines that the ink near the nozzle 110 of the ink jet head 100 is dried and thickened (dry) (Step S309).

Also, if it is determined that the cycle Tw of the residue vibration is shorter than the predetermined threshold value T1 in Step S305, the cycle Tw of the residue vibration is a value of the scope that satisfies Tr<Tw<T1, and it is considered that it is the state in which paper dust is attached near the outlet of the nozzle 110, and the frequency is higher than when the ink is dried as described above. Therefore, the determination section 20 determines that the paper dust is attached near the outlet of the nozzle 110 of the ink jet head 100 (paper dust attachment) (Step S310).

In this manner, if the normal ejection of the ink jet head 100 which is the target or the cause of the ejection abnormality is determined by the determination section 20 (Steps S306 to S310), the determination result is output to the control portion 6, and the ejection abnormality determining process is ended.

Next, it is assumed that the ink jet printer 1 includes the plurality of ink jet heads (liquid ejecting heads) 100, that is, the plurality of nozzles 110, and an ejection selecting section (nozzle selector) 182 and timing for detecting and determining the ejection abnormality of the respective ink jet heads 100 in the ink jet printer 1.

Further, hereinafter, for convenience of explanation, one head unit 35 among the plurality of head units 35 included in the typing section 3 is described, and it is described that the head unit 35 includes five ink jet heads 100*a* to 100*e* (that is, includes five nozzles 110). However, the number of head units 35 included in the typing section 3 and the number of ink jet heads 100 (the nozzles 110) included in each of the head units 35 may be any numbers.

FIGS. 27 to 30 are block diagrams illustrating an example of ejection abnormality detecting and determining timings in the ink jet printer 1 including the ejection selecting section 182. Hereinafter, configuration examples of respective drawings are described sequentially.

Figure 27:
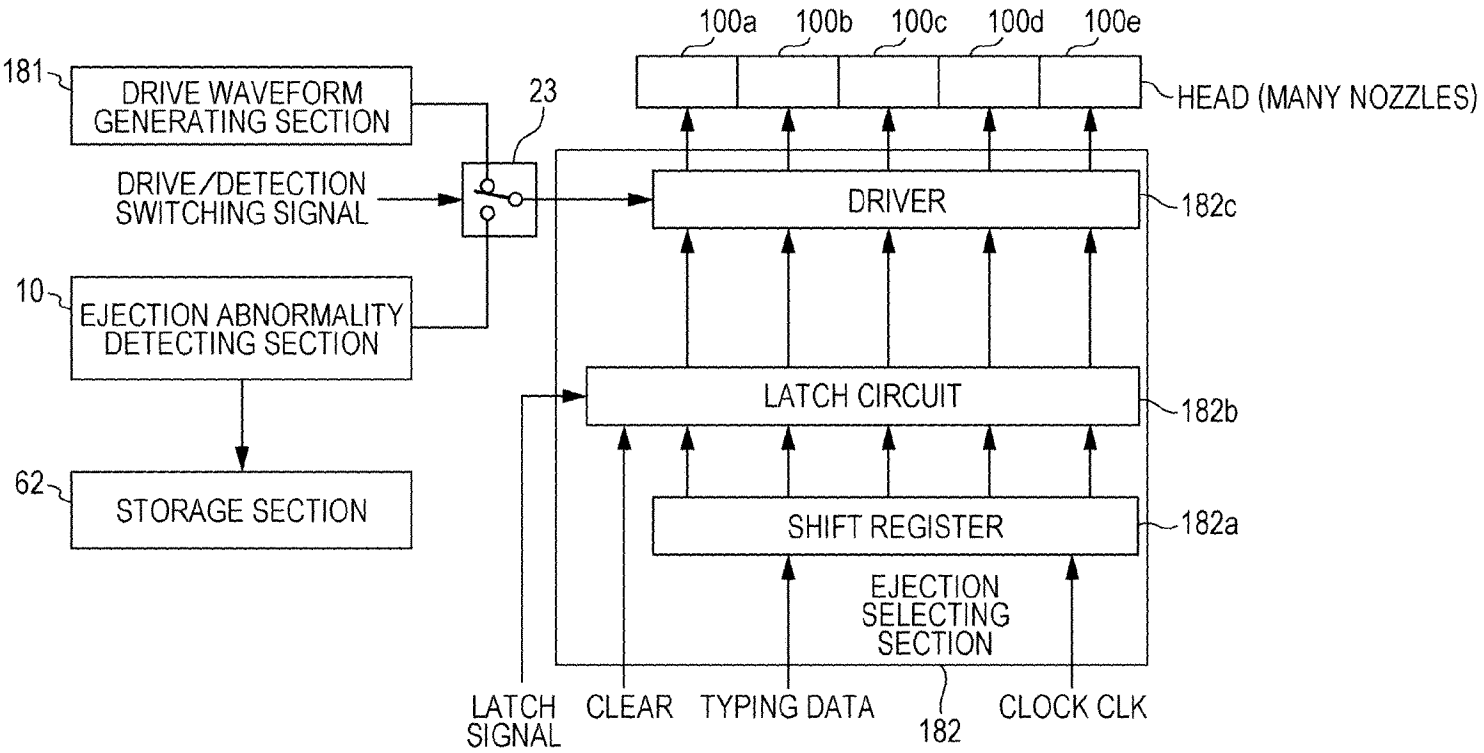
FIG. 27 is a diagram illustrating an example of timings of the ejection abnormality detection of the plurality of ink jet heads (when there is one ejection abnormality detecting section).

FIG. 27 is an example of the timing of ejection abnormality detection of the plurality (5) of ink jet heads 100*a* to 100*e* (when there is one ejection abnormality detecting section 10). As illustrated in FIG. 27, the ink jet printer 1 having the plurality of ink jet heads 100*a* to 100*e* includes a drive waveform generating section 181 that generates a drive waveform, the ejection selecting section 182 that selects which of the nozzles 110 is to eject an ink drop, and the plurality of ink jet heads 100*a* to 100*e* that are selected by the ejection selecting section 182 and driven by the drive waveform generating section 181. Further, in the configuration of FIG. 27, the other configurations are the same as illustrated in FIGS. 2, 16, and 23, so the descriptions thereof are omitted.

Further, according to the embodiment, the drive waveform generating section 181 and the ejection selecting section 182 are described to be included in the driving circuit 18 of the head driver 33 (are illustrated as two blocks interposing the switching section 23 therebetween in FIG. 27, but, generally configured that both are in the head driver 33), but the configuration is not limited thereto, for example, the drive waveform generating section 181 may be configured to be separated from the head driver 33.

As illustrated in FIG. 27, the ejection selecting section 182 includes a shift register 182*a*, a latched circuit 182*b*, and a driver 182*c*. The typing data (ejection data) and the clock signal (CLK) which are output from the host computer 8 illustrated in FIG. 2, and are subjected to a predetermined process in the control portion 6 are sequentially input to the shift register 182*a*. The typing data is shifted and input from an initial step to the last stage side of the shift register 182*a* (every time when the clock signal is input) according to the input pulse of the clock signal (CLK), and output to the latched circuit 182*b* as the typing data corresponding to the respective ink jet heads 100*a* to 100*e*. Further, in the ejection abnormality detecting process described below, the ejection data in the flushing (preliminary ejection), not the typing data is input, but the ejection data means all kinds of typing data with respect to the ink jet heads 100*a* to 100*e*. Further, in the flushing, it may be processes by hardware so that all the outputs of the latched circuit 182*b* are set to be values for ejection.

After the typing data corresponding to the number of nozzles 110 of the head units 35, that is, the number of ink jet heads 100 is stored in the shift register 182*a*, the latched circuit 182*b* latches the respective output signals of the shift register 182*a* by the input latch signals. Here, when the clear signal is input, the latched state is released, the latched output signal of the shift register 182*a* (output stop of the latch) becomes 0, and the typing operation stops. When the clear signal is not input, the latched typing data of the shift register 182*a* is output to the driver 182*c*. After the typing data output from the shift register 182*a* is latched by the latched circuit 182*b*, the next typing data is input to the shift register 182*a*, and the latch signals of the latched circuit 182*b* are sequentially updated by matching with the typing timings.

The driver 182*c* connects the drive waveform generating section 181 and the respective electrostatic actuators 120 of the ink jet heads 100, and inputs the output signals (driving signals) of the drive waveform generating section 181 to the respective electrostatic actuators 120 (the electrostatic actuators 120 of any or all of the ink jet heads 100*a* to 100*e*) designated (specified) by the latch signals output from the latched circuit 182*b*, and the driving signals (voltage signals) are applied between both electrodes of the electrostatic actuators 120.

The ink jet printer 1 illustrated in FIG. 27 includes one drive waveform generating section 181 that drives the plurality of ink jet heads 100*a* to 100*e*, the ejection abnormality detecting section 10 that detects the ejection abnormality (non-ejection of ink drop) to any of the ink jet heads 100 of the respective ink jet heads 100*a* to 100*e*, the storage section 62 that saves (stores) the determination result such as the cause of the ejection abnormality obtained by the ejection abnormality detecting section 10, and one switching section 23 that switches the drive waveform generating section 181 and the ejection abnormality detecting section 10. Accordingly, the ink jet printer 1 drives one or the plurality of the ink jet heads 100*a* to 100*e* selected by the driver 182*c* based on the driving signals input from the drive waveform generating section 181, detects the ejection abnormality (non-ejection of ink drop) of the nozzles 110 of the ink jet heads 100 by the ejection abnormality detecting section 10 based on the residue vibration waveform of the vibration plates 121 after the switching section 23 switches the connection with the electrostatic actuators 120 of the ink jet heads 100 from the drive waveform generating section 181 to the ejection abnormality detecting section 10 by the input of the drive/detection switching signals to the switching sections 23 after the ejection driving operation, and determines the cause thereof when the ejection abnormality occurs.

Also, if the ink jet printer 1 detects or determines the ejection abnormality with respect to one nozzle 110 of the ink jet head 100, detects and determines the ejection abnormality with respect to the next nozzle 110 of the ink jet head 100 designated based on the next driving signal input from the drive waveform generating section 181, and thereafter sequentially detects and determines ejection abnormality with respect to the nozzles 110 of the ink jet heads 100 driven by the output signals of the drive waveform generating section 181 in the same manner. Also, as described above, if the residue vibration detecting section 16 detects the residue vibration waveform of the vibration plate 121, the measurement section 17 measures the cycle of the residue vibration waveform based on the waveform data, and the determination section 20 determines whether the ejection is normal or abnormal based on the measurement result of the measurement section 17, determines the cause of the ejection abnormality if the ejection abnormality occurs (abnormal head), and outputs the determination result to the storage section 62.

In this manner, since the ink jet printer 1 illustrated in FIG. 27 is configured to sequentially detect and determine the ejection abnormality of the respective nozzles 110 of the plurality of ink jet heads 100*a* to 100*e* in the ink drop ejection driving operation, the ink jet printer 1 may include one ejection abnormality detecting section 10 and one switching section 23, it is possible to scale down the circuit configuration of the ink jet printer 1 that can detect and determine the ejection abnormality, and also it is possible to prevent the increase of the manufacturing cost.

Figure 28:
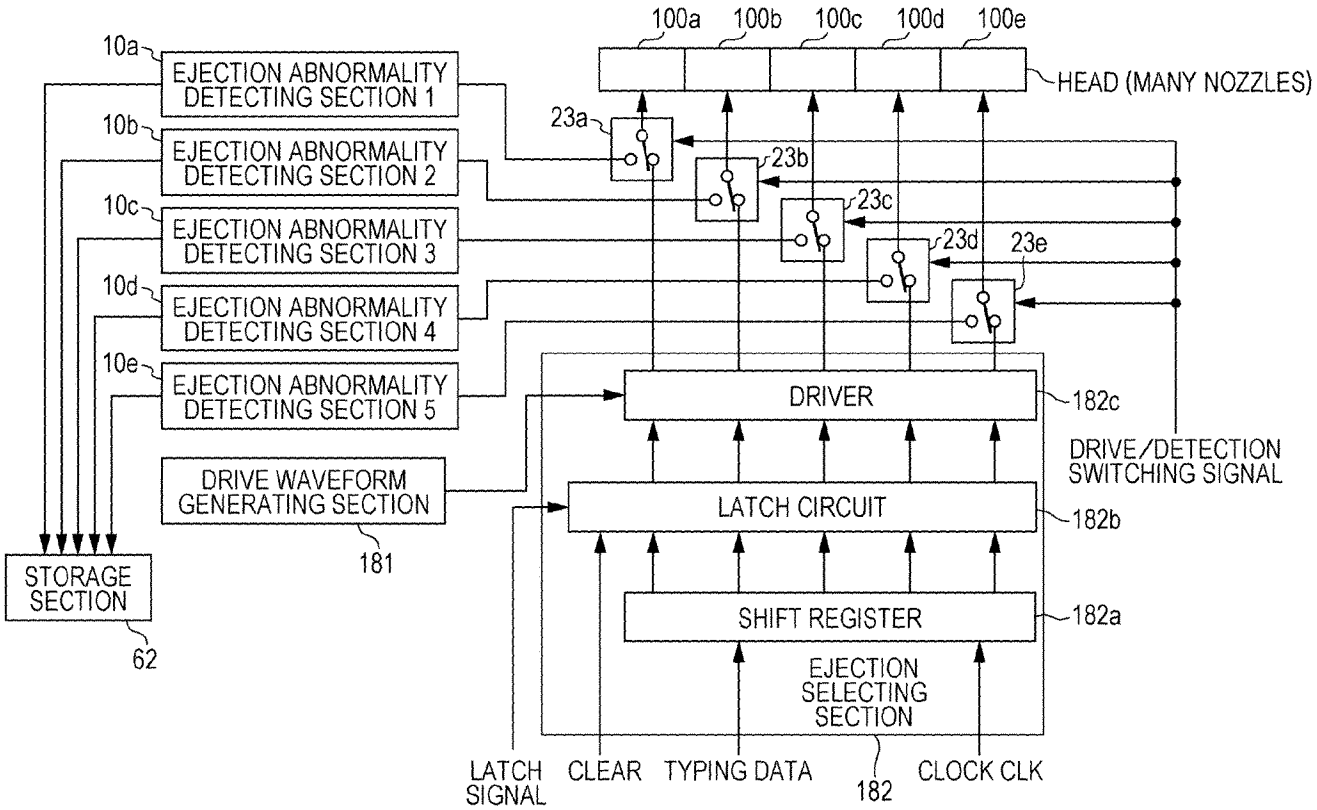
FIG. 28 is a diagram illustrating an example of timings of the ejection abnormality detection of the plurality of ink jet heads (when the number of ejection abnormality detecting sections is the same as the number of ink jet heads).

FIG. 28 is an example of the timing of ejection abnormality detection of the plurality of ink jet heads 100 (when the number of ejection abnormality detecting sections 10 is the same as the number of ink jet heads 100). The ink jet printer 1 illustrated in FIG. 28 includes one ejection selecting section 182, five ejection abnormality detecting sections 10*a* to 10*e*, five switching sections 23*a* to 23*e*, one drive waveform generating section 181 commonly used in the five ink jet heads 100*a* to 100*e*, and one storage section 62. Further, since the respective elements are already described in the description of FIG. 27, the description thereof is omitted, and the connections thereof are described.

As illustrated in FIG. 27, the ejection selecting section 182 latches the typing data corresponding to the respective ink jet heads 100*a* to 100*e* to the latched circuit 182*b* based on the typing data (ejection data) and the clock signal CLK input from the host computer 8, drives the electrostatic actuators 120 of the ink jet heads 100*a* to 100*e* corresponding to the typing data according to the driving signal (voltage signal) input from the drive waveform generating section 181 to the driver 182*c*. The drive/detection switching signals are input to the switching sections 23*a* to 23*e* corresponding to all the ink jet heads 100*a* to 100*e*, and the switching sections 23*a* to 23*e* inputs the driving signals to the electrostatic actuators 120 of the ink jet heads 100 based on the drive/detection switching signals regardless of whether the corresponding typing data (ejection data) exists or not, and then switches the connection with the ink jet heads 100 from the drive waveform generating section 181 to the ejection abnormality detecting sections 10*a* to 10*e*.

After the ejection abnormality of the respective ink jet heads 100*a* to 100*e* is detected and determined by all the ejection abnormality detecting sections 10*a* to 10*e*, the determination results of all the ink jet heads 100*a* to 100*e* obtained by the detection process is output to the storage section 62, and the storage section 62 stores whether the respective ink jet heads 100*a* to 100*e* have ejection abnormality and the cause of the ejection abnormality in the predetermined storage area.

In this manner, the ink jet printer 1 illustrated in FIG. 28 is provided with the plurality of ejection abnormality detecting sections 10*a* to 10*e* corresponding to the respective nozzles 110 of the plurality of ink jet heads 100*a* to 100*e*, performs a switching operation by the plurality of switching sections 23*a* to 23*e* corresponding thereto, and determines the ejection abnormality detection and the cause thereof. Therefore, it is possible to detect the ejection abnormality and determine the cause thereof with respect to all the nozzles 110 at once in a short time.

Figure 29:
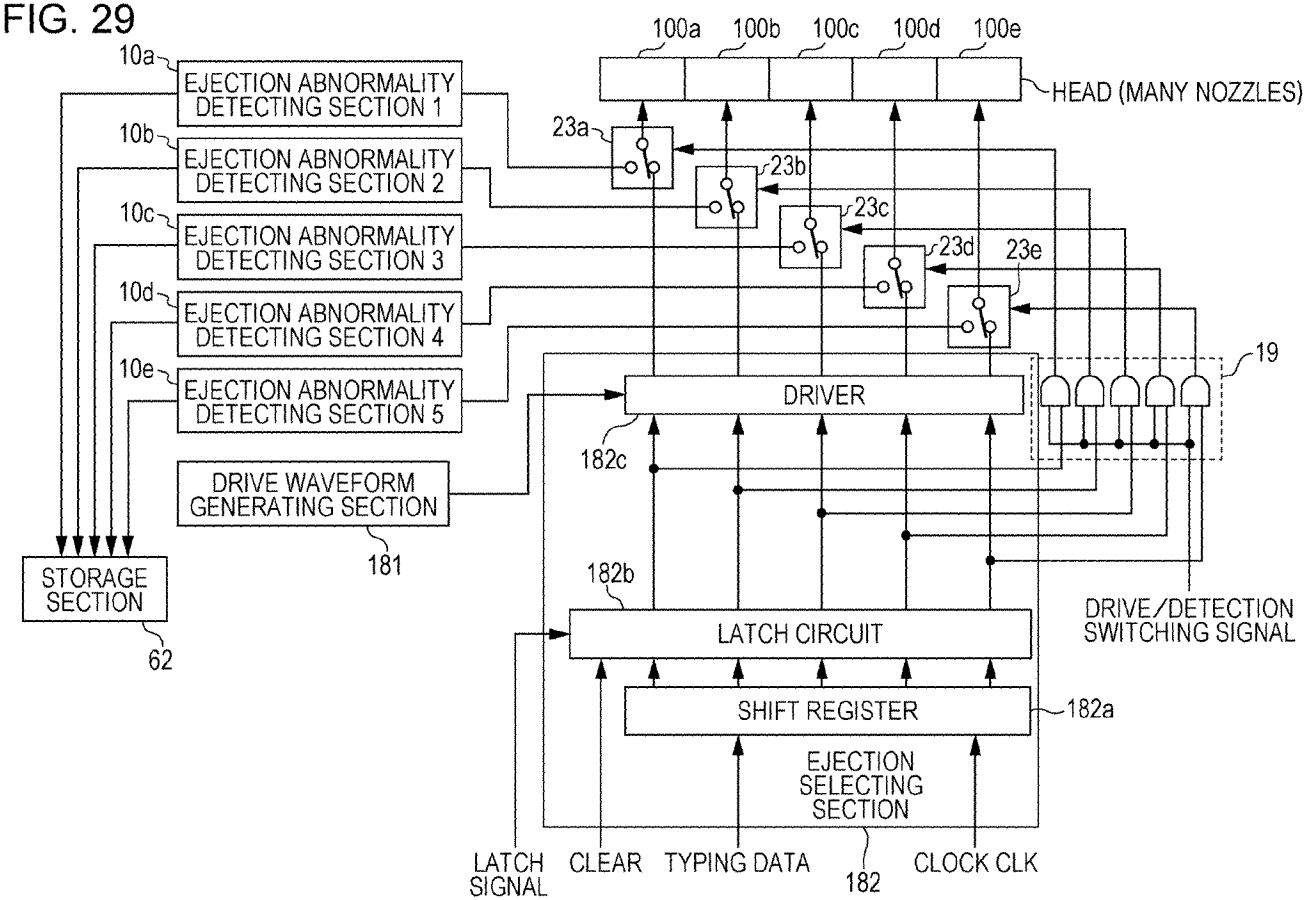
FIG. 29 is a diagram illustrating an example of timings of the ejection abnormality detection of the plurality of ink jet heads (when the number of ejection abnormality detecting sections is the same as the number of ink jet heads, and ejection abnormality detection is performed when typing data exist).

FIG. 29 is an example of the timing of ejection abnormality detection of the plurality of ink jet heads 100 (when number of ejection abnormality detecting sections 10 is the same as number the ink jet heads 100, and ejection abnormality detection is performed when typing data exist). The ink jet printer 1 illustrated in FIG. 29 is obtained by adding (supplementing) a switch control section 19 to the configuration of the ink jet printer 1 illustrated in FIG. 28. According to the embodiment, the switch control section 19 is configured with a plurality of AND circuits ANDa to ANDe, and outputs output signals in the high level to the corresponding switching sections 23*a* to 23*e*, if the typing data and the drive/detection switching signals to be input to the respective ink jet heads 100*a* to 100*e* are input. Further, the switch control section 19 is not limited to the AND circuit, and may be configured so that the switching sections 23 consistent to the outputs of the latched circuit 182*b* selected by the driving ink jet heads 100 are selected.

The respective switching sections 23*a* to 23*e* switches the connection with the corresponding electrostatic actuators 120 of the ink jet heads 100*a* to 100*e* from the drive waveform generating section 181 respectively to the corresponding ejection abnormality detecting sections 10*a* to 10*e* respectively based on the corresponding output signals of the AND circuits ANDa to ANDe of the switch control section 19. Specifically, when the output signal of the corresponding AND circuits ANDa to ANDe is the high level, that is, when the typing data input to the corresponding ink jet heads 100*a* to 100*e* in a state in which the drive/detection switching signals are in the high level is output from the latched circuit 182*b* to the driver 182*c*, the switching sections 23*a* to 23*e* corresponding to the AND circuit switches the connection with the corresponding ink jet heads 100*a* to 100*e* from the drive waveform generating section 181 to the ejection abnormality detecting sections 10*a* to 10*e*.

The ejection abnormality detecting sections 10*a* to 10*e* corresponding to the ink jet heads 100 to which the typing data is input detects the existence or the non-existence of ejection abnormality of the respective ink jet heads 100, and the cause thereof if the ejection abnormality occurs, and then the ejection abnormality detecting sections 10 outputs the determination result obtained in the detection process to the storage section 62. The storage section 62 stores one or the plurality of determination results input (obtained) in this manner to a predetermined storage area.

In this manner, the ink jet printer 1 illustrated in FIG. 29 is provided with the plurality of ejection abnormality detecting sections 10*a* to 10*e* corresponding to the respective nozzles 110 of the plurality of ink jet heads 100*a* to 100*e*. When the typing data respectively corresponding to the ink jet heads 100*a* to 100*e* is input from the host computer 8 to the ejection selecting section 182 through the control portion 6, only the switching sections 23*a* to 23*e* designated by the switch control section 19 perform the predetermined switching operation to detect the ejection abnormality of the ink jet heads 100 and determine the cause thereof. Therefore, the detecting and determining process is not performed with respect to the ink jet heads 100 that does not perform the ejection driving operation. Accordingly, it is possible to avoid the unnecessary detecting and determining process by the ink jet printer 1.

Figure 30:
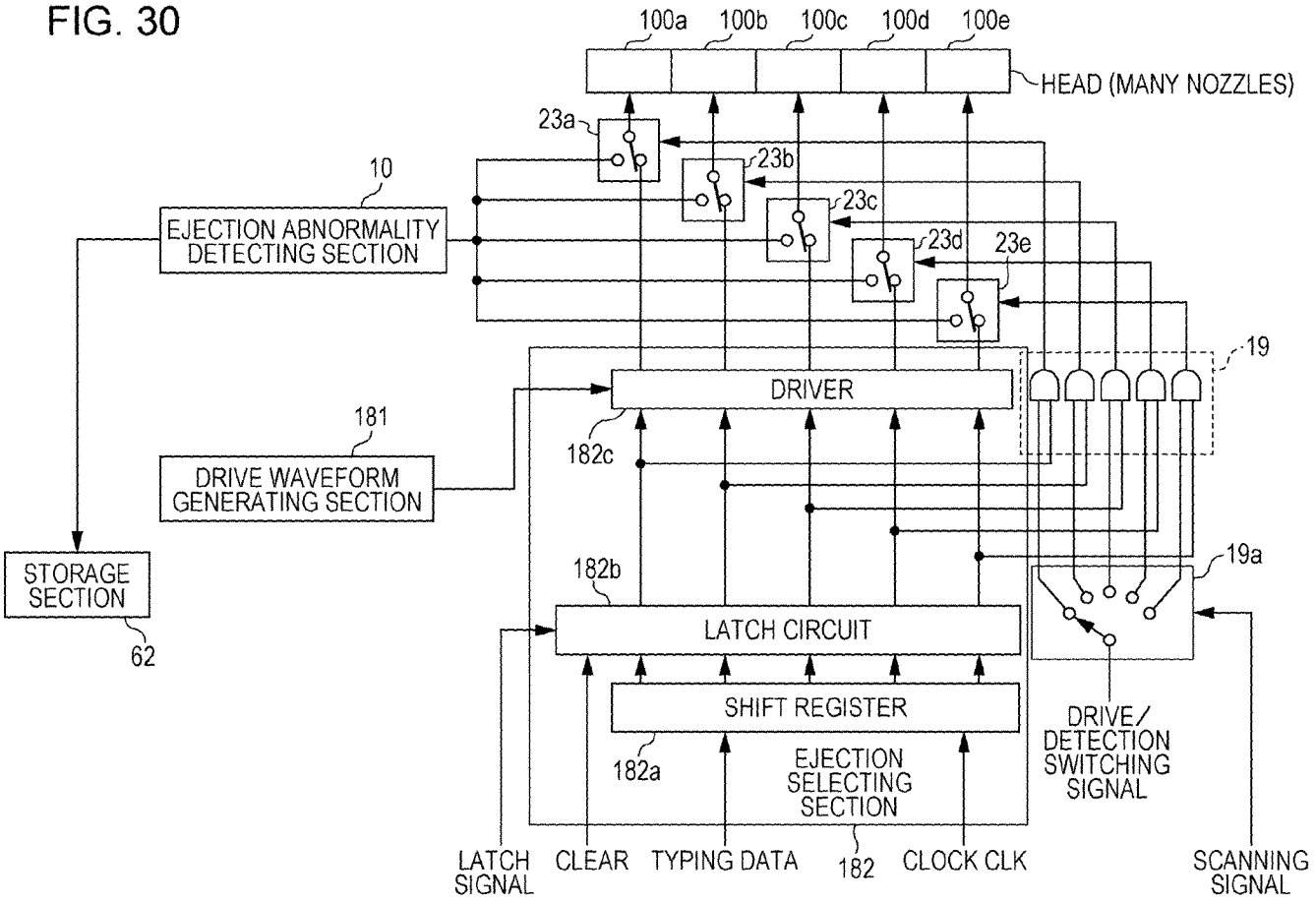
FIG. 30 is a diagram illustrating an example of timings of ejection abnormality detection of the plurality of ink jet heads (when the number of ejection abnormality detecting sections is the same as the number of ink jet heads, and the ejection abnormality is detected by going around the respective ink jet heads).

FIG. 30 is an example of the timing of ejection abnormality detection of the plurality of ink jet heads 100 (when the number of ejection abnormality detecting sections 10 is the same as the number of ink jet heads 100, and the ejection abnormality is detected by going around the respective ink jet heads 100). The ink jet printer 1 illustrated in FIG. 30 is obtained by setting the configuration of the ink jet printer 1 illustrated in FIG. 29 to have one ejection abnormality detecting section 10 and adding a switch selecting section 19*a* that scans the drive/detection switching signal (specifies the ink jet heads 100 that perform the detecting and determining process one by one).

The switch selecting section 19*a* is connected to the switch control section 19 illustrated in FIG. 29, and is a selector that scans (selects and switches) the input of the drive/detection switching signal to the AND circuits ANDa to ANDe corresponding to the plurality of ink jet heads 100*a* to 100*e* based on the scanning signal (selection signal) input from the control portion 6. The scanning (selecting) sequence of the switch selecting section 19*a* may be the sequence of the typing data input to the shift register 182*a*, that is, the sequence in which the plurality of ink jet heads 100 performs ejection, but may be simply the sequence of the plurality of ink jet heads 100*a* to 100*e*.

When the scanning sequence is the sequence of the typing data input to the shift register 182*a*, if the typing data is input to the shift register 182*a* of the ejection selecting section 182, the typing data is latched to the latched circuit 182*b*, and output to the driver 182*c* by the input of the latch signals. The scanning signals that specifies the ink jet heads 100 corresponding to the typing data in synchronization with the inputs of the typing data to the shift register 182*a*, or the inputs of the latch signals to the latched circuit 182*b* are input to the switch selecting section 19*a*, and the drive/detection switching signals are output to the corresponding AND circuits. Further, the output terminal of the switch selecting section 19*a* outputs the signals in the low level in the non-selection.

The corresponding AND circuit (the switch control section 19) outputs the output signals in the high level to the switching sections 23 by performing AND operation on the typing data input from the latched circuit 182*b* and the drive/detection switching signal input from the switch selecting section 19*a*. Also, the switching sections 23 to which the output signals in the high level is input from the switch control section 19 switches the connection with the corresponding electrostatic actuators 120 of the ink jet heads 100 from the drive waveform generating section 181 to the ejection abnormality detecting section 10.

After the ejection abnormality of the ink jet heads 100 to which the typing data is input is detected, and the cause thereof if the ejection abnormality occurs is determined, the ejection abnormality detecting section 10 outputs the determination results to the storage section 62. Also, the storage section 62 stores the determination result input (obtained) in this manner in the predetermined storage area.

In addition, when the scanning sequence is the simple sequence of the ink jet heads 100*a* to 100*e*, if the typing data is input to the shift register 182*a* of the ejection selecting section 182, the typing data is latched to the latched circuit 182*b*, and output to the driver 182*c* by the inputs of the latch signals. The scanning (selecting) signals for specifying the ink jet heads 100 corresponding to the typing data in synchronization with the inputs to the shift register 182*a* of typing data, or the inputs to the latched circuit 182*b* of the latch signals are input to the switch selecting section 19*a*, and the drive/detection switching signals are output to the AND circuits corresponding to the switch control section 19.

Here, when the typing data to the ink jet heads 100 determined by the scanning signals input to the switch selecting section 19*a* is input to the shift register 182*a*, the output signals of the AND circuits (the switch control section 19) corresponding thereto becomes the high level, and the switching sections 23 switches the connection with the corresponding ink jet heads 100 from the drive waveform generating section 181 to the ejection abnormality detecting section 10. However, when the typing data is not input to the shift register 182*a*, the output signals of the AND circuits becomes the Low level, and the corresponding switching sections 23 do not perform the predetermined switching operations. Accordingly, the ejection abnormality detecting process of the ink jet heads 100 is performed based on the AND operation between the selection result of the switch selecting section 19*a* and the result designated by the switch control section 19.

When the switching operation is performed by the switching sections 23, as described above, after the ejection abnormality of the ink jet heads 100 to which the typing data is input, and the causes thereof is determined if the ejection abnormality occurs, the ejection abnormality detecting section 10 outputs the determination result to the storage section 62. Also, the storage section 62 stores the determination result input (obtained) in this manner in the predetermined storage area.

Further, when the typing data to the ink jet heads 100 specified by the switch selecting section 19*a* does not exist, as described above, the corresponding switching sections 23 do not perform the switching operation. Therefore, it is not necessary to perform the ejection abnormality detecting process by the ejection abnormality detecting section 10, but such a process may be performed. When the ejection abnormality detecting process is performed without the switching operation being performed, the determination section 20 of the ejection abnormality detecting section 10 determines that the corresponding nozzles 110 of the ink jet heads 100 are non-ejection nozzles as illustrated in the flowchart of FIG. 26 (Step S306), and stores the determination result in the predetermined storage area of the storage section 62.

As described above, differently from the ink jet printer 1 illustrated in FIG. 28 or 29, the ink jet printer 1 illustrated in FIG. 30 is provided with one ejection abnormality detecting section 10 to the respective nozzles 110 of the plurality of ink jet heads 100*a* to 100*e*, the typing data corresponding to the respective ink jet heads 100*a* to 100*e* is input from the host computer 8 to the ejection selecting section 182 through the control portion 6, only the switching sections 23 corresponding to the ink jet heads 100 that are specified by the scanning (selecting) signals and that perform the ejection driving operation according to the typing data concurrently performs the switching operation, and the ejection abnormality of the corresponding ink jet heads 100 is detected and the cause thereof is determined. Therefore, it is possible to reduce the load on the CPU 61 of the control portion 6 without processing a large amount of detection results at once. In addition, since the ejection abnormality detecting section 10 goes round the nozzle state independently from the ejection operation, it is possible to understand the ejection abnormality for each nozzle even during the driving of the printing, and it is possible to know the state of the nozzles 110 of all the head units 35. Accordingly, for example, since the ejection abnormality is periodically detected, it is possible to reduce the operation of detecting the ejection abnormality for each nozzle during the stoppage of the printing. In the above, the detection of the ejection abnormality of the ink jet heads 100 and the determination of the cause thereof can be effectively performed.

In addition, differently from the ink jet printer 1 illustrated in FIG. 28 or 29, since the ink jet printer 1 illustrated in FIG. 30 may include only one ejection abnormality detecting section 10, compared with the ink jet printer 1 illustrated in FIGS. 28 and 29, it is possible to scale down the circuit configuration of the ink jet printer 1 and also it is possible to prevent the increase of the manufacturing cost.

Next, an operation of the printer 1 illustrated in FIGS. 27 to 30, that is, the ejection abnormality detecting process (mainly, detection timing) in the ink jet printer 1 including the plurality of ink jet heads 100. The ejection abnormality detecting and determining process (process in multiple nozzles) detects the residue vibrations of the vibration plates 121 when the electrostatic actuators 120 of the respective ink jet heads 100 perform the ink drop ejection operation, determines whether ejection abnormality (dot omission, non-ejection of ink drop) occurs in the respective ink jet heads 100 based on the cycles of the residue vibrations, and determines what is the cause when the dot omission (non-ejection of ink drop) occurs. In this manner, if the ejection operation of the ink drops (liquid drops) by the ink jet heads 100 is performed, the detecting and determining process may be performed. However, the ink jet heads 100 ejects the ink drops not only when actually perform printing on the recording sheet P, but also when performing the flushing operation (preliminary ejection or preparatory ejection).

Hereinafter, with respect to the two cases, the ejection abnormality detecting and determining process (multiple nozzles) is described.

Here, the flushing (preliminary ejection) process is a head cleaning operation of ejecting ink drops from all the nozzles 110 or targeted nozzles 110 of the head units 35 when caps (not illustrated in FIG. 1) are mounted or a position which the ink drops (liquid drops) does not reach on the recording sheet P (media). The flushing process (flushing operation) may be performed, for example, when the ink in the cavity 141 is periodically discharged in order to maintain the thickness of the ink in the nozzles 110 to be in an appropriate scope, or performed as a restoration operation when the ink is thickened. Moreover, the flushing process is performed when the respective cavities 141 are initially filled with ink after the ink cartridges 31 are mounted to the typing section 3.

In addition, the wiping process (measure of wiping an attached substance (such as paper dust or waste) attached to head surface of the typing section 3 with wiper which is not illustrated in FIG. 1) is performed in order to clean the nozzle plate (nozzle surface) 150 in some cases, but at this point, it is possible that the pressure in the nozzles 110 becomes the negative pressure, and another color of ink (another kind of liquid drops) is drawn. Therefore, after the wiping process, the flushing process is performed in order to eject a certain amount of ink drops all the nozzles 110 of the head units 35. Moreover, the flushing process may be timely performed in order to hold the meniscus state of the nozzles 110 to be normal and secure favorable typing.

Figure 31:
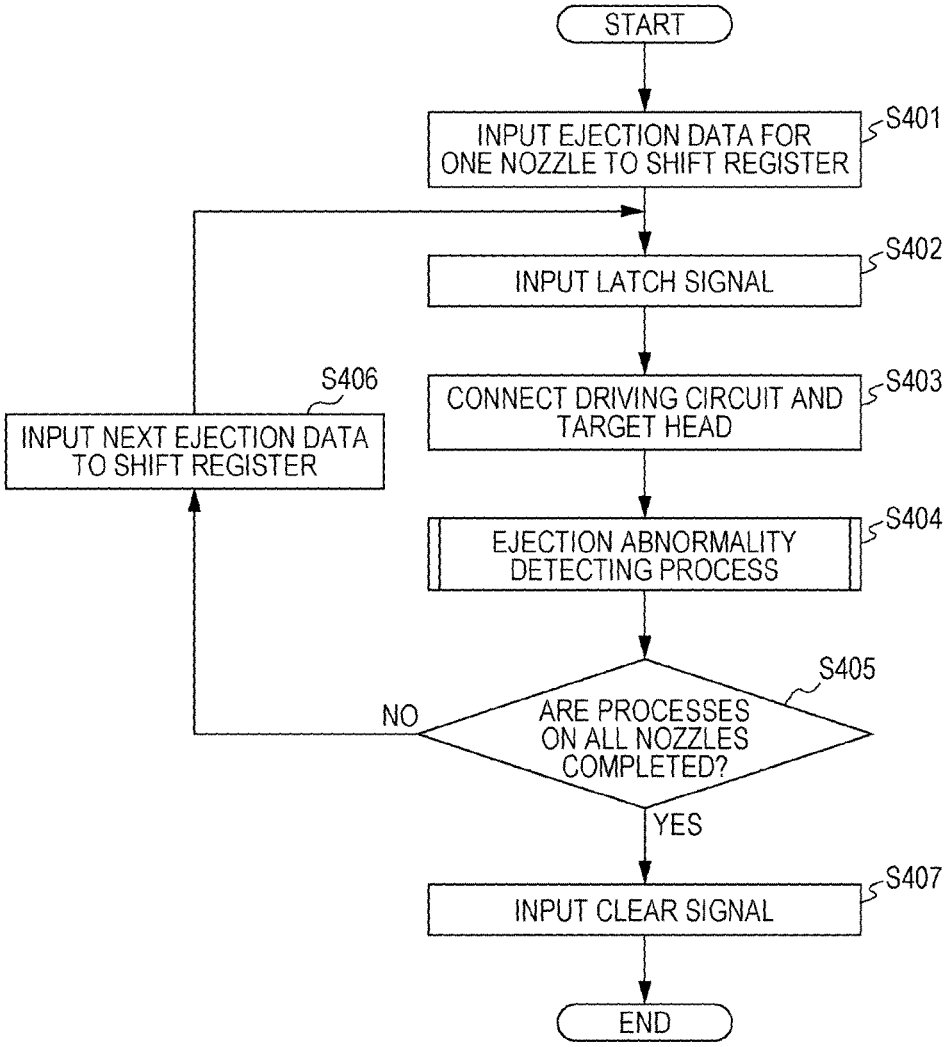
FIG. 31 is a flowchart illustrating timings of the ejection abnormality detection in the flushing operation of the ink jet printer illustrated in FIG. 27.
Figure 33:
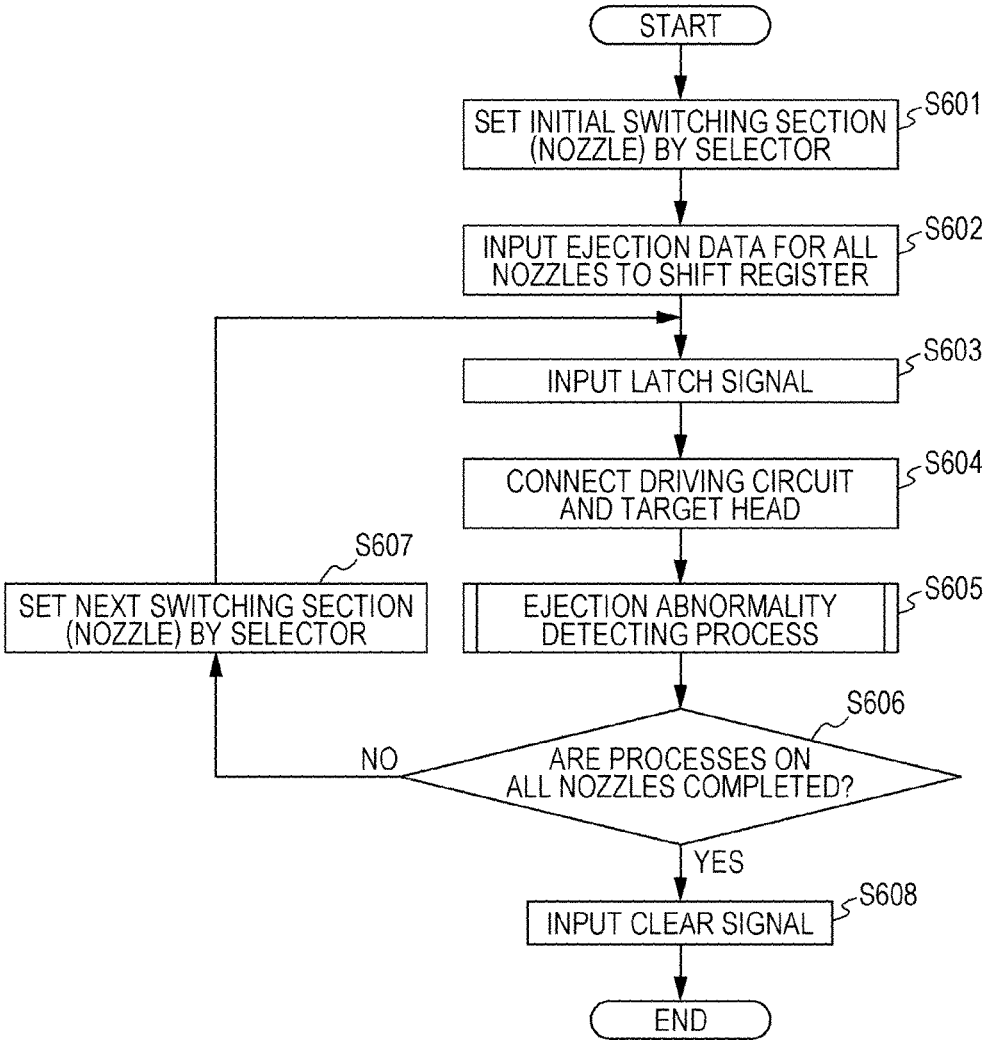
FIG. 33 is a flowchart illustrating timings of the ejection abnormality detection in the flushing operation of the ink jet printer illustrated in FIG. 30.

First, with reference to the flowcharts illustrated in FIGS. 31 and 33, the ejection abnormality detecting and determining process in the flushing process is described. Further, these flowcharts are described with reference to the block diagrams of FIGS. 27 to 30 (hereinafter, also in the description of the typing operation). FIG. 31 is a flowchart illustrating timings of the ejection abnormality detection in the flushing operation of the ink jet printer 1 illustrated in FIG. 27.

When the flushing process of the ink jet printer 1 is performed, the ejection abnormality detecting and determining process illustrated in FIG. 31 is performed at a predetermined timing. The control portion 6 inputs ejection data for one nozzle to the shift register 182*a* of the ejection selecting section 182 (Step S401), the latch signal is input to the latched circuit 182*b* (Step S402), and the ejection data is latched. At this point, the switching section 23 connects the electrostatic actuator 120 of the ink jet head 100 which is the target of the ejection data, and the drive waveform generating section 181 (Step S403).

Also, the ejection abnormality detecting and determining process illustrated in the flowchart of FIG. 24 is performed on the ink jet heads 100 performing the ink ejection operation by the ejection abnormality detecting section 10 (Step S404). In Step S405, the control portion 6 determines whether the ejection abnormality detecting and determining process on all the nozzles 110 of the ink jet heads 100*a* to 100*e* of the ink jet printer 1 illustrated in FIG. 27 is ended based on the ejection data output to the ejection selecting section 182. Also, when it is determined that the process on all the nozzles 110 is not ended, the control portion 6 inputs the ejection data corresponding to the next nozzle 110 of the ink jet heads 100 to the shift register 182*a* (Step S406), and the control portion 6 proceeds to Step S402 and repeats the same processes.

In addition, in Step S405, if it is determined that the ejection abnormality detecting and determining process on all the nozzles 110 is ended, the control portion 6 inputs the clear signal to the latched circuit 182*b*, and releases the latched state of the latched circuit 182*b*, and ends the ejection abnormality detecting and determining process on the ink jet printer 1 illustrated in FIG. 27.

As described above, since a detection circuit is configured with one ejection abnormality detecting section 10 and one switching section 23 in the ejection abnormality detecting and determining process in the printer 1 illustrated in FIG. 27, the ejection abnormality detecting process and determining process repeat as many as the number of ink jet heads 100, but there is an advantage in that the circuit that configures the ejection abnormality detecting section 10 does not get bigger as much.

Figure 32:
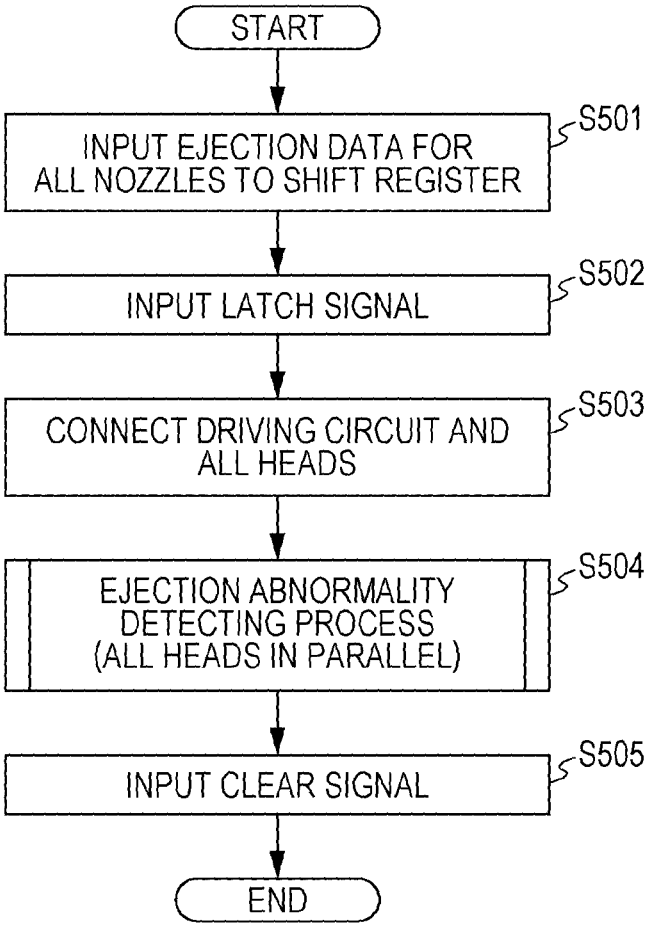
FIG. 32 is a flowchart illustrating timings of the ejection abnormality detection in the flushing operation of the ink jet printer illustrated in FIGS. 28 and 29.

Subsequently, FIG. 32 is a flowchart illustrating timings of the ejection abnormality detection in the flushing operation of the ink jet printer 1 illustrated in FIGS. 28 and 29. The ink jet printer 1 illustrated in FIG. 28 and the ink jet printer 1 illustrated in FIG. 29 are somewhat different from each other in the circuit configuration, but are the same in that the numbers of the ejection abnormality detecting sections 10 and the switching sections 23 are correspond (identical) to the number of ink jet heads 100. Therefore, the ejection abnormality detecting and determining process in the flushing operation is configured with the same steps.

When the flushing process of the ink jet printer 1 is performed at the predetermined timing, the control portion 6 inputs the ejection data for all nozzles to the shift register 182*a* of the ejection selecting section 182 (Step S501), the latch signal is input to the latched circuit 182*b* (Step S502), and the ejection data is latched. At this point, the switching sections 23*a* to 23*e* respectively connects all the ink jet heads 100*a* to 100*e* and the drive waveform generating section 181 (Step S503).

Also, the ejection abnormality detecting and determining processes illustrated in the flowchart of FIG. 24 are performed in parallel on all the ink jet heads 100 that perform the ink ejection operation by the ejection abnormality detecting sections 10*a* to 10*e* corresponding to the respective ink jet heads 100*a* to 100*e* (Step S504). In this case, the determination results corresponding to all the ink jet heads 100*a* to 100*e* are associated with the ink jet heads 100 that become the targets of the process, and saved in the predetermined storage area of the storage section 62 (Step S107 in FIG. 24).

Also, the control portion 6 inputs the clear signal to the latched circuit 182*b* in order to clear the ejection data latched in the latched circuit 182*b* of the ejection selecting section 182 (Step S505), releases the latched state of the latched circuit 182*b*, and ends the ejection abnormality detecting process and the determining process in the ink jet printer 1 illustrated in FIGS. 28 and 29.

As described above, since the detecting and determining circuit is configured with the plurality (five in the embodiment) of ejection abnormality detecting sections 10 corresponding to the ink jet heads 100*a* to 100*e*, and the plurality of switching sections 23 in the processes in the printer 1 illustrated in FIGS. 28 and 29, the ejection abnormality detecting and determining process has an advantage of capable of being performed in a short time with respect to all nozzles 110 at once.

Subsequently, FIG. 33 is a flowchart illustrating timings of the ejection abnormality detection in the flushing operation of the ink jet printer 1 illustrated in FIG. 30. As described below, the ejection abnormality detecting process and the cause determining process in the flushing operation are performed by using the circuit configuration of the ink jet printer 1 illustrated in FIG. 30.

When the flushing process of the ink jet printer 1 is performed at the predetermined timing, the control portion 6 first outputs the scanning signal to the switch selecting section (selector) 19*a*, and sets (specifies) the initial switching section 23*a* and the initial ink jet heads 100*a* by the switch selecting section 19*a* and the switch control section 19 (Step S601). Also, the ejection data for all nozzles is input to the shift register 182*a* of the ejection selecting section 182 (Step S602), the latch signal is input to the latched circuit 182*b* (Step S603), and the ejection data is latched. At this point, the switching section 23*a* connects the electrostatic actuators 120 of the ink jet heads 100*a* and the drive waveform generating section 181 (Step S604).

Also, the ejection abnormality detecting and determining process illustrated in the flowchart of FIG. 24 is performed with respect to the ink jet heads 100*a* that perform the ink ejection operation (Step S605). In this case, in Step S103 of FIG. 24, the drive/detection switching signal that becomes the output signal of the switch selecting section 19*a* and the ejection data output from the latched circuit 182*b* are input to the AND circuit ANDa, the switching section 23*a* connects the electrostatic actuators 120 of the ink jet heads 100*a* and the ejection abnormality detecting section 10 when the output signal of the AND circuit ANDa becomes the high level. Also, the determination result of the ejection abnormality determining process performed in Step S106 of FIG. 24 is associated with the ink jet head 100 (here, 100*a*) that becomes the process target, and saved in the predetermined storage area of the storage section 62 (Step S107 in FIG. 24).

The control portion 6 determines whether the ejection abnormality detecting and determining process on all the nozzles is ended in Step S606. Also, if it is determined that the ejection abnormality detecting and determining process on all the nozzles 110 is not yet ended, the control portion 6 outputs the scanning signal to the switch selecting section (selector) 19*a*, sets (specifies) the next switching section 23*b* and the next ink jet head 100*b* by the switch selecting section 19*a* and the switch control section 19 (Step S607), proceeds to Step S603, and repeats the same processes. Hereinafter, this loop repeats until the ejection abnormality detecting and determining process on all the ink jet heads 100 is ended.

In addition, if it is determined that the ejection abnormality detecting process and the determining process on all the nozzles 110 are ended in Step S606, the control portion 6 inputs the clear signal to the latched circuit 182*b* in order to clear the ejection data to be latched in the latched circuit 182*b* of the ejection selecting section 182 (Step S609), releases the latched state of the latched circuit 182*b*, and ends the ejection abnormality detecting process and the determining process in the ink jet printer 1 illustrated in FIG. 30.

As described above, in the process in the ink jet printer 1 illustrated in FIG. 30, the detection circuit is configured with the plurality of switching sections 23 and one ejection abnormality detecting section 10, only the switching sections 23 corresponding to the ink jet heads 100 that are specified by the scanning signals of the switch selecting section (selector) 19*a* and that drive ejection according to the ejection data perform the switching operations, and the detecting of the ejection abnormality of the corresponding ink jet heads 100 and the determination of the cause are performed. Therefore, the detection of the ejection abnormality of the ink jet heads 100 and the determination of the cause thereof can be more effectively performed.

Further, in Step S602 of the flowchart of FIG. 33, the ejection data corresponding to all the nozzles 110 is input to the shift register 182*a*, but as illustrated in the flowchart in FIG. 31, the ejection data input to the shift register 182*a* is input to the ink jet heads 100 concurrently with the scanning sequence of the ink jet heads 100 by the switch selecting section 19*a*, and the ejection abnormality detecting and determining process may be performed on one nozzle 110 by one.

Figure 34:
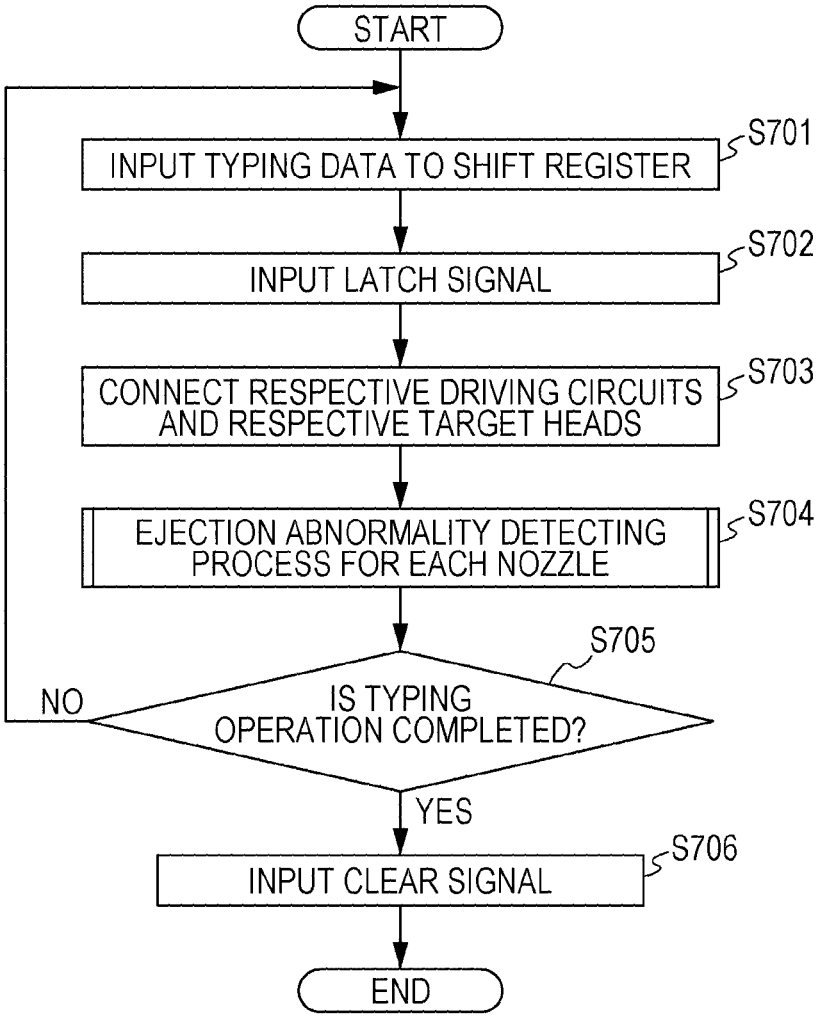
FIG. 34 is a flowchart illustrating timings of the ejection abnormality detection in the typing operation of the ink jet printer illustrated in FIGS. 28 and 29.
Figure 35:
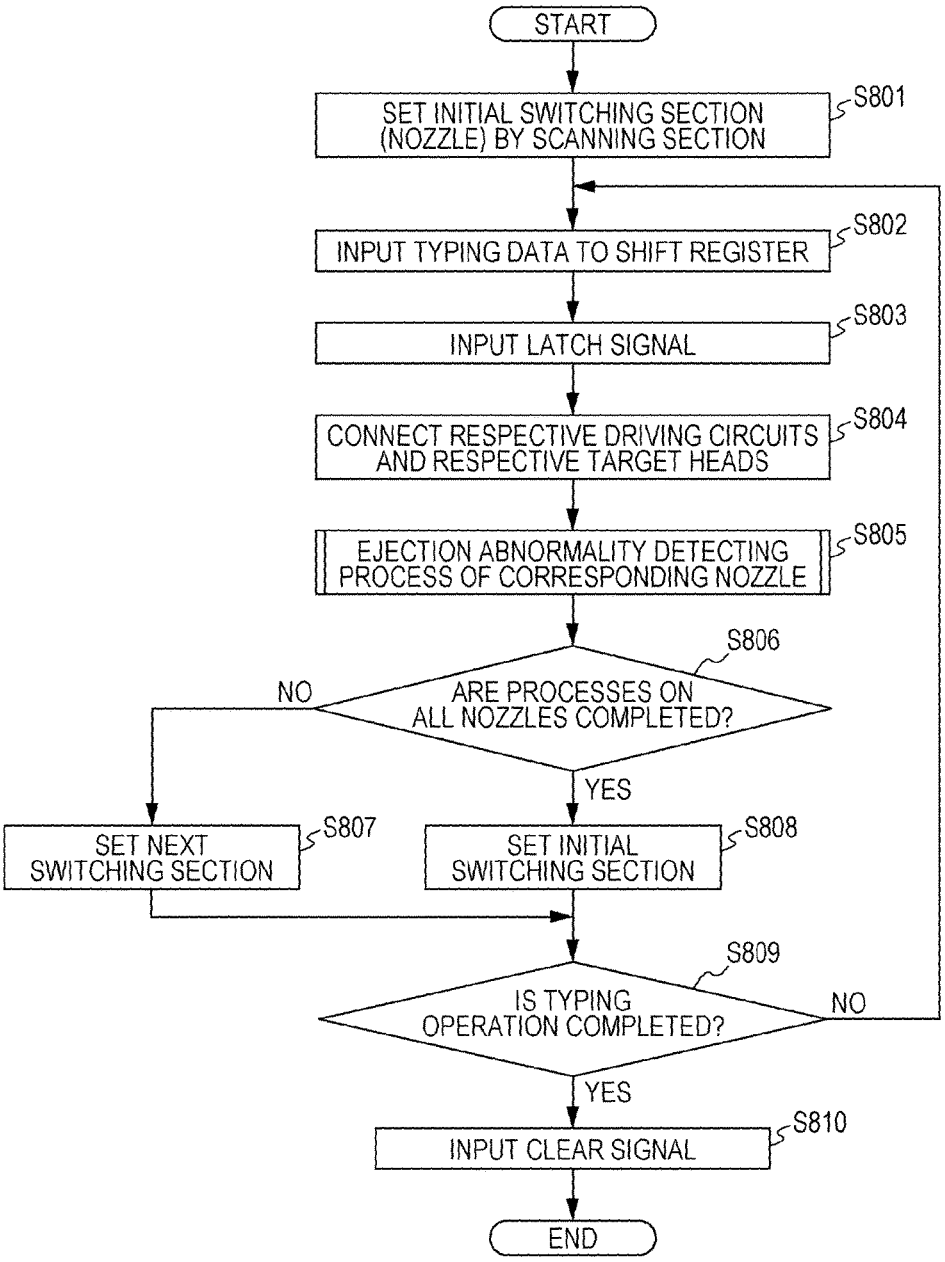
FIG. 35 is a flowchart illustrating timings of the ejection abnormality detection in the typing operation of the ink jet printer illustrated in FIG. 30.

Next, with reference to the flowchart illustrated in FIGS. 34 and 35, the ejection abnormality detecting and determining process of the ink jet printer 1 in the typing operation is described. With respect to the ink jet printer 1 illustrated in FIG. 27, the ejection abnormality detecting and determining process is mainly the same as the ejection abnormality detecting process and the determining process in the flushing operation. Therefore, the flowchart in the typing operation and the operation thereof are omitted, but the ejection abnormality detecting and determining process in the typing operation may be performed also on the ink jet printer 1 illustrated in FIG. 27.

FIG. 34 is a flowchart illustrating timings of the ejection abnormality detection in the typing operation of the ink jet printer 1 illustrated in FIGS. 28 and 29. The process of the flowchart is performed (started) by the printing (typing) instruction from the host computer 8. If the typing data is input from the host computer 8 to the shift register 182*a* of the ejection selecting section 182 through the control portion 6 (Step S701), the latch signal is input to the latched circuit 182*b* (Step S702), and the typing data is latched. At this point, the switching sections 23*a* to 23*e* connects all the ink jet heads 100*a* to 100*e* and the drive waveform generating section 181 (Step S703).

Also, the ejection abnormality detecting section 10 corresponding to the ink jet heads 100 that perform the ink ejection operation performs the ejection abnormality detecting and determining process illustrated in the flowchart of FIG. 24 (Step S704). In this case, the respective determination results corresponding to the respective ink jet heads 100 are associated with the ink jet heads 100 that become the process target, and saved in the predetermined storage area of the storage section 62.

Here, in the case of the ink jet printer 1 illustrated in FIG. 28, the switching sections 23*a* to 23*e* connect the ink jet heads 100*a* to 100*e* to the ejection abnormality detecting sections 10*a* to 10*e* based on the drive/detection switching signal output from the control portion 6 (Step S103 of FIG. 24). Therefore, in the ink jet heads 100 in which the typing data does not exist, since the electrostatic actuators 120 are not driven, the residue vibration detecting section 16 of the ejection abnormality detecting section 10 does not detect the residue vibration waveforms of the vibration plates 121. Meanwhile, in the case of the ink jet printer 1 illustrated in FIG. 29, the switching sections 23*a* to 23*e* connect the ink jet heads 100 in which the typing data exist, to the ejection abnormality detecting section 10 based on the output signal of the AND circuit to which the drive/detection switching signal output from the control portion 6 and the typing data output from the latched circuit 182*b* are input (Step S103 of FIG. 24).

In Step S705, the control portion 6 determines whether the typing operation of the ink jet printer 1 is ended or not. Also, when it is determined that the typing operation is not ended, the control portion 6 proceeds to Step S701, inputs the next typing data to the shift register 182*a*, and repeats the same process. In addition, when it is determined that the typing operation is ended, the control portion 6 inputs the clear signal to the latched circuit 182*b* in order to clear the ejection data latched in the latched circuit 182*b* of the ejection selecting section 182 (Step S707), releases the latched state of the latched circuit 182*b*, and ends the ejection abnormality detecting process and the determining process in the ink jet printer 1 illustrated in FIGS. 28 and 29.

As described above, the ink jet printer 1 illustrated in FIGS. 28 and 29 is configured with the plurality of switching sections 23*a* to 23*e* and the plurality of ejection abnormality detecting sections 10*a* to 10*e*, and the ejection abnormality detecting and determining process on all the ink jet heads 100 is performed at once. Therefore, these processes are performed in a short time. In addition, the ink jet printer 1 illustrated in FIG. 29 further includes the switch control section 19, that is, the AND circuits ANDa to ANDe that performs the AND operation between the drive/detection switching signal and the typing data, and performs the switching operation by the switching sections 23 only on the ink jet heads 100 that performs the typing operation. Therefore, the ink jet printer 1 can perform the ejection abnormality detecting process and the determining process without performing unnecessary detection.

Subsequently, FIG. 35 is a flowchart illustrating timings of the ejection abnormality detection in the typing operation of the ink jet printer 1 illustrated in FIG. 30. A process of the flowchart is performed in the ink jet printer 1 illustrated in FIG. 30 under the printing instruction from the host computer 8. First, the switch selecting section 19*a* sets (specifies) the initial switching section 23*a* and the initial ink jet heads 100*a* (Step S801).

If the typing data is input from the host computer 8 to the shift register 182*a* of the ejection selecting section 182 through the control portion 6 (Step S802), the latch signal is input to the latched circuit 182*b* (Step S803), and the typing data is latched. Here, the switching sections 23*a* to 23*e* connects all the ink jet heads 100*a* to 100*e* and the drive waveform generating section 181 (the driver 182*c* of the ejection selecting section 182) in this step (Step S804).

Also, if the typing data exists in the ink jet heads 100*a*, the electrostatic actuators 120 after the ejection operation by the switch selecting section 19*a* are connected to the ejection abnormality detecting section 10 (Step S103 of FIG. 24), and the control portion 6 performs the ejection abnormality detecting and determining process illustrated in the flowchart of FIG. 24 (FIG. 25) (Step S805). Also, the determination result of the ejection abnormality determining process performed in Step S106 of FIG. 24 is associated with the ink jet head 100 (here, 100*a*) which is the process target, and is saved in the predetermined storage area of the storage section 62 (Step S107 of FIG. 24).

In Step S806, the control portion 6 determines whether the ejection abnormality detecting and determining process on all the nozzles 110 (all the ink jet heads 100) described above is completed. Also, if it is determined that the process on all the nozzles 110 is ended, the control portion 6 sets the switching section 23*a* corresponding to the initial nozzle 110 based on the scanning signal (Step S808), and if the process on all the nozzles 110 is not ended, the switching section 23*b* corresponding to the next nozzle 110 is set (Step S807).

In Step S809, the control portion 6 determines whether the predetermined typing operation instructed from the host computer 8 is ended or not. Also, if it is determined that the typing operation is not ended, the next typing data is input to the shift register 182*a* (Step S802), and the same process is repeated. If it is determined that the typing operation is ended, the control portion 6 inputs the clear signal to the latched circuit 182*b* in order to clear the ejection data latched in the latched circuit 182*b* of the ejection selecting section 182 (Step S811), releases the latched state of the latched circuit 182*b*, and ends the ejection abnormality detecting and determining process in the ink jet printer 1 illustrated in FIG. 30.

As described above, the liquid ejecting apparatus (the ink jet printer 1) according to the embodiment includes the vibration plates 121, the electrostatic actuators 120 that displaces the vibration plates 121, the cavities 141 which are filled with liquid, and of which internal pressure is changed (increased or decreased) by the displacement of the vibration plates 121, the drive waveform generating section 181 that includes the plurality of ink jet heads (liquid ejecting head)

100 with the nozzles 110 communicating with the cavities 141 and ejecting the liquid according to the change (increase and decrease) of the pressure in the cavities 141 and also drives the electrostatic actuators 120 thereof, the ejection selecting section 182 that selects which of the nozzles 110 of the plurality of nozzles 110 eject liquid drops, and one or the plurality of ejection abnormality detecting section 10 that detect the residue vibrations of the vibration plates 121, and detects the ejection abnormality of the liquid drops based on the detected residue vibrations of the vibration plates 121, and one or the plurality of switching sections 23 that switch the electrostatic actuators 120 from the drive waveform generating section 181 to the ejection abnormality detecting section 10 after the ejection operation of the liquid drop by the driving of the electrostatic actuators 120 based on the drive/detection switching signals, the typing data, or the scanning signals, and detects the ejection abnormality of the plurality of nozzles 110 at once (in parallel) or subsequently.

Accordingly, by the ejection abnormality detecting and determining method of the liquid ejecting apparatus and the liquid ejecting head according to the embodiment, it is possible to detect the ejection abnormality and determine the cause thereof in a short time and to scale down the circuit configuration of the detection circuit including the ejection abnormality detecting section 10. Therefore, it is possible to prevent the increase of the manufacturing cost of the liquid ejecting apparatus. In addition, after the electrostatic actuators 120 are driven, the connection is switched to the ejection abnormality detecting section 10 to detect ejection abnormality and determine the cause thereof. Therefore, the driving of the actuators is not influenced, and accordingly the throughput of the liquid ejecting apparatus is not decreased or deteriorated. In addition, it is possible to install the ejection abnormality detecting section 10 in the existing liquid ejecting apparatus (ink jet printer) including predetermined elements.

In addition, differently from the configurations described above, the liquid ejecting apparatus according to the embodiment includes the plurality of switching sections 23, the switch control section 19, and the plurality of ejection abnormality detecting sections 10 corresponding to the number of one or the plurality of nozzles 110, switches the connection with the corresponding electrostatic actuators 120 from the drive waveform generating section 181 or the ejection selecting section 182 to the ejection abnormality detecting section 10 based on the drive/detection switching signal and the ejection data (typing data), or the scanning signal, the drive/detection switching signal, and the ejection data (typing data), and the detection of the ejection abnormality and the determination of the cause are performed.

Accordingly, in the liquid ejecting apparatus according to the embodiment, the switching sections corresponding to the electrostatic actuators 120 to which the ejection data (typing data) is not input, that is, that do not perform the ejection driving operation do not perform the switching operation. Therefore, it is possible to avoid the unnecessary detecting and determining process. In addition, when the switch selecting section 19*a* is used, the liquid ejecting apparatus may include only one ejection abnormality detecting section 10. Therefore, it is possible to scale down the circuit configuration of the liquid ejecting apparatus, and also to prevent the increase of the manufacturing cost of the liquid ejecting apparatus.

Figure 36:
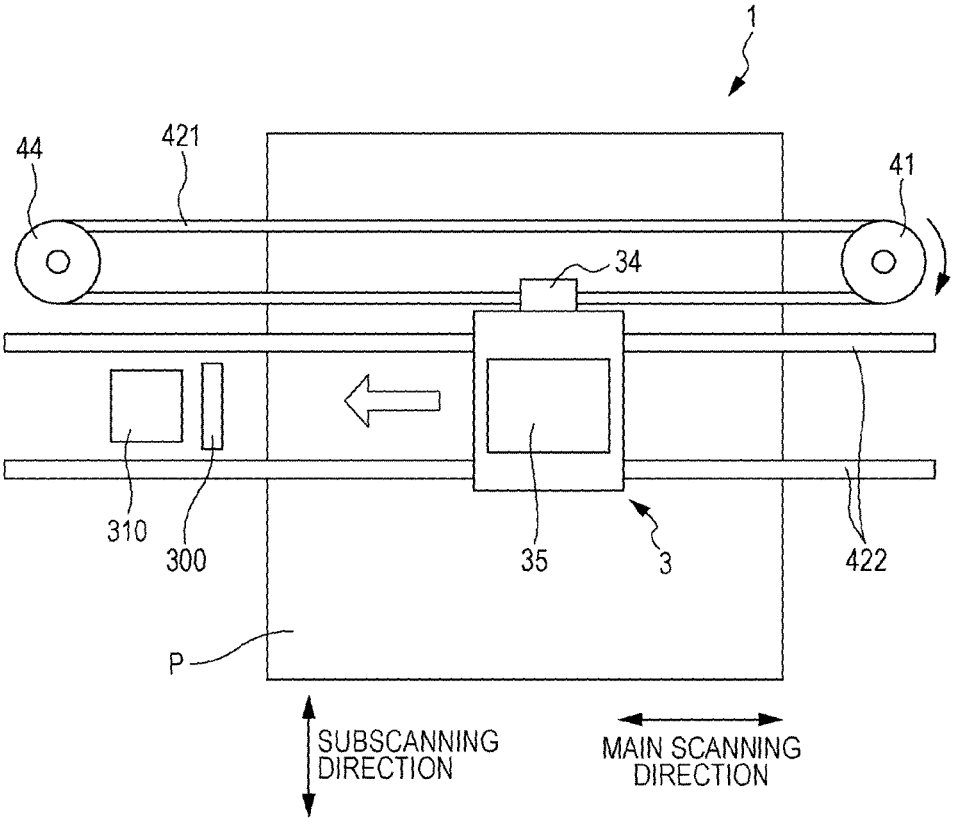
FIG. 36 is a diagram schematically illustrating a structure (partially omitted) viewed from the upper portion of the ink jet printer illustrated in FIG. 1.

Next, a configuration (the restoring section 24) of performing the restoring process of solving the cause of the ejection abnormality (abnormal head) is described with respect to the ink jet heads 100 (the head units 35) in the liquid ejecting apparatus according to the embodiment. FIG. 36 is a diagram schematically illustrating a structure (partially omitted) viewed from the upper portion of the ink jet printer 1 illustrated in FIG. 1. In addition to the configuration illustrated in the perspective view of FIG. 1, the ink jet printer 1 illustrated in FIG. 36 includes a wiper 300 and a cap 310 for performing the restoration process of the non-ejection of ink drop (abnormal head).

As the restoration process to be performed by the restoring section 24, a flushing process that preliminarily ejects the liquid drop from the respective nozzles 110 of the ink jet heads 100, and a wiping process by the wiper 300 (see FIGS. 37A and 37B) described below and a pumping process (pump suction process) by a tube pump 320 described below are included. That is, the restoring section 24 includes the tube pump 320, a pulse motor that drives the tube pump 320, the wiper 300, a vertical driving mechanism of the wiper 300, and a vertical driving mechanism (not illustrated) of the cap 310. The head driver 33 and the head units 35 function as a portion of the restoring section 24 in the flushing process, and the carriage motor 41 or the like functions as a portion of the restoring section 24 in the wiping process. Since the flushing process is described above, the wiping process and the pumping process are described below.

Here, the wiping process means a process of wiping a foreign substance such as paper dust attached to the nozzle plate 150 (nozzle surface) of the head units 35 by the wiper 300. In addition, the pumping process (pump suction process) is a process of driving the tube pump 320 described below, and sucking and discharging the ink in the cavities 141 from the respective nozzles 110 of the head units 35. In this manner, the wiping process is a proper process as the restoration process in the state of the paper dust attachment which is one of the causes of the ejection abnormality of the liquid drop of the ink jet heads 100 described above. In addition, the pump suction process is a proper process as the restoration process for removing the bubbles in the cavities 141 that may not be removed in the flushing process, and removing thickened ink when the ink near the nozzles 110 is dried and thickened or the ink in the cavities 141 is thickened by aging degradation. Further, when the thickening does not progress very much and the viscosity is not great, the restoration process by the flushing process described above. In this case, since the discharged amount of the ink is little, it is possible to perform the proper restoration process without reducing the throughput or the running cost.

The plurality of head units 35 are mounted on the carriage 32, and moved by being connected to the timing belt 421 through a connection portion 34 illustrated in the upper portion of FIG. 36 by the carriage motor 41 guided by two carriage guide shafts 422. The head units 35 mounted on the carriage 32 can be moved in the main scanning direction through the timing belt 421 (interlocked to the timing belt 421) moving by the driving of the carriage motor 41. Further, the carriage motor 41 functions as a pulley for continuously rotating the timing belt 421, and includes a pulley 44 on the other side in the same manner.

In addition, the cap 310 is to cap the nozzle plate 150 of the head units 35 (see FIG. 5). In the cap 310, a hole is formed on the lower side surface thereof, and a flexible tube 321 which is the element of the tube pump 320 is connected to the hole as described below. Further, the tube pump 320 is described with reference to FIGS. 39A and 39B.

In the recording (typing) operation, while the electrostatic actuators 120 of the predetermined ink jet heads 100 (liquid ejecting head) are driven, the recording sheet P moves in the subscanning direction, that is, downwardly in FIG. 36, the typing section 3 moves in the main scanning direction, that is, in the horizontal direction in FIG. 36, and the ink jet printer (liquid ejecting apparatus) 1 prints (records) the predetermined image or the like on the recording sheet P based on the data to be printed (typing data) which is input from the host computer 8.

Figure 37A:
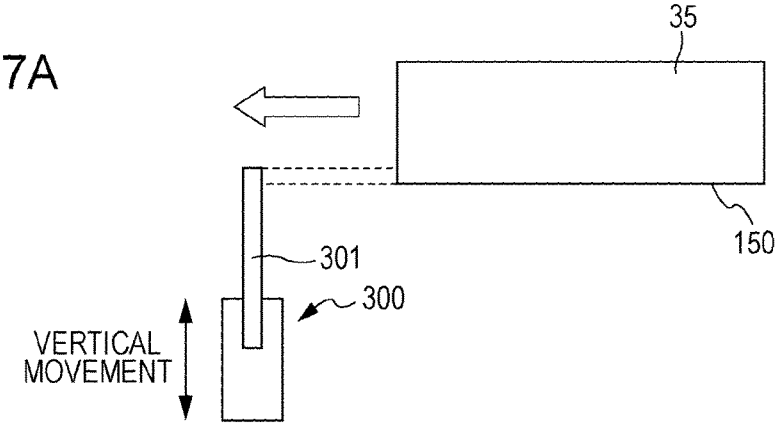
FIGS. 37A and 37B are diagrams illustrating a positional relationship between a wiper and a head unit illustrated in FIG. 36.
Figure 37B:
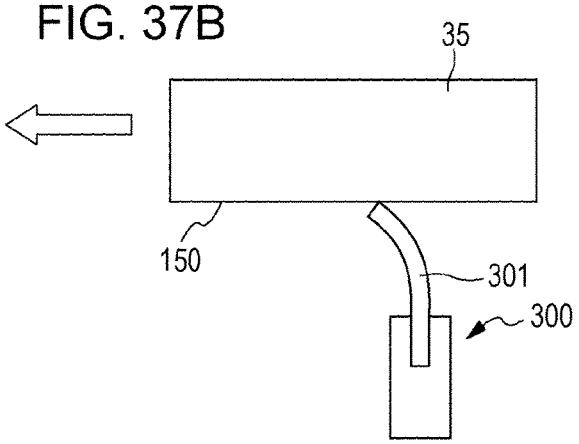

FIGS. 37A and 37B are diagrams illustrating positional relationship between the wiper 300 and the typing section 3 (the head unit 35) illustrated in FIG. 36. In FIGS. 37A and 37B, the head unit 35 and the wiper 300 are illustrated as a portion of side view when the upper side of the ink jet printer 1 illustrated in FIG. 36 is viewed from the lower side in the FIG. 36. As illustrated in FIG. 37A, the wiper 300 is arranged in a vertically moveable manner so as to be capable of coming in contact with the nozzle surface of the typing section 3, that is, the nozzle plate 150 of the head units 35.

Here, the wiping process which is the restoration process using the wiper 300 is described. In the wiping process, as illustrated in FIG. 37A, the wiper 300 is upwardly moved by a driving apparatus (not illustrated) so that the distal end of the wiper 300 is positioned on the upper side than the nozzle surface (the nozzle plate 150). In such case, if the typing section 3 (the head units 35) is moved in the horizontal direction (direction indicated by an arrow) in FIGS. 37A and 37B by driving the carriage motor 41, a wiping member 301 comes into contact with the nozzle plate 150 (nozzle surface).

Further, since the wiping member 301 is configured with a flexible rubber member or the like, as illustrated in FIG. 37B, the distal end portion that comes into contact with the nozzle plate 150 of the wiping member 301 is bent, and the surface of the nozzle plate 150 (nozzle surface) is cleaned (wiped) by the distal end portion thereof. Accordingly, foreign substance (for example, paper dust, waste floating in the air, and scrap of rubber) such as the paper dust attached to the nozzle plate 150 (nozzle surface) can be removed. In addition, according to the attachment state of the foreign substance like this (when many foreign substances are attached), the wiping process can be performed several times by moving the upper side of the wiper 300 back and forth to the typing section 3.

Figure 38:
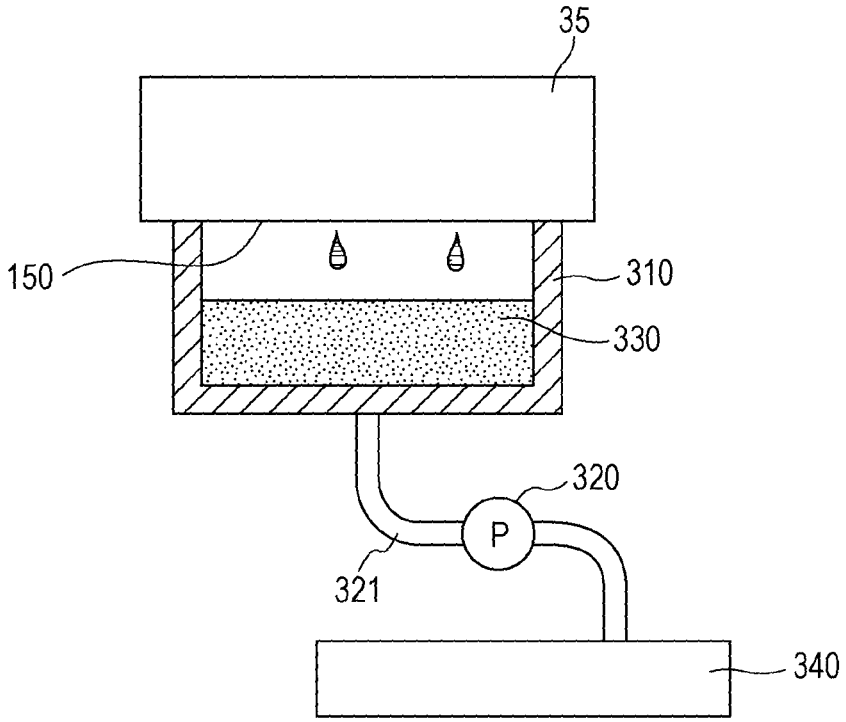
FIG. 38 is a diagram illustrating the relationship among the head unit, a cap, and a pump in a pump suction process.

FIG. 38 is a diagram illustrating the relationship among the head units 35, the cap 310, and the pump 320 in the pump suction process. The tube 321 forms an ink discharging path in the pumping process (pump suction process). As described above, one end thereof is connected to the lower portion of the cap 310, and the other end is connected to a waste ink cartridge 340 through the tube pump 320.

On the inner lower surface of the cap 310, an ink absorber 330 is arranged. In the pump suction process and the flushing process, the ink absorber 330 absorbs and temporarily stores ink ejected from the nozzles 110 of the ink jet heads 100. Further, the ink absorber 330 can prevent the ejected liquid drop to rebound and dirty the nozzle plate 150 in the flushing operation in the cap 310.

Figure 39A:
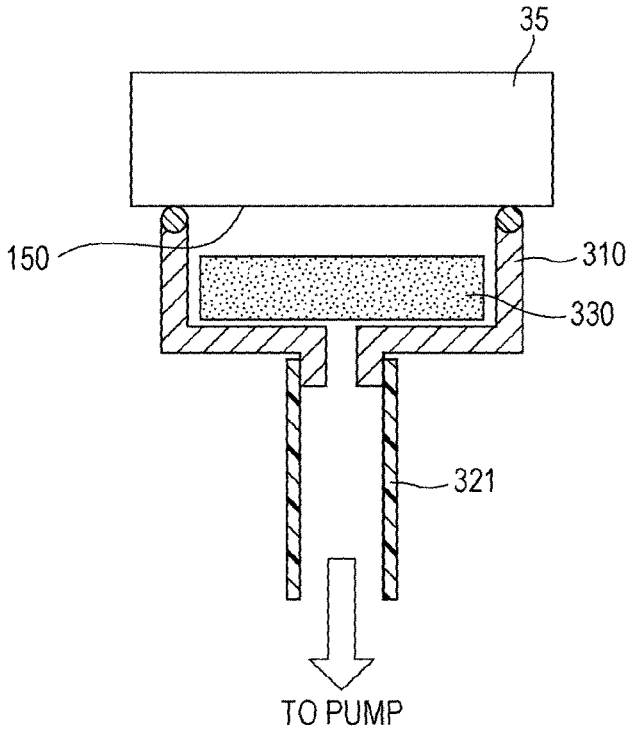
FIGS. 39A and 39B are diagrams schematically illustrating a configuration of a tube pump illustrated in FIG. 38.
Figure 39B:
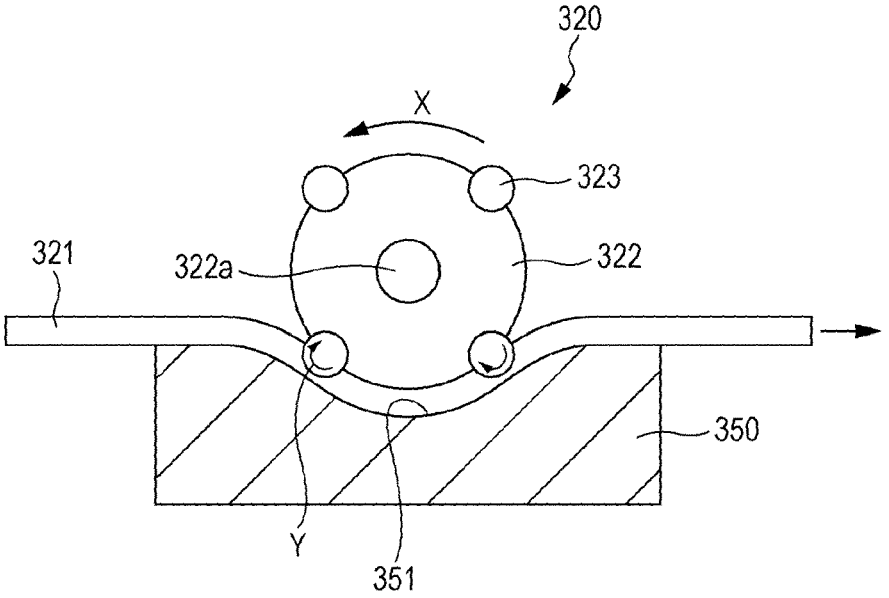

FIGS. 39A and 39B are diagrams schematically illustrating the configuration of the tube pump 320 illustrated in FIG. 38. As illustrated in FIG. 39B, the tube pump 320 is a rotation-type pump, and includes a rotating body 322, four rollers 323 arranged in the circumference portion of the rotating body 322, and a guide member 350. Further, the rollers 323 is supported by the rotating body 322, and pressurizes the flexible tube 321 installed in an art shape along a guide 351 of the guide member 350.

In the tube pump 320, the rotating body 322 with a shaft 322*a* as a center rotates in the X direction indicated by an arrow illustrated in FIGS. 39A and 39B, one or two rollers 323 that are in contact with the tube 321 rotate in Y direction, and thus the tube 321 installed in the arc-shaped guide 351 of the guide member 350 is sequentially pressurized. Accordingly, the tube 321 is deformed, the ink (liquid material) in the respective cavities 141 of the ink jet heads 100 is sucked through the cap 310 by the negative pressure generated in the tube 321, unnecessary ink into which bubbles are mixed, or which is dried and thickened is discharged to the ink absorber 330 through the nozzles 110, and the waste ink absorbed by the ink absorber 330 is discharged to the waste ink cartridge 340 (see FIG. 38) through the tube pump 320.

Further, the tube pump 320 is driven by a motor such as a pulse motor (not illustrated) or the like. The pulse motor is controlled by the control portion 6. The driving information on the rotation control of the tube pump 320, for example, a lookup table in which a rotation speed and the number of rotation are described, or a control program in which sequence control is described, is stored in the PROM 64 of the control portion 6 or the like, and the tube pump 320 is controlled by the CPU 61 of the control portion 6 based on the driving information.

Figure 40:
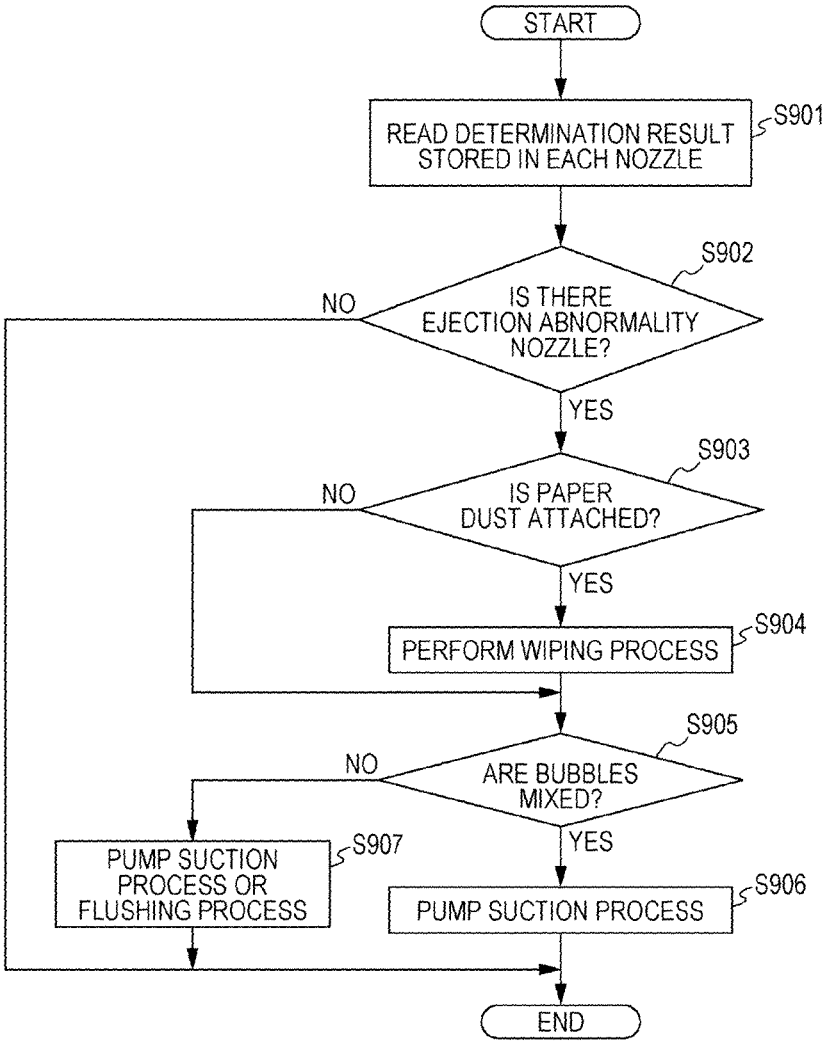
FIG. 40 is a flowchart illustrating the ejection abnormality restoring process in the ink jet printer.

Next, the operation of the restoring section 24 (ejection abnormality restoring process) is described. FIG. 40 is a flowchart illustrating the ejection abnormality restoring process in the ink jet printer 1 (liquid ejecting apparatus). In the ejection abnormality detecting and determining process (see the flowchart of FIG. 24) described above, if the ejection abnormality nozzles 110 are detected, and the cause thereof is determined, the typing section 3 is moved to a predetermined standby area (for example, in FIG. 36, a position in which the nozzle plate 150 of the typing section 3 is covered with the cap 310, or a position in which a wiping process by the wiper 300 can be performed) at the predetermined timing at which the printing operation (typing operation) or the like is not performed, and the ejection abnormality restoring process is performed.

First, the control portion 6 reads the determination results corresponding to the respective nozzles 110 saved in the EEPROM 62 of the control portion 6 in Step S107 of FIG. 24 (Here, the determination results are not determination results limited to the respective nozzles 110, but correspond to the respective ink jet heads 100. Therefore, hereinafter, the ejection abnormality nozzles 110 also mean the ink jet heads 100 in which the ejection abnormality occurs.) (Step S901). In Step S902, the control portion 6 determines whether an ejection abnormality nozzle 110 exists in the read determination results. Also, if it is determined that the ejection abnormality nozzle 110 does not exist, that is, all the nozzles 110 are normally ejects liquid drops, the ejection abnormality restoring process is ended as it is.

Meanwhile, if it is determined that some of the nozzles 110 perform the abnormal ejection, the control portion 6 determines whether the cause of the nozzles 110 determined to perform abnormal ejection is paper dust attachment in Step S903. Also, if it is determined that the paper dust is not attached near the outlets of the nozzles 110, the step proceeds to Step S905, and if it is determined that the paper dust is attached, the aforementioned wiping process on the nozzle plate 150 by the wiper 300 is performed (Step S904).

In Step S905, subsequently, the control portion 6 determines whether the cause of the nozzles 110 determined to perform the abnormal ejection is bubble mixture. Also, if it is determined that the cause is the bubble mixture, the control portion 6 performs the pump suction process on all the nozzles 110 by the tube pump 320 (Step S906), and the ejection abnormality restoring process is ended. Meanwhile, if it is determined that the cause is not the bubble mixture, the control portion 6 performs the pump suction process by the tube pump 320 based on the length of the cycle of the residue vibration of the vibration plates 121 which is measured by the measurement section 17, or the flushing process on only the nozzles 110 determined to perform abnormal ejection or on all the nozzles 110 (Step S907), and ends the ejection abnormality restoring process.

Further, the pump suction restoring process which is one of the restoration processes performed by the restoring section 24 is the process which is effective when thickening is progressed by drying, or if the bubble mixture occurs, and since the same restoration process is performed in both cases, when the ink jet heads 100 of the bubble mixture or the dried and thickened, which require the pump suction process are detected in the head unit, the processes are not independently determined as in Steps S905 to S907 of the flowchart of FIG. 40, and the pump suction process on the ink jet heads 100 of the bubble mixture and the ink jet heads 100 of which the ink is dried and thickened is performed at once. That is, after it is determined whether the paper dust is attached near the nozzles 110, the pump suction process may be performed without determining whether the cause is the bubble mixture or the dried and thickened.

Figure 41A:
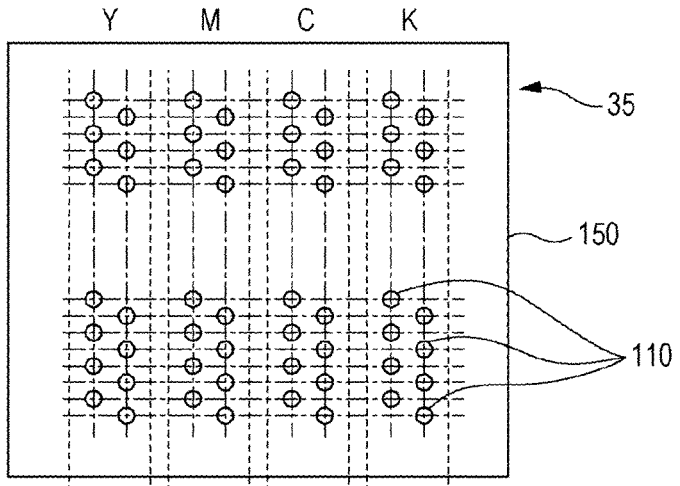
FIGS. 41A and 41B are diagrams illustrating another configuration example of a wiper (wiping section)
Figure 41B:
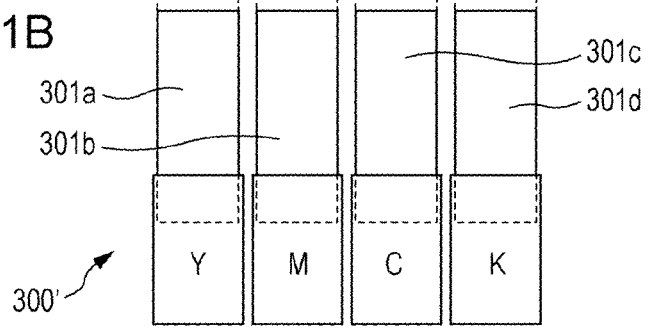
Figure 42:
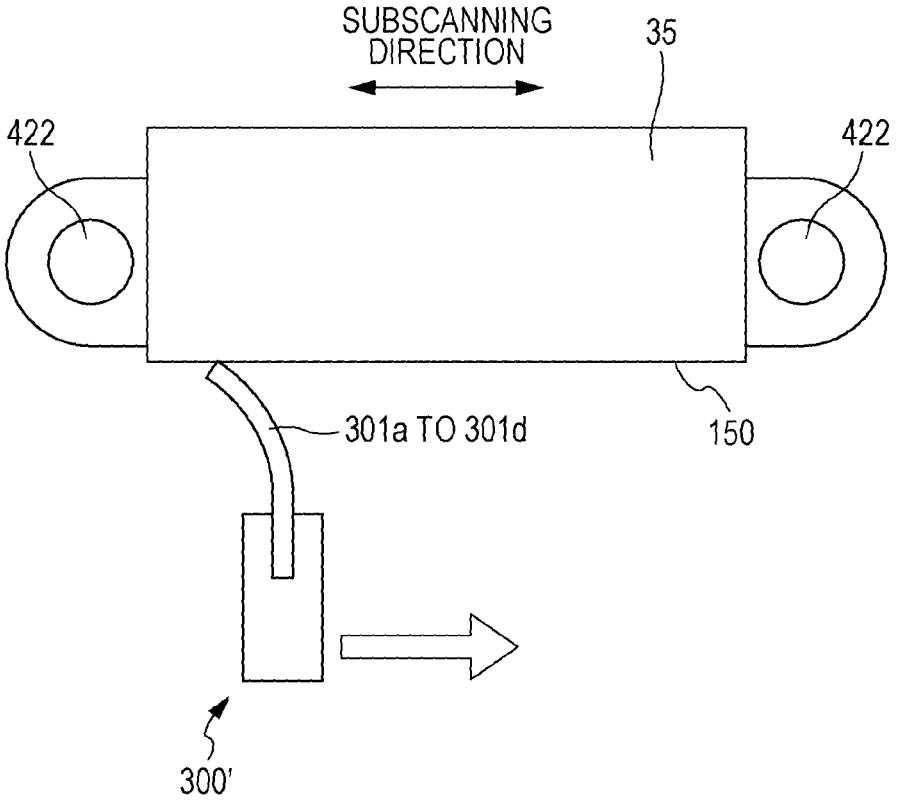
FIG. 42 is a diagram illustrating an operation state of the wiper illustrated in FIGS. 41A and 41B.

FIGS. 41A and 41B are diagrams illustrating another configuration example of the wiper (wiping section) (a wiper 300'), FIG. 41A is a diagram illustrating the nozzle surface (the nozzle plate 150) of the typing section 3 (the head unit 35), and FIG. 41B is a diagram illustrating the wiper 300'. FIG. 42 is a diagram illustrating an operation state of the wiper 300' illustrated in FIGS. 41A and 41B.

Hereinafter, based on FIGS. 41A, 41B and 42, the wiper 300' which is another configuration example of the wiper is described, but differences from the wiper 300 described above are mainly described, so the same matters are omitted in the description.

As illustrated in FIG. 41A, on the nozzle surface of the typing section 3, the plurality of nozzles 110 are divided into four sets of nozzle groups corresponding to the respective colors of ink: yellow (Y), magenta (M), cyan (C), and black (K). The wiper 300' in the configuration example can respectively perform the wiping processes on these four sets of nozzle groups, for each color of nozzle groups by the configuration described below.

As illustrated in FIG. 41B, the wiper 300' has the wiping member 301*a* for a yellow nozzle group, the wiping member 301*b* for a magenta nozzle group, the wiping member 301*c* for a cyan nozzle group, and the wiping member 301*d* for a black nozzle group. As illustrated in FIG. 42, the respective wiping members 301*a* to 301*d* can be respectively moved by a moving mechanism (not illustrated) in the subscanning direction.

The wiper 300 described above is to perform the wiping process collectively on the nozzle surface of all the nozzles 110, but in the wiper 300' according to the configuration example, only the nozzle groups that requires the wiping process can be wiped. Therefore, the restoration process that does not include an unnecessary process can be performed.

Figure 43:
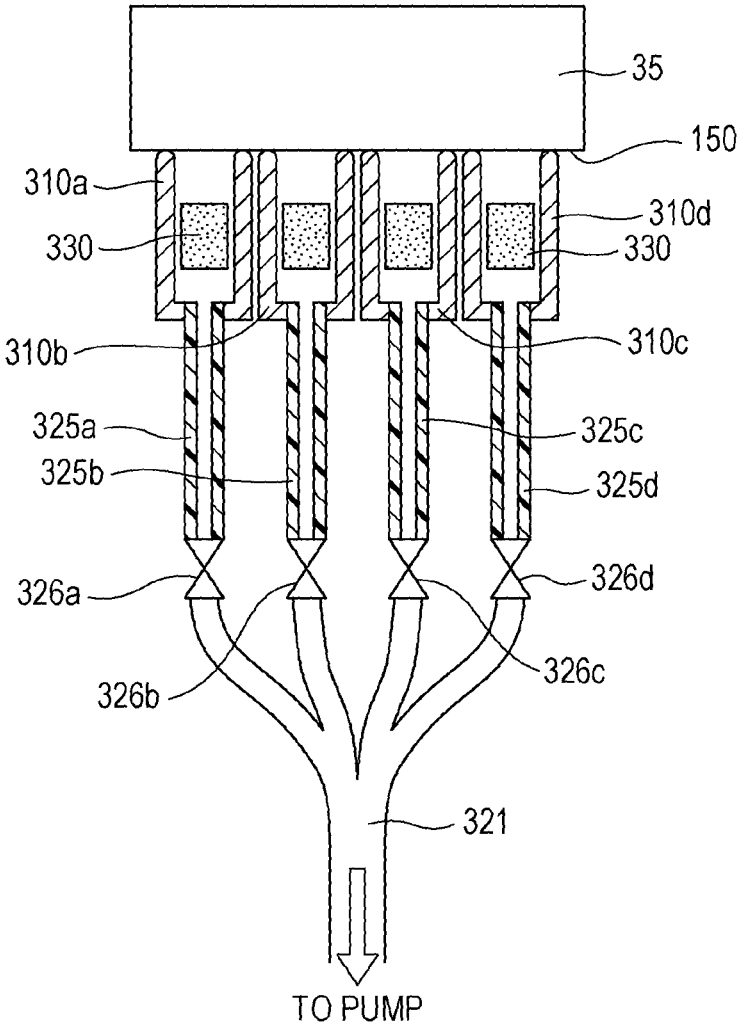
FIG. 43 is a diagram illustrating another configuration example of the pumping section.

FIG. 43 is a diagram illustrating another configuration example of a pumping section. Hereinafter, based on the diagram, another example of the pumping section is described, but differences from the pumping section described above are mainly described, so the same matters are omitted in the description.

As described in FIG. 43, the pumping section according to the configuration example has the cap 310*a* for the yellow nozzle group, the cap 310*b* for the magenta nozzle group, the cap 310*c* for the cyan nozzle group, and the cap 310*d* for the black nozzle group.

The tube 321 of the tube pump 320 is branched into 4 branch tubes 325*a* to 325*d*, and the respective branch tubes 325*a* to 325*d* are connected to the respective caps 310*a* to 310*d*, and respective valves 326*a* to 326*d* are provided in the middle of the respective branch tubes 325*a* to 325*d*.

The pumping section in the configuration example described above can respectively perform the pump suction process on four nozzle groups of the typing section 3, for each color of nozzle groups by selecting the opening and the closing of the respective valves 326*a* to 326*d*. Accordingly, since only the nozzle groups that require the pump suction process can be sucked, the restoration process that does not include an unnecessary process can be performed. Further, FIG. 43 illustrates an example in which the tube pump 320 sucks the four colors with the same tube 321, but the tube pump 320 may suck the four colors respectively with different tubes.

However, when the ink jet printer 1 described above performs the detection on all the nozzles 110 by the ejection abnormality detecting section 10, the ink jet printer 1 operates in the flows described below. Hereinafter, when the detection by the ejection abnormality detecting section 10 is performed in the ink jet printer 1, two patterns of the flows of the operation subsequent thereto are sequentially described, but a first pattern is described first.

1A

In the flushing process (flushing operation) or the printing operation, as described above, the ink jet printer 1 detects on all the nozzles 110 by the ejection abnormality detecting section 10.

As a result of the detection, if the nozzles 110 in which the ejection abnormality occurs exist (hereinafter, referred to as "abnormal nozzle"), the ink jet printer 1 preferably informs the gist. The section (method) of the notification is not specifically limited, and, for example, the notification may be displayed on the operation panel 7, may be performed by a voice, a warning sound, the turning on and off of a lamp, or may be performed by transmitting ejection abnormality information to the host computer 8 or the like through the interface 9, or to a printer server through the network.

2A

As a result of the detection in "1A", if the nozzles 110 in which the ejection abnormality occurs (abnormal nozzle) exist, the restoration process by the restoring section 24 is performed (by interrupting the printing operation if the printing operation is in process). In this case, the restoring section 24 performs the restoration process of the kind corresponding to the cause of the ejection abnormality of the abnormal nozzle as illustrated in the flowchart of FIG. 40 described below. Accordingly, the pump suction process is not performed, for example, even when the cause of the ejection abnormality of the abnormal nozzle is the paper dust attachment, that is, when the pump suction process is not necessary. Therefore, it is possible to prevent the ink from being unnecessarily discharged, and to decrease the consumption amount of the ink. In addition, since an unnecessary kind of the restoration process is not performed, it is possible to reduce the time required in the restoration process and to enhance the throughput of the ink jet printer 1 (the number of printed sheets per unit time).

In addition, the restoration process may not be performed on all the nozzles 110, but it is preferable to perform on the abnormal nozzles only. For example, if the flushing process is performed as the restoration process, the flushing operation may be performed only on the abnormal nozzle. In addition, if the wiping section and the pumping section are configured so as to be capable of respectively performing the restoration process on each color of nozzle groups as illustrated in FIGS. 41A to 43, it is possible to perform the wiping process or the pump suction process only on the abnormal nozzle detected in "1A".

In addition, in "1A", if the plurality of abnormal nozzles of which causes of the ejection abnormality are different are detected, it is preferable to perform the plurality kinds of restoration processes so that all the causes of the ejection abnormality can be solved.

3A

If the restoration process of "2A" is ended, the liquid ejection operation is performed only on the abnormal nozzle detected in "1A", and the detection by the ejection abnormality detecting section 10 is performed only on the abnormal nozzle. Accordingly, since it is possible to check whether the abnormal nozzle detected in "1A" are restored to the normal state, it is possible to prevent the ejection abnormality from occurring in the subsequent printing operation.

In addition, here, since the detection by the ejection abnormality detecting section 10 is performed by causing the abnormal nozzle to perform the liquid ejection operation, an ink drop does not have to be ejected from the nozzle 110 which is normal in "1A". Accordingly, it is possible to avoid unnecessarily ejecting ink, so it is possible to reduce the consumption amount of the ink. Moreover, it is possible to reduce the burden of the ejection abnormality detecting section 10 and the control portion 6.

Further, when the ejection abnormality nozzles 110 by the detection in "3A" exist, it is preferable to perform the restoration process by the restoring section 24 again.

Hereinafter, in the ink jet printer 1, if the detection by the ejection abnormality detecting section 10 is performed, a second pattern of the subsequent flows of the operation is described. That is, according to the embodiment, instead the previous "1A" to "3A", control may be performed in the flows of "1B" to "5B" as below.

1B

In the same manner as in "1A", the detecting by the ejection abnormality detecting section 10 is performed on all the nozzles 110.

2B

As a result of the detection in "1B", when the nozzles 110 in which the ejection abnormality occurs exist (hereinafter, referred to as an "abnormal nozzle"), the flushing process is performed only on the abnormal nozzle (by interrupting the printing operation if the printing operation is in process). If the cause of the ejection abnormality of the abnormal nozzle is insignificant, the abnormal nozzle can be restored to the normal state by the flushing process. In addition, at this point, since the ink drop is not ejected from the normal nozzle 110, ink is not unnecessarily consumed. When the detection by the ejection abnormality detecting section 10 is frequently performed, the cause of the ejection abnormality is insignificant in many cases. Therefore, it is possible to effectively and quickly perform the restoration process by first performing the flushing process on the abnormal nozzle regardless of the cause of the ejection abnormality.

3B

If the flushing process of "2B" is performed, the liquid ejection operation is performed only on the abnormal nozzle detected in "1B", and the detection by the ejection abnormality detecting section 10 is performed only on the abnormal nozzle. Accordingly, since it is possible to check whether the abnormal nozzle detected in "1B" is restored to the normal state, the occurrence of the ejection abnormality can be more securely prevented in the subsequent printing operation.

In addition, here, since the detection by the ejection abnormality detecting section 10 is performed by causing the abnormal nozzle to perform the liquid ejection operation, an ink drop does not have to be ejected from the nozzle 110 which is normal in "1B". Accordingly, it is possible to avoid unnecessarily ejecting ink, so it is possible to reduce the consumption amount of the ink. Moreover, it is possible to reduce the burden of the ejection abnormality detecting section 10 and the control portion 6.

4B

As a result of the detection in "3B", the nozzle 110 in which the ejection abnormality is not solved (hereinafter, referred to as "re-abnormal nozzle"), the restoration process by the restoring section 24 is performed. In this case, the restoring section 24 performs the restoration process of the kind corresponding to the cause of the ejection abnormality of re-abnormal nozzle as illustrated in the flowchart of FIG. 40 described above. Accordingly, the pump suction process is not performed, for example, even when the cause of the ejection abnormality of the abnormal nozzle is the paper dust attachment, that is, the pump suction process is not necessary. Therefore, it is possible to prevent the ink from being unnecessarily discharged, and to decrease the consumption amount of the ink. In addition, since an unnecessary kind of the restoration process is not performed, it is possible to reduce the time required in the restoration process and to enhance the throughput of the ink jet printer 1 (the number of printed sheets per unit time).

In addition, since the flushing process is performed in "2B", it is preferable that another restoration process be performed in "4B". That is, if the cause of ejection abnormality of the re-abnormal nozzle is the bubble mixture or the dried and thickened, the pump suction process is preferably performed, and if the cause is the paper dust attachment, the wiping process by the wiper 300 or 300' is preferably performed.

Further, in "4B", the other processes are the same as in "2A".

5B

If the restoration process of "4B" is ended, the liquid ejection operation is performed only on the re-abnormal nozzle detected in "3B", and the detecting by the ejection abnormality detecting section 10 is performed only on the re-abnormal nozzle. Accordingly, since it is possible to check whether the re-abnormal nozzle detected in "3B" is restored to the normal state, it is possible to more securely prevent the ejection abnormality from occurring in the subsequent printing operation.

In addition, here, since the detection by the ejection abnormality detecting section 10 is performed by causing the re-abnormal nozzle to perform the liquid ejection operation, an ink drop does not have to be ejected from the nozzle 110 which is normal in "1B" or "3B". Accordingly, it is possible to avoid unnecessarily ejecting ink, so it is possible to reduce the consumption amount of the ink. Moreover, it is possible to reduce the burden of the ejection abnormality detecting section 10 and the control portion 6.

In the above, in "1A" to "3A" and "1B" to "5B", after the restoration process according to the cause of the ejection abnormality is performed, the flushing process on the respective nozzles 110 (all the nozzles 110) is preferably performed. Accordingly, it is possible to prevent respective colors of ink which is residual in the nozzle surface (the nozzle plate 150) from being mixed, and to prevent the mixed color of ink.

As described above, since the liquid ejecting apparatus according to the embodiment does not require another component (for example, optical dot omission detection apparatus) in addition to components in the liquid ejecting apparatus that can detect the ejection abnormality in the related art, the ejection abnormality of the liquid drop can be detected without increasing the size of the liquid ejecting head, and the manufacture cost of the liquid ejecting apparatus that can detect the ejection abnormality (dot omission) can be suppressed to be low. In addition, since the ejection abnormality of the liquid drop is detected by using the residue vibration of the vibration plate after the liquid ejection operation, it is possible to detect the ejection abnormality of the liquid drop even in the middle of the recording operation.

Second Embodiment

Next, another configuration example of the ink jet head is described. FIGS. 44 to 47 are cross-sectional views schematically illustrating other configurations of the ink jet head (head unit) respectively. Hereinafter, the configuration examples are described with reference to the drawings, but differences from the first embodiment are mainly described, so the same matters are omitted in the description.

Figure 44:
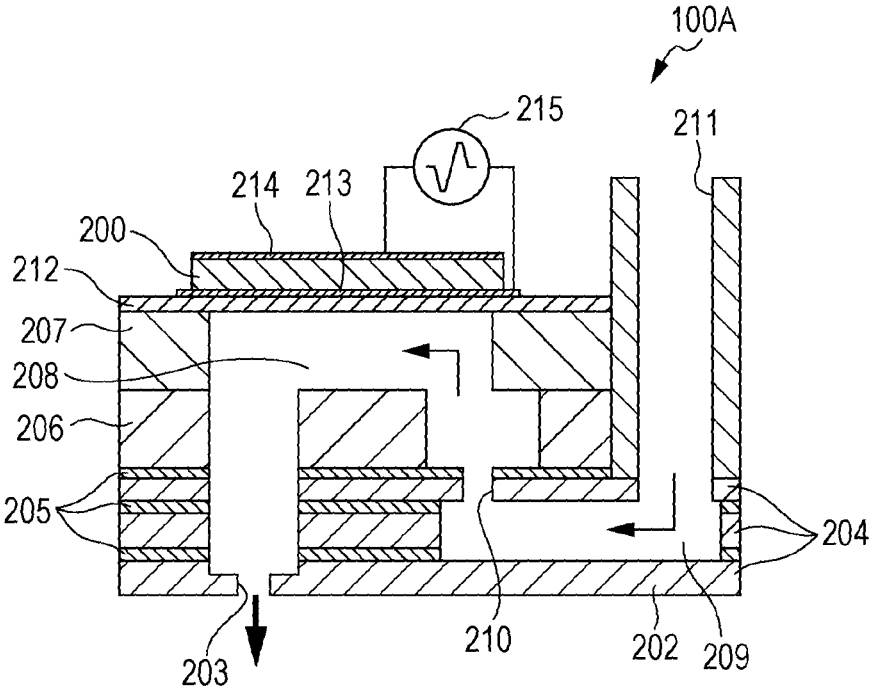
FIG. 44 is a cross-sectional view schematically illustrating another configuration example of the ink jet head.
Figure 45:
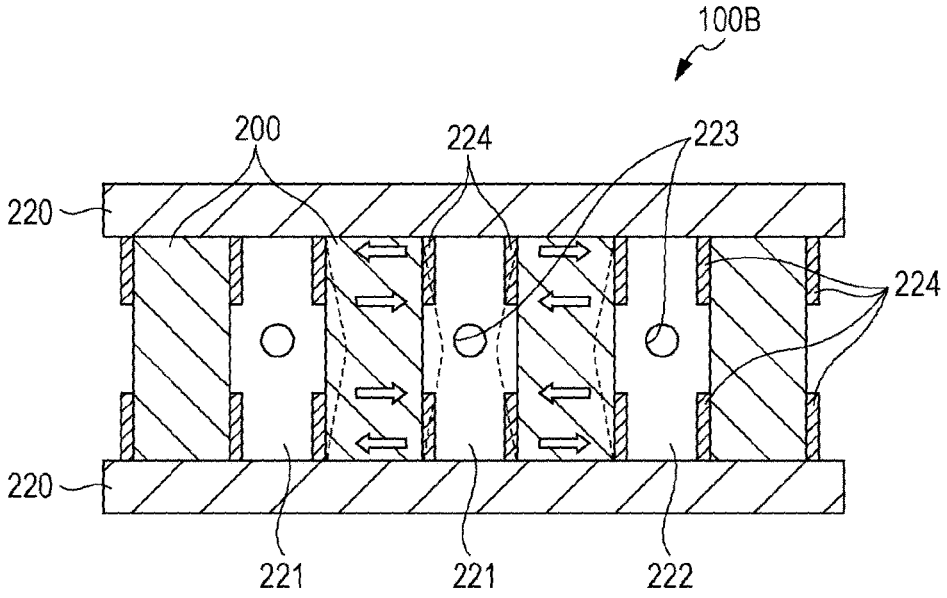
FIG. 45 is a cross-sectional view schematically illustrating another configuration example of the ink jet head.

The ink jet head 100A illustrated in FIG. 44 vibrates a vibration plate 212 by driving a piezoelectric element 200, and ejects ink (liquid) in a cavity 208 from nozzles 203. A stainless steel metal plate 204 is bonded to a stainless steel nozzle plate 202 in which the nozzles (holes) 203 are formed, through an adhesive film 205, and further the stainless steel metal plate 204 is bonded thereon through the adhesive film 205. Also, thereon, a communication opening forming plate 206 and a cavity plate 207 are sequentially bonded.

The nozzle plate 202, the metal plate 204, the adhesive film 205, the communication opening forming plate 206, and the cavity plate 207 are respectively formed in predetermined shapes (shapes in which concave portions are formed) and are overlapped with each other, so that the cavity 208 and a reservoir 209 are formed. The cavity 208 and the reservoir 209 communicate with each other through an ink supplying opening 210. In addition, the reservoir 209 is communicates with an ink intake opening 211.

The vibration plate 212 is installed in the upper opening portion of the cavity plate 207, and the piezoelectric element (piezo element) 200 is bonded to the vibration plate 212 through a lower electrode 213. In addition, an upper electrode 214 is bonded to the opposite side of the lower electrode 213 of the piezoelectric element 200. A head drive 215 includes a driving circuit that generates a driving voltage waveform, and the piezoelectric element 200 is vibrated by applying (supplying) a driving voltage waveform between the upper electrode 214 and the lower electrode 213, and the vibration plate 212 bonded thereto is vibrated. The capacity (pressure in cavity) of the cavity 208 is changed by the vibration of the vibration plate 212, and the ink (liquid) that fills the cavity 208 is ejected by the nozzles 203 as the liquid drop.

The liquid amount decreased in the cavity 208 by the ejection of the liquid drop is replenished by supplying ink from the reservoir 209. In addition, ink is supplied from the ink intake opening 211 to the reservoir 209.

As described above, the ink jet head 100B illustrated in FIG. 45 also ejects ink (liquid) in a cavity 221 from nozzles by driving the piezoelectric elements 200. The ink jet head 100B has substrates 220, and the plurality of piezoelectric elements 200 are intermittently installed between both of the substrates 220 having a predetermined interval.

The cavities 221 are formed between the adjacent piezoelectric elements 200. The plate (not illustrated) is installed on the front side of the cavities 221 in FIG. 45, and nozzle plates 222 are installed on the rear side thereof. Nozzles (holes) 223 are formed at positions corresponding to the respective cavities 221 of the nozzle plates 222.

Pairs of electrodes 224 are installed respectively on one surface and the other surfaces of the respective piezoelectric elements 200. That is, four of the electrodes 224 are bonded to one of the piezoelectric elements 200. The piezoelectric elements 200 have the shear mode deformation and are vibrated by the application of predetermined driving voltage waveforms between predetermined electrodes among these electrodes 224 (indicated by arrows in FIG. 45), the capacities of the cavities 221 (pressures in cavities) are changed by the vibration, and the ink (liquid) that fills the cavities 221 is ejected from the nozzles 223 as liquid drops. That is, the piezoelectric elements 200 themselves function as vibration plates in the ink jet heads 100B.

As described above, the ink jet head 100C illustrated in FIG. 46 ejects ink (liquid) in a cavity 233 from a nozzle 231 by driving the piezoelectric element 200. The ink jet head 100C includes a nozzle plate 230 in which the nozzle 231 is formed, a spacer 232, and the piezoelectric element 200. The piezoelectric element 200 is installed to be separated from the nozzle plate 230 through the spacer 232 with a predetermined distance, and the cavity 233 is formed in a space enclosed with the nozzle plate 230, the piezoelectric element 200, and the spacer 232.

Figure 46:
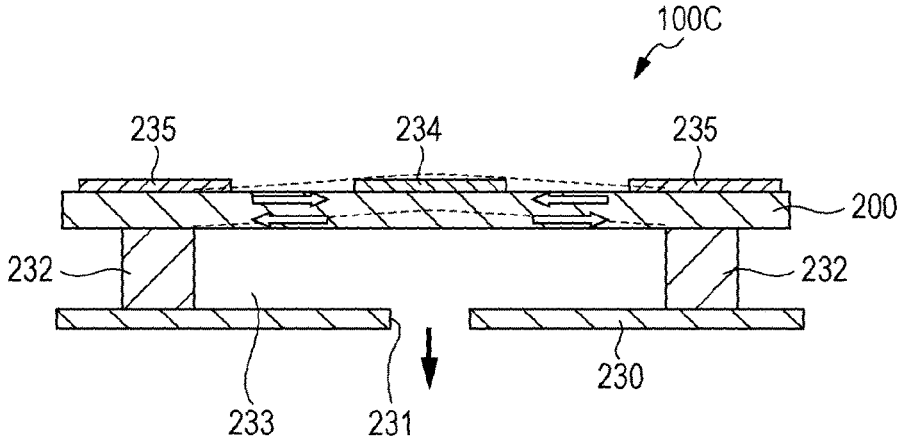
FIG. 46 is a cross-sectional view schematically illustrating another configuration example of the ink jet head.

A plurality of electrodes are bonded on the upper surface of the piezoelectric element 200 in FIG. 46. That is, a first electrode 234 is boned in substantially the center of the piezoelectric element 200, and second electrodes 235 are boned respectively on both sides thereof. The piezoelectric element 200 have the shear mode deformation and are vibrated by the application of predetermined driving voltage waveforms between the first electrode 234 and the second electrodes 235 (indicated by arrows in FIG. 46), the capacity of the cavity 233 (pressure in cavity) is changed by the vibration, and the ink (liquid) that fills the cavity 233 is ejected from the nozzle 231 as liquid drops. That is, the piezoelectric element 200 itself functions as vibration plates in the ink jet heads 100C.

As described above, the ink jet head 100D illustrated in FIG. 47 ejects ink (liquid) in a cavity 245 from a nozzle 241 by driving the piezoelectric elements 200. The ink jet head 100D includes a nozzle plate 240 in which the nozzle 241 is formed, a cavity plate 242, a vibration plate 243, and a stacked piezoelectric element 201 obtained by stacking the plurality of piezoelectric elements 200.

The cavity plate 242 is formed in a predetermined shape (a shape in which a concave portion is formed), and the cavity 245 and a reservoir 246 are formed accordingly. The cavity 245 and the reservoir 246 are connected through an ink supplying opening 247. In addition, the reservoir 246 is connected to the ink cartridge 31 through the ink supplying tube 311.

Figure 47:
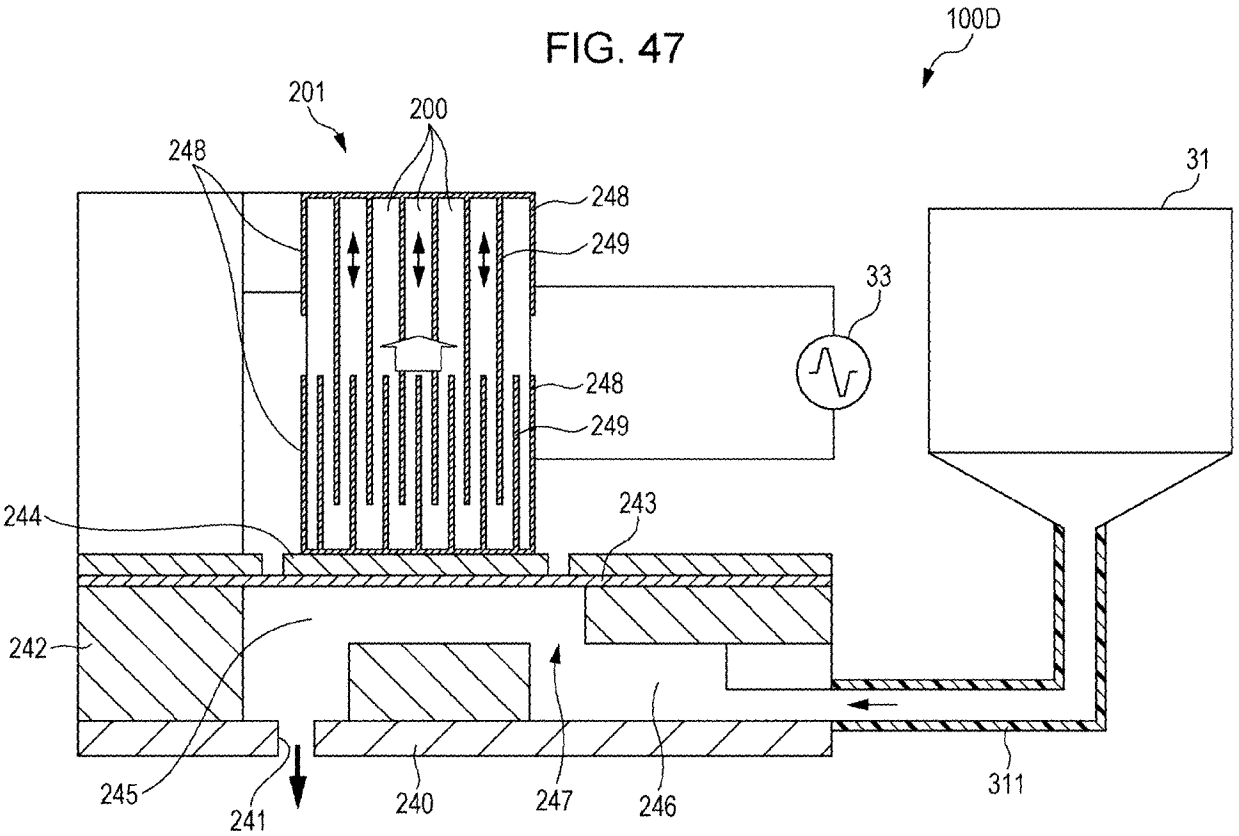
FIG. 47 is a cross-sectional view schematically illustrating another configuration example of the ink jet head.

The lower end of the stacked piezoelectric element 201 in FIG. 47 is bonded to the vibration plate 243 through an intermediate layer 244. A plurality of external electrodes 248 and a plurality of internal electrodes 249 are bonded to the stacked piezoelectric element 201. That is, the external electrodes 248 are bonded to the external surface of the stacked piezoelectric element 201, and the internal electrodes 249 are installed between the respective piezoelectric elements 200 (or inside portions of the respective piezoelectric element) that configure the stacked piezoelectric element 201. In this case, portions of the external electrodes 248 and the internal electrodes 249 are arranged to be alternately overlapped with each other in the thickness direction of the piezoelectric elements 200.

Also, the stacked piezoelectric element 201 is deformed as indicated by an arrow in FIG. 47 (expanded and contracted in the vertical direction of FIG. 47) by applying driving voltage waveforms between the external electrodes 248 and the internal electrodes 249 by the head driver 33, and the vibration plate 243 is vibrated by the vibration thereof. The capacity of the cavity 245 (pressure in cavity) is changed by the vibration of the vibration plate 243, and the ink (liquid) that fills the cavity 245 is ejected from the nozzle 241 as liquid drops.

The liquid amount decreased in the cavity 245 by the ejection of the liquid drop is replenished by supplying ink from the reservoir 246. In addition, ink is supplied from the ink cartridge 31 to the reservoir 246 through the ink supplying tube 311.

In the same manner as the electrostatic capacity-type ink jet heads 100, with respect to the ink jet heads 100A to 100D including piezoelectric elements, it is possible to detect ejection abnormality of the liquid drops or specify the cause of the ejection abnormality, based on the residue vibrations of the piezoelectric elements functioning as the vibration plate or the vibration plate. Further, the ink jet heads 100B and 100C may be configured to be provided with vibration plates (vibration plates for residue vibration detection) as sensors at positions facing the cavities so as to detect residue vibrations of the vibration plates.

Third Embodiment

Figure 48:
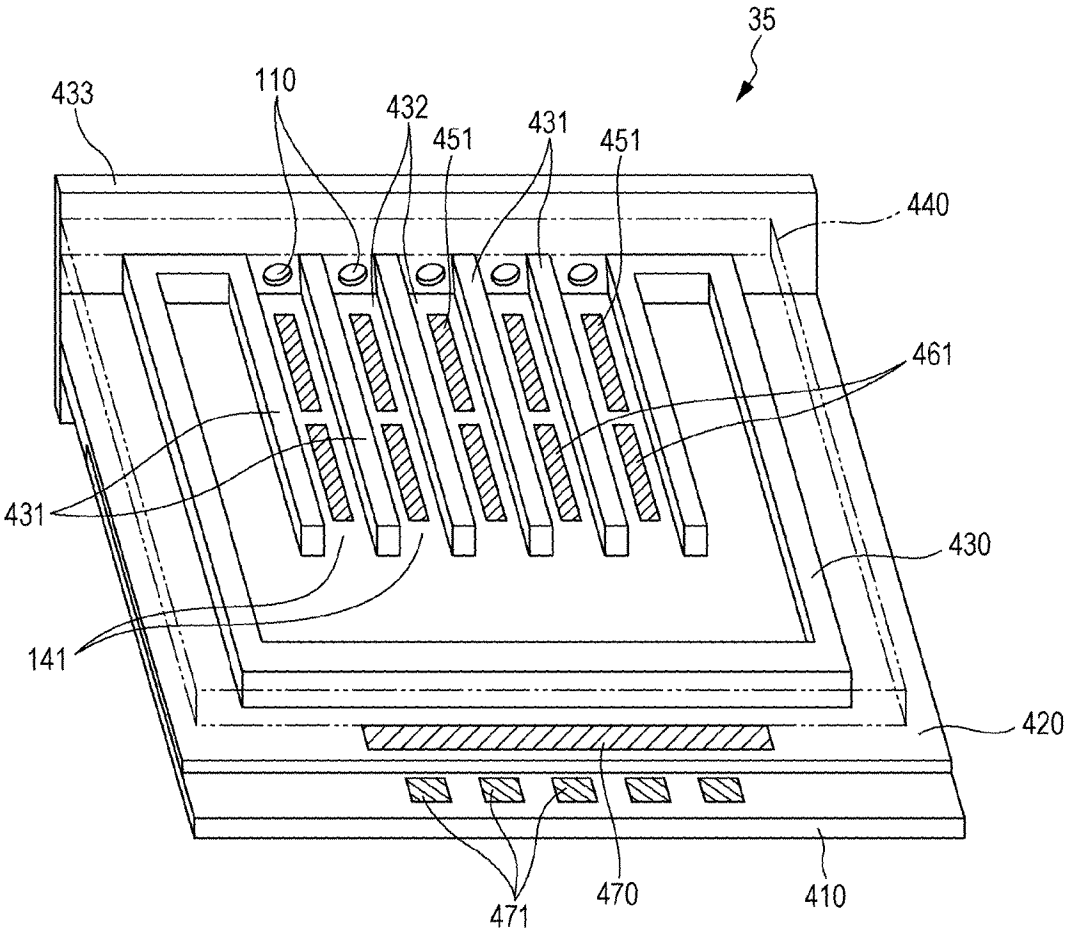
FIG. 48 is a perspective view illustrating the configuration of the head unit according to a third embodiment.
Figure 49:
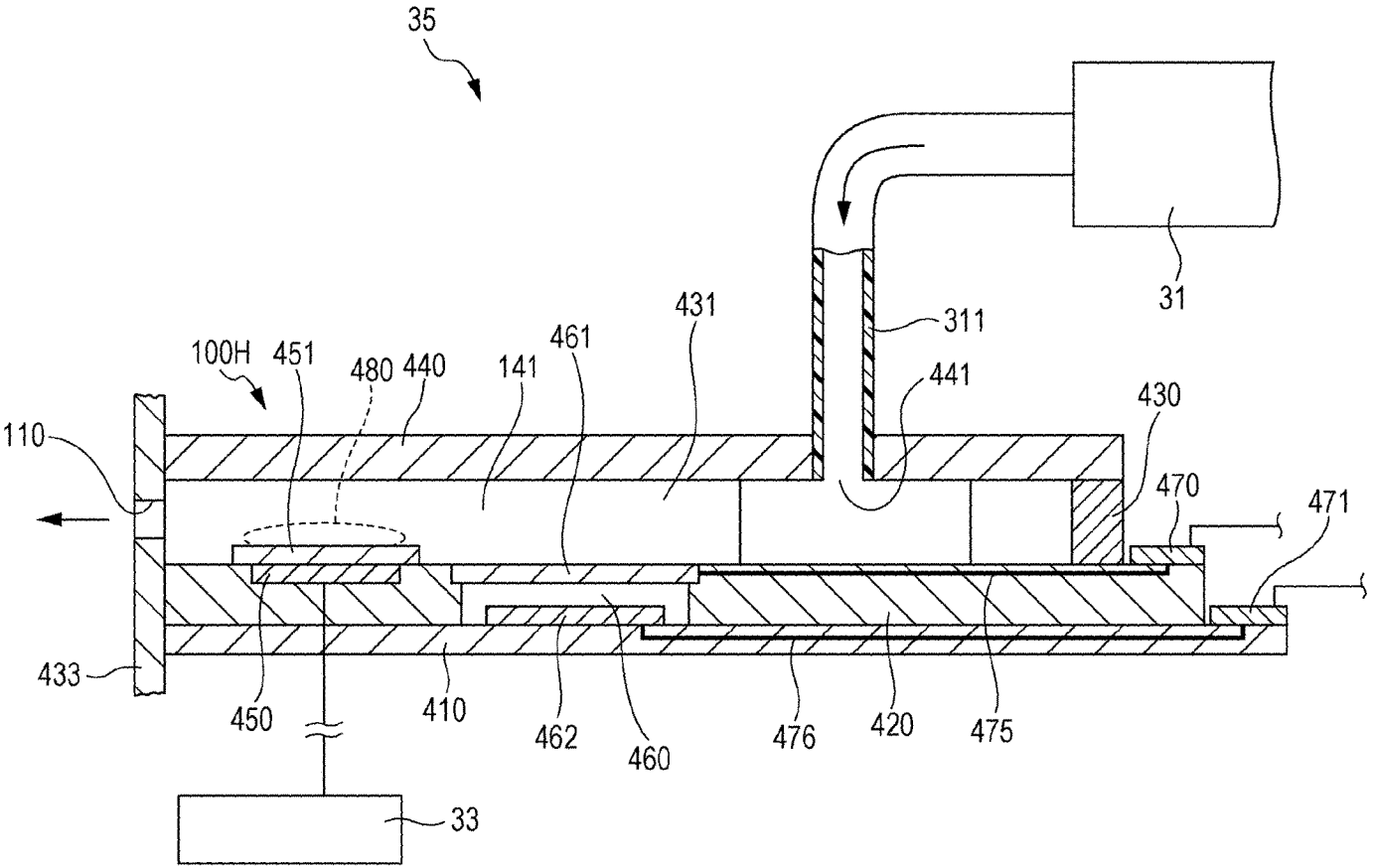
FIG. 49 is a cross-sectional view illustrating the head unit (ink jet head) illustrated in FIG. 48.

Next, still another configuration example of the ink jet head is described. FIG. 48 is a perspective view illustrating the head unit 35 according to the third embodiment, and FIG. 49 is a cross-sectional view illustrating the head unit 35 (an ink jet head 100H) illustrated in FIG. 48. Hereinafter, the configuration is described with reference to FIGS. 48 and 49. However, differences from the above embodiments are mainly described, so the same matters are omitted in the description.

The head unit 35 (the ink jet head 100H) illustrated in FIGS. 48 and 49 is a so-called film boiling ink jet-type (thermal jet-type) head unit, and has a configuration in which a supporting substrate 410, a substrate 420, an exterior wall 430, a partition 431, and a top plate 440 are bonded from the lower side of FIGS. 48 and 49 in this sequence.

The substrate 420 and the top plate 440 are installed to have a predetermined interval with interposing the exterior wall 430 and the plurality (6 in the example of FIGS. 48 and 49) of partitions 431 arranged in parallel with the same interval. Also, the plurality of (5 in the example of FIGS. 48 and 49) cavities (pressure chamber: ink chamber) 141 partitioned by the partitions 431 are formed between the substrate 420 and the top plate 440. The respective cavities 141 have a strip shape (rectangular parallelepiped shape).

In addition, as illustrated in FIGS. 48 and 49, the left end portions of the respective cavities 141 in FIG. 49 (upper end in FIG. 48) are covered with a nozzle plate (front plate) 433. The nozzles (holes) 110 communicating with the respective cavities 141 are formed in the nozzle plate 433, and ink (liquid material) is ejected from the nozzles 110.

In FIG. 48, though the nozzles 110 are arranged in the nozzle plate 433 linearly, that is, in a column shape, it is obvious that the arrangement pattern of the nozzle is not limited to this.

Further, a configuration in which the upper ends of the respective cavities 141 in FIG. 48 (left ends in FIG. 49) are opened without providing the nozzle plate 433, and the opened apertures become nozzles may be provided.

In addition, ink intake openings 441 are formed in the top plate 440, and the ink intake openings 441 are connected to the ink cartridges 31 through the ink supplying tubes 311.

Heat generating bodies 450 are installed (embedded) in portions corresponding to the respective cavities 141 of the substrate 420. The respective heat generating bodies 450 are independently energized by the head driver (energization section) 33 including the driving circuit 18 and generate heat. The head driver 33 outputs, for example, pulse-type signals, as driving signals of the heat generating bodies 450 according to printing signals (data to be printed) input from the control portion 6.

In addition, the surfaces on the cavities 141 side of the heat generating bodies 450 are covered with a protection film (cavitation resistant film) 451. The protection film 451 is provided in order to prevent the heat generating bodies 450 to directly come into contact with the ink in the cavities 141. It is possible to prevent deterioration, degradation, or the like caused by the direct contact of the heat generating bodies 450 with the ink by providing the protection film 451.

Concave portions 460 are formed in portions which are near the respective heat generating bodies 450 of the substrate 420 and correspond to the respective cavities 141. The concave portions 460 can be formed, for example, by etching or punching.

Vibration plates (diaphragm) 461 are installed so as to cover the cavities 141 of the concave portions 460. The vibration plates 461 are elastically deformed (elastically displaced) in the vertical direction in FIG. 49 according to the changes of the pressure (hydraulic pressure) in the cavities 141.

The vibration plates 461 also function as electrodes. The entire body of the vibration plates 461 may be conductive, or may be formed by stacking conductive layers and insulation layers.

Meanwhile, the other sides of the concave portions 460 may be covered with the supporting substrate 410, and electrodes (segment electrode) 462 are respectively installed in portions corresponding to the respective vibration plates 461 on the upper surface of the supporting substrate 410 in FIG. 49.

The vibration plates 461 and the electrodes 462 are arranged so as to face with each other substantially in parallel with a predetermined gap distance.

In this manner, the parallel plate capacitors are formed by arranging the vibration plates 461 and the electrodes 462 to be separated from each other with slight interval distances. Also, if the vibration plates 461 are displaced (deformed) in the vertical direction in FIG. 49 according to the pressure in the cavities 141, gap distances between the vibration plates 461 and the electrodes 462 are changed accordingly, and the electrostatic capacity of the parallel plate capacitor is changed. In the ink jet head 100H, the vibration plates 461 and the electrodes 462 function as sensors that detects the abnormality of the corresponding ink jet head 100H based on the change of the electrostatic capacity over time according to the vibrations of the vibration plates 461 (residue vibrations (damped vibrations)).

In addition to the cavities 141 of the substrate 420, a common electrode 470 is formed. In addition, in addition to the cavities 141 of the supporting substrate 410, segment electrodes 471 are formed. The electrodes 462, the common electrode 470, and the segment electrodes 471 can be respectively formed by a method of bonding, plating, deposition, or sputtering of metal foil, or the like.

The respectively vibration plates 461 and the common electrode 470 are electrically connected to each other by a conductor 475, and the respective electrodes 462 and the respective segment electrodes 471 are connected to each other by a conductor 476.

As the conductors 475 and 476, [1] conductors obtained by arranging wiring such as a metal line, [2] conductors obtained by forming a thin film made of a conductive material such as gold and copper on a surface of the substrate 420 or the supporting substrate 410, [3] conductors obtained by giving conductivity by performing ion-doping on a conductor forming part such as the substrate 420, or the like are included, respectively.

Next, a function (operation principle) of the ink jet head 100H is described.

If the driving signals (pulse signals) are output from the head driver 33 and energize the heat generating bodies 450, the heat generating bodies 450 instantly generate heat to the temperature of 300° C. or greater. Accordingly, if bubbles (different from bubbles generated and mixed in the cavity which cause the ejection abnormality described above) 480 are generated on the protection film 451 by film boiling, the bubbles 480 instantly expand. Accordingly, the hydraulic pressure of the ink (liquid material) that fills the cavities 141 increases, and a portion of the ink is ejected from the nozzle 110 as an ink drop.

The liquid amount decreased in the cavities 141 by the ejection of the liquid drop is replenished by supplying new ink from the ink intake openings 441 to the cavities 141. The ink is supplied from the ink cartridges 31 through the ink supplying tubes 311.

Right after the liquid drops of the ink are ejected, the bubbles 480 drastically shrink, and return to the original state. At this point, the vibration plates 461 are elastically displaced (deformed) by the pressure change in the cavities 141, and generate damped vibrations (residue vibrations) until the next driving signal is input and an ink drop is ejected again. If the vibration plates 461 generate the damped vibrations, the electrostatic capacities of the capacitor configured with the vibration plates 461 and the electrodes 462 opposite thereto are changed according to the damped vibrations. The ink jet head 100H according to the embodiment can detect the ejection abnormality by using the changes of electrostatic capacities over time in the same manner as the ink jet heads 100 according to the first embodiment described above.

Fourth Embodiment

Since the hardware configurations according to the fourth embodiment are the same as those according to the first embodiment, the descriptions are omitted. FIG. 50 is a table illustrating printing modes prepared in the fourth embodiment. As illustrated in FIG. 50, in the fourth embodiment, respective modes of "highest quality", "high speed and high quality", "normal", and "high speed draft" are prepared as printing modes. As illustrated in FIG. 50, the waveforms (A) to (D) are selected in these modes. The waveform is the drive waveform that is generated by the latch signal and the drive waveform generating section 181.

Figures 51A, 51B:
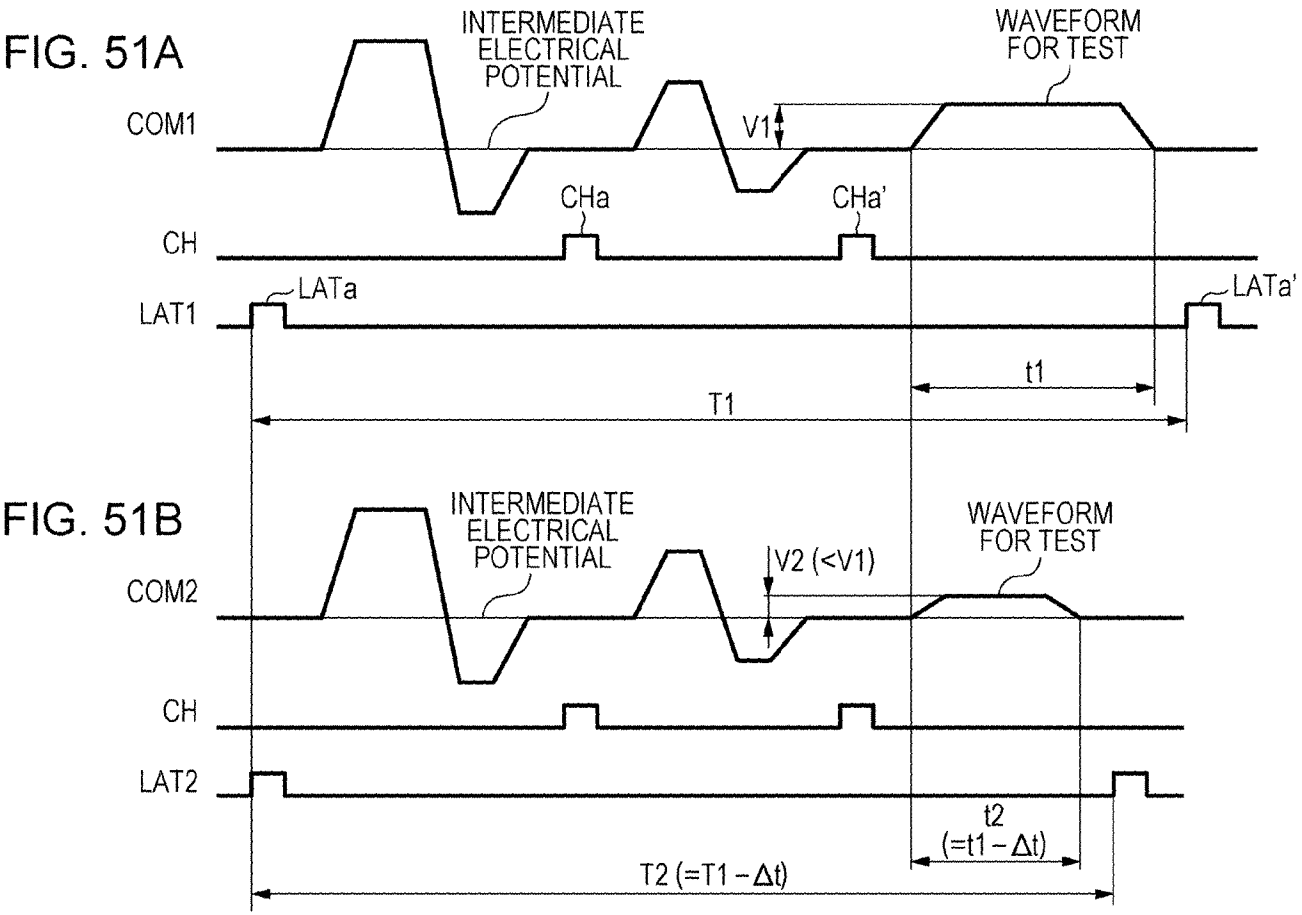
FIGS. 51A and 51B are diagrams illustrating waveforms in a highest quality mode and a high speed and high quality mode.

FIGS. 51A and 51B are diagrams illustrating the waveform (A) selected in the highest quality mode, and the waveform (B) selected in the high speed and high quality mode. If the waveform (A) is selected, a signal COM1 is selected as the drive waveform, and a signal LAT1 is selected as the latch signal. If the waveform (B) is selected, a signal COM2 is selected as the drive waveform, and a signal LAT2 is selected as the latch signal.

As illustrated in FIG. 50, if the waveform (A) is selected, an ejection amount for each section is (12+8+0) ng, and the maximum ejection amount is 20 ng. The maximum ejection amount is identical to the total value of the ejection amount for each section. The section in the ejection amount for each section is the section of the signal COM1 obtained by dividing by a channel signal CH. The first section is regulated from a rise LATa of the signal LAT1 to a rise CHa of the channel signal CH illustrated in FIG. 50. The second section is regulated from the rise CHa to another rise CHa' of the channel signal CH illustrated in FIG. 50. The third section is regulated from the rise CHa' to another rise LATa' of the signal LAT1 illustrated in FIG. 50.

The fact that the ejection amount for each section is 12+8+0 (ng) means that the ink in the third section is not ejected. In this section, the abnormality detection described in the first embodiment is performed. Hereinafter, in the third section of the signal COM1, a portion having a higher electrical potential than the intermediate electrical potential is called a "waveform for a test".

As illustrated in FIGS. 51A and 51B, differences between the signals COM1 and COM2 are voltage values and lengths of times for the waveform for the test (hereinafter, referred to as "test time"). The voltage value of the waveform for the test of the signal COM1 is a voltage V1, and the voltage value of the waveform for the test of the signal COM2 is a voltage V2 (<the voltage V1). The test time of the signal COM1 is t1, and the test time of the signal COM2 is t2 (=t1−Δt). Δt is the same as the difference obtained from the cycle of the signal LAT1 to the cycle of the signal LAT2 (time from the rise LATa to the rise LATa') as illustrated in FIGS. 51A and 51B. The fact that the cycle of the signal LAT1 is longer than the cycle of the signal LAT2 indicates that the maximum settable frequency in the highest quality mode (10/s) is smaller than the maximum settable frequency in the high speed and high quality mode (14.8/s). The maximum settable frequency is the maximum value of the driving frequency of the nozzle. In this manner, since the maximum settable frequencies are different, the main scanning speed of the typing section 3 in the highest quality mode is slower than that in the high speed and high quality mode as illustrated in FIG. 50. The difference between the maximum settable frequency and the main scanning speed corresponds to the state in which the printing speed in the highest quality mode is slower than the printing speed in the high speed and high quality mode.

As described above, since the highest quality mode has a voltage value of the waveform for the test lower than the high speed and high quality mode has, there is an advantage in that the residue vibration can be reduced. Since the time for detecting the residue vibration can be set to be long, there is an advantage in that the detailed information of the nozzles can be particularly obtained. However, since the driving frequency is small, there is a disadvantage in that high speed driving cannot be performed.

Figures 52A, 52B:
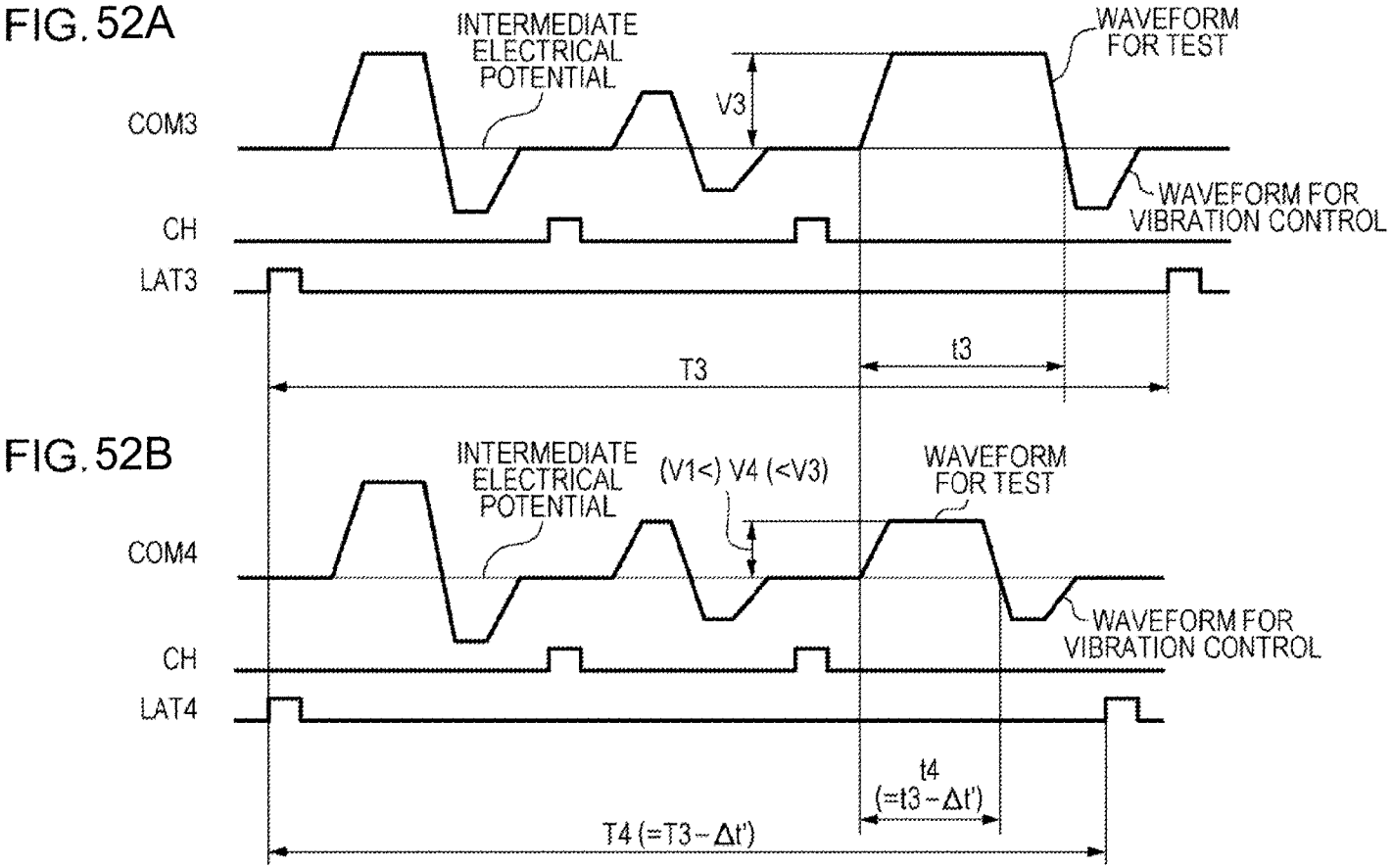
FIGS. 52A and 52B are diagrams illustrating waveforms in a normal mode and a high speed draft mode.

FIGS. 52A and 52B illustrate the waveform (C) selected in the normal mode, and the waveform (D) selected in the high speed draft mode. If the waveform (C) is selected, a signal COM3 is selected as the drive waveform, and a signal LAT3 is selected as the latch signal. If the waveform (D) is selected, a signal COM4 is selected as the drive waveform, and a signal LAT4 is selected as the latch signal.

As illustrated in FIG. 50, if the waveform (C) is selected, the ejection amount for each section is (12+8+12) ng, and the maximum ejection amount is 32 ng. The fact that the ejection amount in the third section is 12 ng means that the ink ejection is performed together with the abnormality detection by the waveform for the test.

As illustrated in FIG. 50, if the waveform (D) is selected, the ejection amount for each section is (12+8+8) ng, and the maximum ejection amount is 28 ng. The fact that ink ejection amount in the waveform for the test is smaller than that in the waveform (C) is because the voltage value in the waveform (C) (a voltage V3) is smaller than that in the waveform (D) (a voltage V4) as illustrated in FIGS. 52A and 52B.

As described above, since the voltage of waveform for the test in the high speed draft mode is smaller than that in the normal mode, there is an advantage in that the influence of the residue vibration after the test is smaller. However, since the driving amount of the piezoelectric element 200 in the abnormality detection is not sufficient, there is a disadvantage in that there are risks that the detection signal obtainable from the residue vibration after driving the piezo element 200 is not correctly output, and erroneous detection may be generated.

As illustrated in FIGS. 52A and 52B, the signals COM3 and COM4 are different from each other in test time in addition to the voltage value described above. The test time of the signal COM3 is t3, and the test time of the signal COM4 is t4 (=t3−Δt'). Δt' is the same as the difference obtained from the cycle of the signal LAT3 to the cycle of the signal LAT4 as illustrated in FIGS. 52A and 52B. The fact that the cycle of the signal LAT3 is longer than the cycle of the signal LAT4 is indicated by that with respect to the maximum settable frequency (1/s) in FIG. 50, the value in the normal mode (9.8/s) is smaller than the value in the high speed draft mode (10.2/s). In this manner, since the maximum settable frequencies are different, the main scanning speed of the typing section 3 in the normal mode is slower than that in the high speed draft mode as illustrated in FIG. 50. The differences in maximum settable frequency and in main scanning speed correspond to the fact that the printing speed in the normal mode is slower than that in the high speed draft mode.

As described above, since the test times are different, the test time in the normal mode is longer than that in the high speed draft mode. Therefore, there is an advantage in that the detailed information of the nozzles can be obtained.

However, in order to realize the ink ejection, the voltages V3 and V4 are greater than the voltages V1 and V2. Therefore, the signals COM3 and COM4 have waveforms for vibration control after the waveforms for the test. The waveforms for vibration control are for controlling the vibrations of meniscuses generated by the waveforms for the test.

If the highest quality mode and the high speed and high quality mode, and the normal mode and high speed draft mode which are generally provided as the printing modes are compared, differences are as follows. Compared with the normal mode and the high speed draft mode, the highest quality mode and the high speed and high quality mode have an advantage in that abnormality detection can be performed without ejecting ink, and an advantage in that detailed information of nozzles can be obtained since waveforms for vibration control are not required and test times can be set to be long, but the highest quality mode and the high speed and high quality mode have a disadvantage in that there are risks that the detection signal obtainable from the residue vibration after driving the piezo element 200 is not correctly output, and erroneous detection may be generated since the driving amount of the piezo element 200 in the abnormality detection is not sufficient.

Meanwhile, compared with the highest quality mode and the high speed and high quality mode, the normal mode and the high speed draft mode have an advantage in that the typing and the abnormality detection can be performed at a high speed, and an advantage in that the residue vibration can be detected while performing typing, but the normal mode and the high speed draft mode have a disadvantage in that the abnormality detection cannot be performed without ejecting ink, and since the ink ejection is performed concurrently with the abnormality detection, the normal mode and the high speed draft mode have a disadvantage in that the ejection stability at that point is poor.

As illustrated in FIG. 50, the resolution in the highest quality mode is lower than that in the high speed and high quality mode, and the resolution in the normal mode is lower than that in the high speed draft mode. Since the one with a lower resolution has a bigger liquid drop of ink, it has an advantage in that it is difficult to receive the influence of the residue vibration.

The length of the test time corresponds to the length of the duration time. The duration time refers to the time at which the maximum voltage of the waveform for the test is continued. That is, the duration time refers to a portion of the waveform for the test in which the voltage value does not change. Further, the waveform for the test may employ the lower voltage value than the intermediate electrical potential according to the characteristic or the test method of the piezo element 200.

Fifth Embodiment

Figure 53:
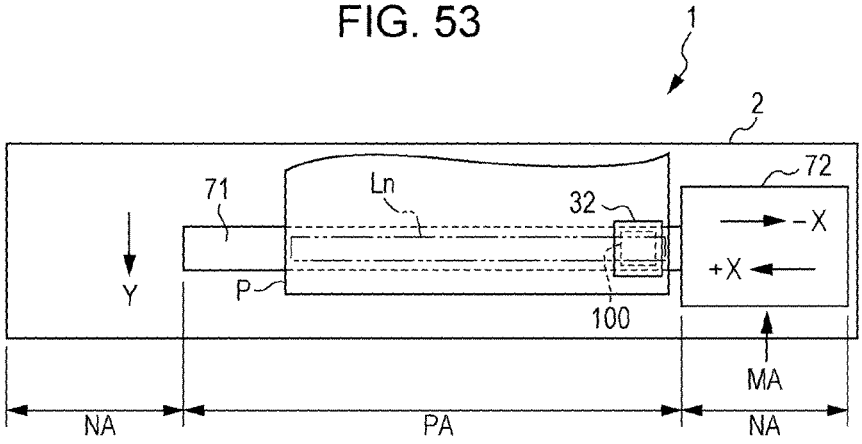
FIG. 53 is a diagram schematically illustrating a printer as a liquid ejecting apparatus according to a fifth embodiment.

Next, the printer 1 as the liquid ejecting apparatus that performs the maintenance operation of the ink jet heads 100 based on the detection result of the ejection abnormality described above is described with reference to FIGS. 53 and 54. Hereinafter, the description is made with reference to FIGS. 53 and 54, but differences from the above embodiments are mainly described, so the same matters are omitted in the description.

The printer 1 includes the ink jet head 100 as the liquid ejecting unit, an supporting stand 71 that supports the recording sheet P which is an example of the recording medium in the apparatus main body 2, and a maintenance mechanism 72 that performs the maintenance of the ink jet head 100. Further, according to the fifth embodiment, a configuration in which the one ink jet head 100 is held in the carriage 32 is described as an example, but the configuration may be change into a configuration in which the plurality of ink jet heads 100 may be held in the carriage 32.

The supporting stand 71 is arranged near the center in the scanning area that extends in the main scanning direction of the carriage 32 (in the horizontal direction in FIGS. 53 and 54), while the maintenance mechanism 72 is arranged in the end portion in the same scanning area. According to the fifth embodiment, a side on which the maintenance mechanism 72 is arranged in the main scanning direction (right side in FIG. 53) may be referred to as a "1-digit side", and the other side (left side in FIG. 53) may be referred to as an "80-digit side". In addition, the movement direction of the carriage 32 from the 1-digit side to the 80-digit side is referred to as a first scanning direction +X, and the movement direction of the carriage 32 from the 80-digit side to the 1-digit side is referred to as a second scanning direction −X.

The supporting stand 71 may be incorporated with a heat generating body so as to function as a drying mechanism for promoting drying the recording sheet P to which liquid drops are received. In addition, as the drying mechanism for promoting drying the recording sheet P, the heat generating body that heats the recording sheet P from the upper side of the carriage 32 or a blowing apparatus that blows toward the recording sheet P may be provided.

The area in which the supporting stand 71 is arranged becomes a recording area PA in which liquid drops are ejected from the ink jet head 100 to the recording sheet P, while the area in which the maintenance mechanism 72 is arranged becomes a non-recording area NA in which the recording (printing) on the recording sheet P is not performed. Also, after the carriage 32 outwardly moves, for example, the recording area PA in the first scanning direction +X at a substantially constant speed, the carriage 32 is decreased the speed in the non-recording area NA on the 80-digit side, and changes the direction changed at an end portion in the main scanning direction. Also, after the carriage 32 that has changed the direction increases the speed in the non-recording area NA on the 80-digit side, the carriage 32 inwardly moves the recording area PA again in the second scanning direction −X at a substantially constant speed.

That is, the non-recording area NA is also an area in which the reciprocating carriage 32 changes the direction. When performing a recording process, the ink jet head 100 reciprocates between the recording area PA in which the recording sheet P is arranged, and the non-recording area NA which is positioned outside the recording area PA. According to the fifth embodiment, one scanning (movement) of the carriage 32 in the first scanning direction +X or the second scanning direction −X is referred to as one pass, and a belt-shaped area Ln (area indicated with alternate long and two short dashed lines in FIG. 53) in which the recording of the ink jet head 100 can be performed while the carriage 32 performs one pass on the recording sheet P is referred to as one line. In addition, the changing of the direction by the carriage 32 in the non-recording area NA is referred to as a return.

The recording sheet P is arranged on the supporting stand 71, or is retreated from the supporting stand 71 by being transported in a transportation direction Y in the subscanning direction intersecting to the main scanning direction by a transportation mechanism (not illustrated). The recording sheet P is transported in a predetermined distance (distance corresponding to one line) in the transportation direction Y, while the carriage 32 changes the direction in the non-recording area NA. That is, the printer 1 performs recording on the entire recording sheet P by performing the recording for one line in the recording area PA and the intermittent transportation of the recording sheet P.

Figure 54:
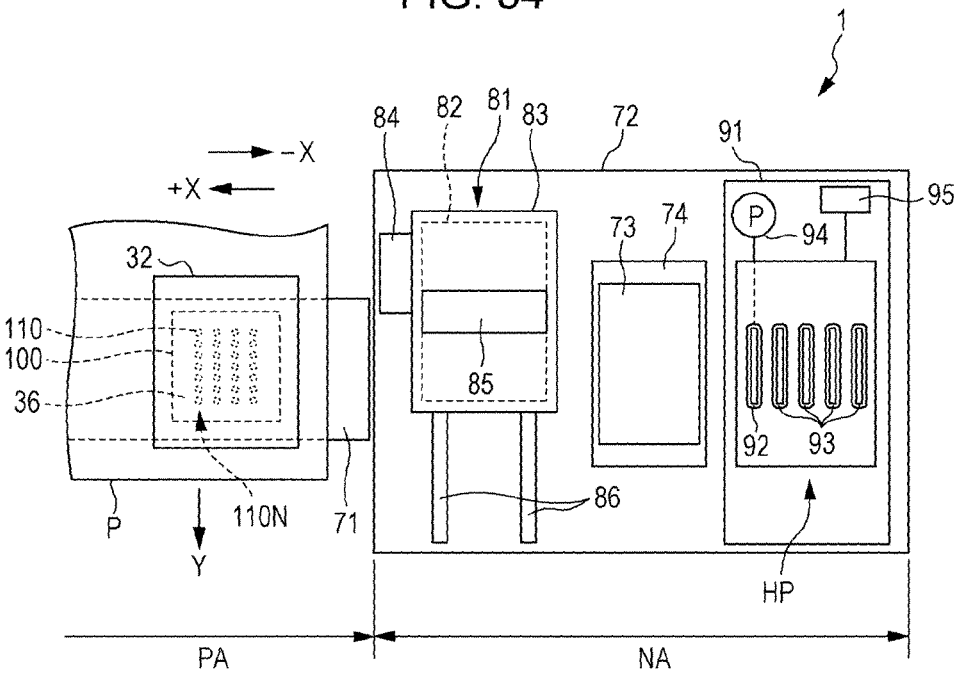
FIG. 54 is a plan view schematically illustrating a portion of the printer in FIG. 53.

As illustrated in FIG. 54, in the ink jet head 100, the plurality of nozzles 110 are lined up in the subscanning direction to form a nozzle array 110N, and also the plurality of nozzle arrays 110N are arranged along the main scanning direction. The plurality of nozzles 110 that configure the nozzle array 110N are nozzles that eject the same kind of liquid (for example, the same color of ink), and the plurality of nozzle arrays 110N are arrays that jet different kinds of liquid (for example, ink of different colors: cyan, magenta, yellow, black, and the like). Further, corresponding to the same kind of liquid, as illustrated in FIG. 5, the plurality of nozzle arrays 110N which are arranged in a manner of being deviated by step are provided in the ink jet head 100.

The maintenance mechanism 72 arranged in the non-recording area NA on the 1-digit side includes a wiping unit 81, a flushing unit 74 having a liquid receiving portion 73, and a cleaning mechanism 91 which are arranged to be lined up from a position near the recording area PA in the main scanning direction.

The wiping unit 81 includes a wiping member 82 that can absorb liquid, a holding mechanism 83 that holds the wiping member 82, and a wiping motor 84. The wiping member 82 can realize a configuration in which liquid is absorbed in a gap between fibers of synthetic resins, by being formed with, for example, non-woven fabric made of synthetic resins or the like.

The wiping member 82 is detachably attached to the holding mechanism 83. Therefore, the wiping member 82 can be replaced into a new one after use or the like. If the wiping member 82 is attached to the holding mechanism 83, a portion thereof protrudes to the outside, and the wiping member 82 functions as a wiping portion 85 that can wipe a nozzle surface 36 in which the nozzles 110 of the ink jet head 100 are open.

The holding mechanism 83 is supported by a pair of guiding shafts 86 extending in the subscanning direction, and moves in the subscanning direction along the guiding shafts 86 by the driving force of the wiping motor 84 when the wiping motor 84 is driven, so that the wiping portion 85 wipes the nozzle surface 36.

The cleaning mechanism 91 includes at least one cap 92 for suction, a plurality of caps 93 for moisturization, a sucking pump 94, and a capping motor 95. If the capping motor 95 is driven, the caps 92 and 93 relatively move in a direction to be close to the ink jet head 100 so that a closed space the plurality of nozzles 110 that form the nozzle array 110N are closed is formed.

The cap 92 for suction forms a closed space in which a portion (for example, the nozzles 110 that eject the same kind of liquid) of the plurality of nozzles 110 is open. Also, if the sucking pump 94 is driven in a state in which the cap 92 for suction forms the closed space, the closed space becomes the negative pressure, and the suction cleaning (pump suction process) in which the ink is discharged from the nozzles 110 which are open to the closed space is performed. The suction cleaning is a kind of maintenance operations which is performed in order to solve the ejection abnormality of the nozzles 110, and is performed for each nozzle group enclosed with the cap 92 for suction.

The caps 93 for moisturization suppresses the nozzles 110 from being dried by forming closed spaces to which the nozzles 110 are open. For example, the caps 93 for moisturization are provided for each nozzle array 110N, and form closed spaces in a shape of dividing the plurality of nozzles 110 in the nozzle array unit.

When the recording is not performed, or the electric power is turned off, the ink jet head 100 is moved to a stand-by position HP in which the caps 93 for moisturization are arranged. Then, the caps 93 for moisturization relatively move in a direction to come to close to the ink jet head 100 to form the closed spaces to which the nozzles 110 are open. In this manner, enclosing a space to which the nozzles 110 are open by the cap 92 or the caps 93 is referred to as capping. Also, when the recording is not performed, the ink jet head 100 is capped by the caps 93 for moisturization in the stand-by position HP.

In addition, when the ink jet head 100 is arranged in a position corresponding to the liquid receiving portion 73 (for example, upper side of the liquid receiving portion 73 in vertical direction), the ink jet head 100 performs a flushing process of ejecting liquid drops to the liquid receiving portion 73.

According to the fifth embodiment, the clogging of the nozzles 110 is prevented or solved by performing the flushing operation in which the ink jet head 100 periodically ejects the ink drops to the liquid receiving portion 73 when performing the recording process on the recording sheet P. In the description below, the flushing which is periodically performed in the non-recording area NA between the recording operations in the recording area PA is distinguished from the flushing as a restoration operation (maintenance operation) when the ink is thickened, and is referred to as periodic flushing.

Further, the periodic flushing may be performed whenever the liquid receiving portion 73 once reciprocates in the scanning area, and arranged in the position corresponding to the liquid receiving portion 73, or whenever the liquid receiving portion 73 reciprocates a plurality of times. In addition, in one time of periodic flushing, the liquid drops may be ejected from a portion of the nozzles 110, and the liquid drops may be ejected from all the nozzles 110.

Next, the ejection abnormality detecting process in the printer 1 according to the fifth embodiment is described.

According to the fifth embodiment, the ejection abnormality detecting section 10 as an ejection abnormality detecting section (see FIG. 16) detects the ejection abnormality (non-ejection of ink drop) in the nozzles 110 based on the residue vibration waveforms of the vibration plates 121 (see FIG. 3) when the liquid drops are ejected according to the periodic flushing while performing the recording process, and determines the cause thereof if the ejection abnormality occurs.

That is, when the ink jet head 100 is moved to the non-recording area NA between the ejection operations of the liquid drops on the recording sheet P, and the ink jet head 100 is arranged in a position in which the liquid receiving portion 73 can receive the liquid drops ejected from the nozzles 110, the ejection abnormality detecting section 10 detects a state of the ejection abnormality in the nozzles 110.

The detection of ejection abnormality may be performed every time the periodic flushing is performed, or the periodic flushing without the detection of ejection abnormality may be performed. In addition, in the periodic flushing, the ejection abnormality may be detected with respect to all the nozzles 110 that eject liquid drops, or the ejection abnormality may be detected with respect to a portion of the nozzles 110 that ejects liquid drops.

The periodic flushing and the detection of the ejection abnormality may be performed while the ink jet head 100 stops in the position corresponding to the liquid receiving portion 73, and the ink jet head 100 may be performed while being moved in the first scanning direction +X or the second scanning direction −X. Further, if a time Td (for example, 1 second) required in the detection of the ejection abnormality is shorter than a time Tc (for example, 2 seconds) required in the returning of the carriage 32, the detection of the ejection abnormality can be performed without stopping the ink jet head 100 in the non-recording area NA.

When the ejection abnormality occurs in the nozzles 110 used in the recording process, it is possible that the dot omission occurs, and the recording quality is decreased. Therefore, it is desirable to solve the ejection abnormality by performing the maintenance operation such as the flushing, the wiping, or the suction cleaning. For example, if the cause of the ejection abnormality is the bubble mixture, the suction cleaning is performed, if the cause of the ejection abnormality is the drying of the nozzles 110, the flushing is performed, and if the cause of the ejection abnormality is the attachment of foreign substances such as paper dust near the outlets of the nozzles 110, the wiping is performed so that the ejection abnormality can be effectively solved.

Here, while the recording process is in process on the recording sheet P, the ejection operation of the liquid drops which is a portion of the recording process is temporarily interrupted, in order to return the carriage 32 or to perform the periodic flushing after the recording for one line is performed and until the recording for the next line is performed. Also, since the liquid drops which impact on the recording sheet P wet and spread on or are dried from the surface of the recording sheet P over time, if times in which the recording processes are interrupted vary, the developed colors of lines which are lined up and adjacent to each other in the subscanning direction are different from each other so that the recording results are not equal. Therefore, the recording quality is decreased.

According to the fifth embodiment, the threshold value of the recording interruption time that causes the recording quality to be decreased is Tng. In addition, times required for flushing, wiping and suction cleaning are respectively set to be Tf, Tw, and Tv. Further, the time Tf required for the flushing is the time required when the ink jet head 100 is stopped in the position corresponding to the liquid receiving portion 73 and the flushing is performed. In addition, the time Tv required for the suction cleaning is the time required when one time of the suction cleaning performed with the nozzles 110 enclosed with the cap 92 for suction as a target is performed.

The threshold value Tng of the recording interruption time that causes the recording quality to be decreased may vary according to components of the recording sheet P or the ejected liquid, the existence or non-existence of the drying mechanism, the environmental condition such as a temperature or humidity, but the relation of $Tf \leq Tw \leq Tng < Tv$ is generally satisfied. That is, if the recording process on one recording sheet P is interrupted, and the suction cleaning is performed, it is highly possible that a difference occurs in the recording result before or after the interruption, and the recording quality is decreased. Meanwhile, if the recording operation on one recording sheet P is interrupted and the flushing or the wiping is performed, it is highly possible that the differences in the recording results that occur before and after the interruption are small, and the recording quality is not decreased as much.

There, according to the embodiment, when the ejection abnormality detecting section 10 detects that the ejection abnormality nozzles 110 exist, if the time required for the maintenance operation in order to solve the ejection abnormality of the nozzles 110 is equal to or shorter than the threshold value Tng, the recording process is interrupted, and the maintenance operation is performed. If the time required for the maintenance operation is longer than the threshold value Tng, the maintenance operation is reserved, and the recording process is continued.

For example, the cause of the ejection abnormality of the nozzles 110 is the bubble mixture, it is preferable to perform the suction cleaning as the maintenance operation, but the time Tv required to perform the suction cleaning is longer than the threshold value Tng. Therefore, if the nozzles 110 in which the ejection abnormality caused by the bubble mixture occurs are detected, the suction cleaning is reserved, and the suction cleaning is performed after the recording process on the recording sheet P is ended. That is, if the recording process on the recording sheet P is interrupted, and the suction cleaning is performed, it is highly possible that the difference of the recording results before and after the interruption is great. Also, if the recording result in the middle of the recording on one recording sheet P is changed, and the recording quality is decreased, the recording sheet P has to be discarded. Therefore, in order to suppress unnecessary consumption of the recording sheet P caused by the interruption of the recording process, the recording process is continued without performing the suction cleaning.

Further, even if the nozzles 110 in which the ejection abnormality occurs exist, if they are the nozzles 110 that do not eject the liquid drop to the recording sheet P, or if positions of the ejection abnormality nozzles 110 are independently scattered, the recording quality is not decreased as much even if the recording process is continued without performing the maintenance operation.

However, if the maintenance operation is reserved and the recording process is continued in this manner, it is preferable to perform the complementary printing (interpolation printing) for supplementing the liquid drops to be ejected from the ejection abnormality nozzles 110 with liquid drops ejected from the nozzles 110 in which the ejection abnormality does not occur, based on the state of the ejection abnormality nozzles 110 detected by the ejection abnormality detecting section 10.

For example, if the ejection abnormality occurs in one of the plurality of nozzles 110 that eject the same kind (color) of liquid (ink), the dot omission is complemented by ejecting liquid drops greater than the liquid drops to be ejected from the ejection abnormality nozzles 110, from the normal nozzles 110 near the ejection abnormality nozzles 110. Otherwise, if the ejection abnormality occurs in the nozzles 110 that eject black ink, the dot omission of the black ink is complemented by ejecting liquid drops of yellow, cyan, and magenta in an overlapped manner, on the position to which the liquid drops to be ejected from the nozzles 110 are to be impact.

Accordingly, if the nozzles 110 in which the ejection abnormality caused by the drying occurs are detected by the detection of the ejection abnormality followed by the periodic flushing, the flushing is performed as the maintenance operation before the recording process of the next line is performed. That is, since the time Tf required to perform the flushing operation is equal to or shorter than the threshold value Tng, even if the recording process is interrupted and the maintenance is performed, the difference in the recording results before and after the interruption is not so great. Therefore, it is preferable that the recording process is resumed after the ejection abnormality is solved.

In addition, if the nozzles 110 in which the ejection abnormality caused by the attachment of foreign substance occurs are detected by the detection of the ejection abnormality followed by the periodic flushing, the wiping is performed as the maintenance operation before the recording process of the next line is performed. That is, since the time Tw required to perform the wiping operation is equal to or shorter than the threshold value Tng, even if the recording process is interrupted and the maintenance is performed, the difference in the recording results before and after the interruption is not so great. Therefore, it is preferable that the recording process is resumed after the ejection abnormality is solved.

Next, the function of the printer 1 according to the fifth embodiment is described.

When the ejection abnormality detecting section 10 detects the ejection abnormality nozzles 110, the printer 1 according to the fifth embodiment reserves the maintenance operation and continues the recording process when the time required for the maintenance operation in order to solve the ejection abnormality is longer than the threshold value Tng. Therefore, the recording sheet P is not unnecessarily consumed by the interruption of the recording process. Also, even if the recording process is continuously performed in a state in which the ejection abnormality nozzles 110 exist, it is possible to prevent the recording quality from being decreased, for example, by performing the complementary printing described above.

In addition, if the time required for the maintenance operation is equal to or shorter than the threshold value Tng, the recording process is resumed after the maintenance operation is performed. Therefore, it is possible to complete the recording process with suppressing the recording quality from being decreased.

Further, as examples of the maintenance operation in which the time required to solve the ejection abnormality is equal to or shorter than the threshold value Tng, the flushing or the wiping is included. Also, since the flushing unit 74 for performing the flushing and the wiping unit 81 for performing the wiping are in the non-recording area NA in which the periodic flushing is performed, after the ejection abnormality is detected, before the recording of the next line is performed, the maintenance operation can be performed quickly.

For example, at the time of the inward movement in the second scanning direction −X in the non-recording area NA, the detection of the ejection abnormality followed by the periodic flushing is performed. If the ejection abnormality nozzles 110 are detected by the detection, the flushing can be performed in the middle of the outward movement in the first scanning direction +X after the direction is changed in the end portion on the 1-digit side.

In addition, since the wiping unit 81 is between the recording area PA and the liquid receiving portion 73 in the main scanning direction, the detection of the ejection abnormality followed by the periodic flushing at the time of the inward movement in the second scanning direction −X in the non-recording area NA is performed, and the wiping by the wiping portion 85 can be performed in the middle of the outward movement in the first scanning direction +X after the direction is changed in the end portion on the 1-digit side.

Further, if the plurality of ejection abnormality nozzles 110 are detected by one detection operation, and the ejection abnormality nozzles 110 having different causes are included, after performing the maintenance operation of which the performance time is equal to or shorter than the threshold value Tng, the detection operation may be performed again.

For example, if the ejection abnormality nozzles 110 caused by the attachment of foreign substances and the ejection abnormality nozzles 110 caused by the drying are detected at the time of the inward movement in the second scanning direction −X, after the flushing is performed in the position corresponding to the liquid receiving portion 73 as it is, the re-detecting is performed on the nozzles 110 in which the ejection abnormality is detected. Also, if the ejection abnormality nozzles 110 caused by the attachment of the foreign substances are detected by the re-detection, the wiping is performed at the time of the outward movement in the first scanning direction +X after the direction is changed in the end portion on the 1-digit side. In this manner, if the time does not exceed the threshold value Tng, the plurality of maintenance operations can be continuously performed.

For example, it is assumed that times required for the flushing, the wiping, and the suction cleaning are respectively 3 seconds, 5 seconds, and 60 seconds, the threshold value Tng of the recording interruption time is 20 seconds, and the time Td required for the detection is 1 second. In this case, in the scope of not exceeding 20 seconds, which is the threshold value Tng, it is possible to perform the first detection (1 second), the flushing (3 seconds), the second detection (1 second), and the wiping (5 seconds). Moreover, if the third detection is performed after the wiping and the ejection abnormality nozzles 110 are detected by the third detection, it is possible to reserve the maintenance operation for solving the ejection abnormality and continue the recording process, or it is possible to repeat the maintenance operation in the scope of not exceeding the threshold value Tng.

Otherwise, if the ejection abnormality nozzles 110 caused by the bubble mixture and the ejection abnormality nozzles 110 by the drying are detected by the first detection operation, it is possible to reserve the maintenance operation, continue the recording process, and perform the maintenance operation after the end of the recording process.

Further, if the ejection abnormality is detected in the periodic flushing, it is preferable to employ the waveform for the test followed by the ejection of the liquid drops, and not to have the waveform for vibration control thereafter. This is because it is possible to detect the residue vibrations of the pressure chamber 141 (the vibration plates 121) more effectively according to the configuration.

The detection of the ejection abnormality described above can be performed based on the residue vibrations of the pressure chamber 141 when the liquid drops are ejected to the recording sheet P. In this case, the unnecessary consumption of the liquid for the detection is suppressed, but it is possible that the ejection abnormality in the nozzles 110 that are not used in the recording is not detected, or the residue vibrations which are not sufficient for the detection are not detected. Therefore, if the ejection abnormality is detected followed with the periodic flushing based on the residue vibrations of the pressure chamber 141 when the liquid drops are ejected, it is preferable since the liquid is not unnecessarily consumed only for detection, and also the precision of the detection can be enhanced by using drive waveforms appropriate for the detection.

Sixth Embodiment

Next, the printer 1 which is an example of the liquid ejecting apparatus according to a sixth embodiment will be described with reference to FIGS. 55 to 57. Hereinafter, the description will be made with reference to FIGS. 55 and 57. The same components which are given the same reference numbers as the above embodiments have the same configurations as in the above embodiments, and repetitive description thereof will be omitted. Hereinafter, differences from the above embodiments are mainly described.

Figure 55:
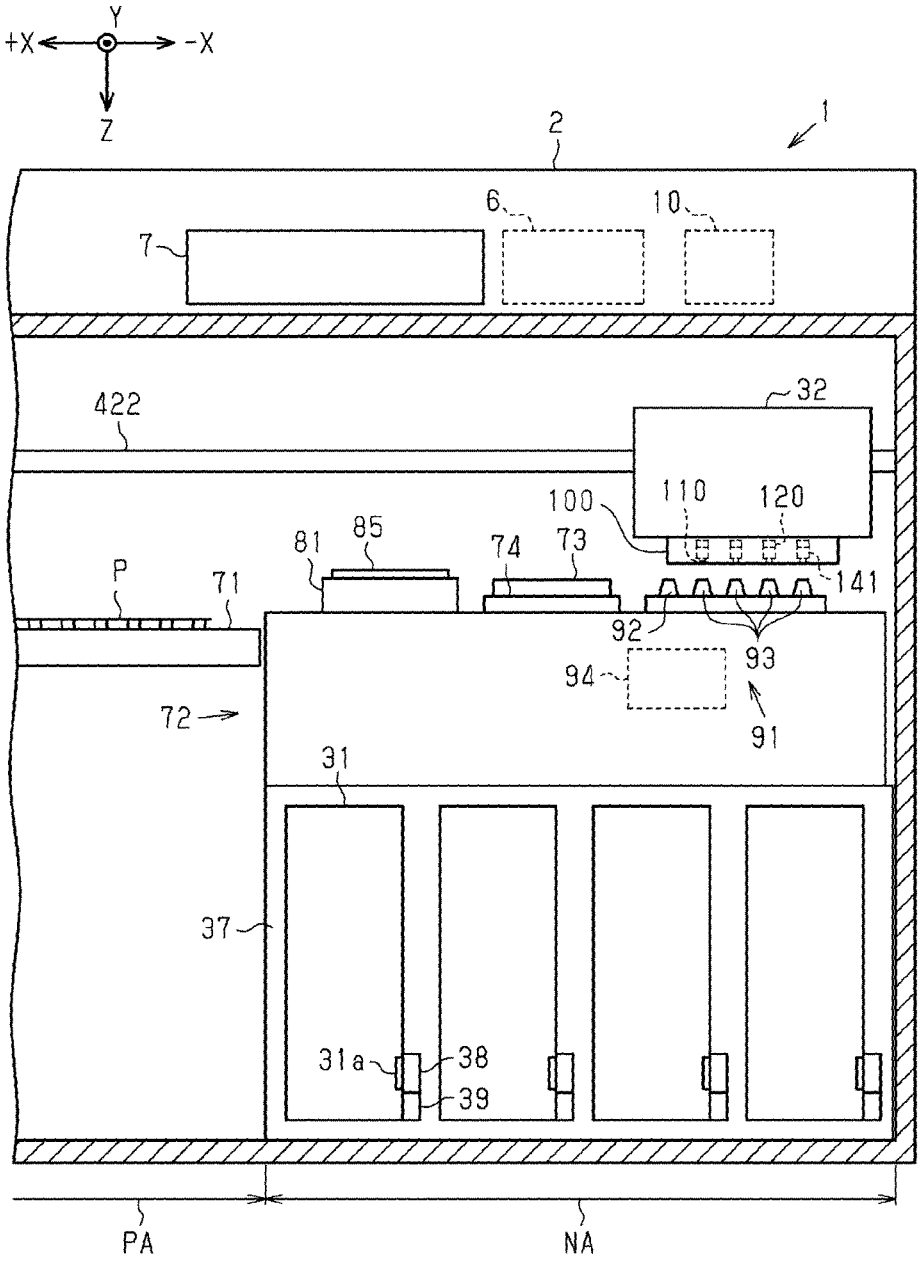
FIG. 55 is a diagram schematically illustrating a printer as a liquid ejecting apparatus according to a sixth embodiment.

As illustrated in FIG. 55, the operation panel 7 is provided on the outer surface side of the apparatus main body 2 of the printer 1. In addition, inside the apparatus main body 2, the carriage guide shafts 422 are provided in a hanging manner, and the carriage 32 holding the ink jet head 100, which is an example of the liquid ejecting unit, reciprocates along the carriage guide shafts 422. The ink jet head 100 includes the plurality of nozzles 110.

The movement region of the ink jet head 100 includes the recording area PA in which the supporting stand 71 supporting the recording sheet P is disposed and the non-recording area NA which is on the outside of the recording area PA. In the non-recording area NA, the maintenance mechanism 72 is disposed. The maintenance mechanism 72 is provided with the wiping unit 81 which includes the wiping portion 85, the flushing unit 74 which includes the liquid receiving portion 73, and the cleaning mechanism 91 which includes the caps 92 and 93.

The ink jet head 100 reciprocates between the recording area PA and the non-recording area NA and performs the recording process by ejecting liquid drops from the nozzle 110 onto the recording sheet P when entering the recording area PA. The liquid receiving portion 73 can receive liquid drops ejected from the ink jet head 100 in the non-recording area NA that is on the outside of the recording area PA in which the recording sheet P is arranged.

The apparatus main body 2 includes a mounting portion 37 into which one or a plurality of ink cartridges 31 are detachably mounted. The ink cartridge 31 is provided with a memory chip 31*a* which includes a memory portion for storing the residual amount of received ink and a terminal portion. The mounting portion 37 is provided with a terminal portion 38 which is electrically connected to the terminal portion of the memory chip 31*a* when the ink cartridge 31 is mounted into the mounting portion 37.

The terminal portion 38 is electrically connected to the control portion 6. When the terminal portion of the memory chip 31*a* is electrically connected to the terminal portion 38, the control portion 6 obtains information stored in the memory chip 31*a* through the terminal portion 38. The information stored in the memory chip 31*a* includes a residual amount Ra0 (refer to FIG. 57) of liquid (ink) received in the ink cartridge 31. In a case where the residual amount Ra0 of liquid received in the ink cartridge 31 is less than a predetermined threshold value (for example, a near-end value Ne illustrated in FIG. 57), the control portion 6 notifies a user to prepare the next ink cartridge 31 to be used through the operation panel 7.

The control portion 6 is electrically connected to an ejection abnormality detecting unit (ejection abnormality detecting section 10) that detects ejection abnormality in the nozzle 110. In addition, the ink jet head 100 includes a plurality of the actuators 120 (for example, electrostatic actuator) which respectively correspond to the nozzles 110, and the ejection abnormality detecting section 10 is electrically connected to the plurality of actuators 120.

The ink jet head 100 includes the pressure chamber (cavity) 141 that communicates with the nozzle 110 and drives the actuator 120 to vibrate the pressure chamber 141 so that a liquid drop is ejected from the nozzle 110. In addition, the ejection abnormality detecting section 10 detects the ejection abnormality in the nozzle 110 on the basis of vibration waveforms of the pressure chamber 141 that vibrates due to driving of the actuator 120.

Figure 56:
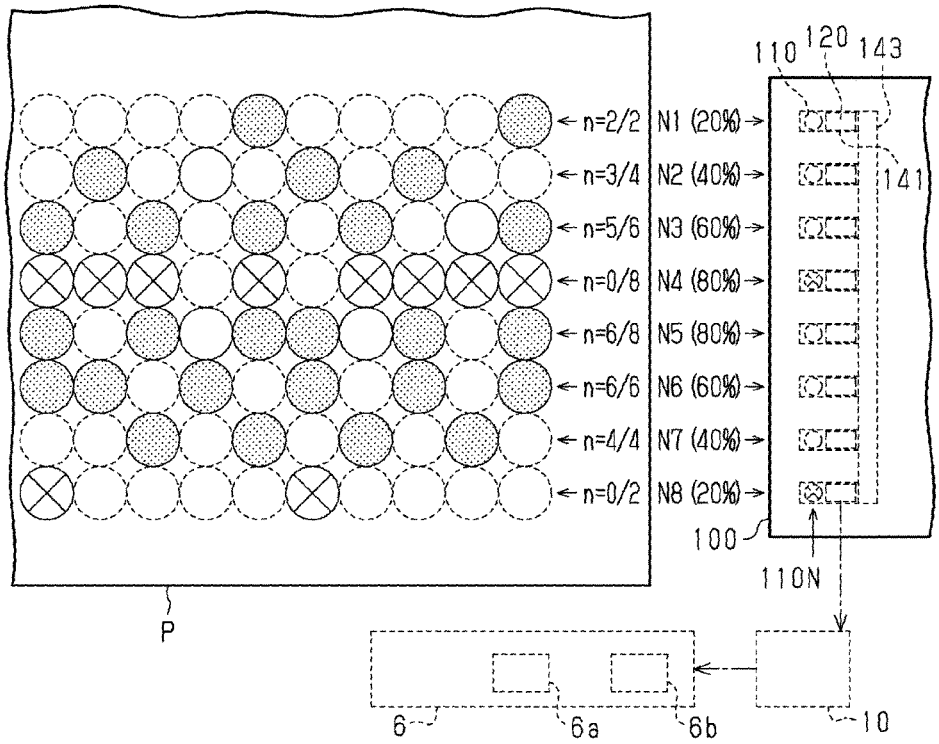
FIG. 56 is a view schematically illustrating a calculation method of a liquid usage amount in the printer in FIG. 55.
Figure 57:
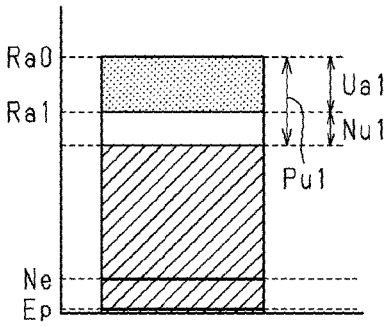
FIG. 57 is a graph illustrating a residual amount, a scheduled usage amount, a liquid usage amount, and an amount of unused liquid according to the sixth embodiment.

As illustrated in FIG. 56, the control portion 6 includes a counting unit 6*a* and a calculation unit 6*b*. The counting unit 6*a* counts the number of liquid ejections to be performed using the nozzles 110 in a recording process of a predetermined unit (such as one recording sheet P or one printing job) as the number of scheduled ejections on the basis of input ejection data (typing data). The calculation unit 6*b* calculates a usage amount of liquid in the recording process as a liquid usage amount Ua1 (refer to FIG. 57) on the basis of the number of scheduled ejections which is counted by the counting unit 6*a* and a state of the ejection abnormality which is detected by the ejection abnormality detecting section 10.

In addition, the calculation unit 6*b* calculates a residual amount Ra1 after the recording process by subtracting the liquid usage amount Ua1 from the current residual amount Ra0 in the ink cartridge 31 (refer to FIG. 55). In a case where the residual amount Ra1 is less than a predetermined threshold value, the control portion 6 performs a notification as described above.

In calculation of residual amount in the ink cartridge 31, it is preferable that, even after operations other than the recording process such as flushing or suction cleaning, the calculation unit 6*b* subtract the amount of liquid used in the operations from the current residual amount Ra0. Since the amount of liquid used in maintenance operations not accompanying the driving of the actuator 120 such as the suction cleaning does not depend on the presence or absence of a faulty nozzle, it is preferable that a predetermined usage amount is subtracted without using the result of the ejection abnormality detection performed by the ejection abnormality detecting section 10.

In a case where a notification to a user is performed on the basis of a residual amount obtained by a software counter, such as the liquid usage amount Ua1 calculated by the calculation unit 6*b*, it is preferable that the threshold value be set to the near-end value Ne (refer to FIG. 57) at which a little more recording process can be performed. Regarding an out-of-ink value Ep (refer to FIG. 57) at which no more recording process can be performed, it is preferable to physically detect the ink cartridge 31 using a sensor 39 (refer to FIG. 55) provided in the mounting portion 37. In addition, it is preferable that the control portion 6 do not perform the recording process in a case where it is detected that a physical residual amount in the ink cartridge 31 is less than the out-of-ink value Ep.

As a method of physically detecting a residual amount of ink, a method of optically detecting a liquid surface of ink received in the ink cartridge 31 or a method of detecting the pressure of an ink pack received in the ink cartridge 31 can be exemplified. Other methods can also be used as a method of physically detecting a residual amount of ink.

Next, a liquid usage amount calculation method for the liquid ejecting apparatus (printer 1) that performs the recording process by ejecting liquid drops from the plurality of nozzles 110 to the recording sheet P will be described.

Calculation of the liquid usage amount includes a detecting step in which the ejection abnormality detecting section 10 detects ejection abnormality, a counting step in which the counting unit 6*a* counts the number of scheduled ejections, and a calculating step in which the calculation unit 6*b* calculates the liquid usage amount.

In the calculating step, it is preferable that the liquid usage amount Ua1 be calculated by subtracting an amount of unused liquid Nu1 (refer to FIG. 57), which is an amount of ink unused in the recording process due to ejection abnormality, from a scheduled usage amount Pu1 (refer to FIG. 57), which is calculated by the calculation unit 6*b* multiplying the number of scheduled ejections in the recording process by a liquid amount per liquid drop (Ua1=Pu1−Nu1). In a case where a liquid amount per liquid drop by which the number of scheduled ejections is multiplied is different for each nozzle 110 or each ejection operation, the number of scheduled ejections may be multiplied by different liquid amounts or may be multiplied by one liquid amount as a representative value.

Here, as a calculation method of the amount of unused liquid Nu1 which is an amount of ink unused in the recording process due to ejection abnormality, a first method, a second method, and a third method will be described below.

In the first method, the ejection abnormality detecting section 10 detects an ejection operation in the recording process, in which ejection abnormality occurs, as a faulty ejection. It is preferable that the detection be performed in real time for ejection operations in which the ink jet head 100 ejects a liquid drop to the recording sheep P in the recording area PA, that is, for all recording processes actually performed.

Then, the calculation unit 6*b* calculates the amount of unused liquid Nu1 by multiplying the total number of faulty ejections in the recording process by a liquid amount per liquid drop. As a result of this, the calculation unit 6*b* calculates the liquid usage amount Ua1 by subtracting the amount of unused liquid Nu1, which is the total amount of liquid not ejected in the recording process, from the scheduled usage amount Pu1, which is calculated on the basis of the typing data, in the recording process of a predetermined unit. Therefore, it is possible to accurately calculate the liquid usage amount Ua1 for each recording process considering the timing of the ejection abnormality in the actual recording process and the amount of liquid supposed to be ejected from the faulty nozzle in which the ejection abnormality occurs in detail.

In the second method, the ejection abnormality detecting section 10 performs detection before the recording process is performed, and detects the nozzle 110 in which the abnormal detection occurs as the faulty nozzle. In this case, it is preferable that the actuator 120 be driven and the ejection abnormality detecting section 10 detect the ejection abnormality when the ink jet head 100 is moved to the non-recording area NA and the ink jet head 100 is arranged in a position in which the liquid receiving portion 73 can receive the liquid drops ejected from the nozzle 110.

Then, the calculation unit 6*b* calculates the amount of unused liquid Nu1 by multiplying the scheduled usage amount by a proportion of the number of faulty nozzles to the total number of nozzles 110, and calculates the liquid usage amount Ua1 by subtracting the amount of unused liquid Nu1 from the scheduled usage amount Pu1.

That is, in the second method, for any recording process, the amount of unused liquid Nu1 is estimated assuming that the same amount of liquid drop is ejected from all of the nozzles 110, and no liquid drop is ejected from the faulty nozzles in the nozzles 110. Therefore, if detection of the faulty nozzle is performed for each recording process, it is possible to quickly calculate the amount of unused liquid Nu1 without calculating the amount of liquid drop supposed to be ejected from the faulty nozzle in the actual recording process.

In the third method, as with the second method, the ejection abnormality detecting section 10 performs detection before the recording process is performed, and detects the nozzle 110 in which the abnormal detection occurs as the faulty nozzle. Even in this case, it is preferable that the actuator 120 be driven and the ejection abnormality detecting section 10 detect the ejection abnormality when the ink jet head 100 is moved to the non-recording area NA and the ink jet head 100 is arranged in a position in which the liquid receiving portion 73 can receive the liquid drops ejected from the nozzle 110.

Then, the calculation unit 6*b* calculates the amount of unused liquid Nu1 by multiplying the number of scheduled ejections in the recording process of faulty nozzles by a liquid amount per liquid drop, and calculates the liquid usage amount Ua1 by subtracting the amount of unused liquid Nu1 from the scheduled usage amount Pu1.

In the second method or the third method, the detection of the faulty nozzle for calculating the amount of unused liquid Nu1 may be performed after the recording process is performed. In addition, in a case where the recording quality is lowered with the proportion of the faulty nozzles which are detected before the recording process is performed being large (for example, 50% or higher) or with the positions of the faulty nozzles being concentrated to one place, a maintenance operation such as suction cleaning may be performed during a period after the detection and before the recording process. Furthermore, in a case where a maintenance operation such as suction cleaning is performed, it is preferable that the detection of the faulty nozzle be performed once again and the liquid usage amount Ua1 be calculated on the basis of the result of the detection.

In addition, in the second method or the third method, the detection of the faulty nozzle for calculating the amount of unused liquid Nu1 may be performed in the middle of the recording process. For example, the ink jet head 100 moves to the non-recording area NA between ejection operations of liquid drops on the recording sheet P, and when the ink jet head 100 is arranged in a position in which the liquid receiving portion 73 can receive the liquid drops ejected from the nozzle 110, the ejection abnormality detecting section 10 detects the ejection abnormality. The detection of the faulty nozzle in the middle of the recording process may be performed a plurality of times in the middle of recording process. For example, the detection of the faulty nozzle in the middle of the recording process may be performed for every one passage (reciprocation of ink jet head 100) or for every plurality of passages, may be performed for every one recording sheet P in one job, and may be performed for every one job.

In a case where the detection of the faulty nozzle is performed in the middle of the recording process, the amount of unused liquid Nu1 may be corrected according to the time at which the faulty nozzle is detected. For example, in a case where the nozzle 110, which was normal at the time of the first detection, becomes the faulty nozzle in the middle of the recording process, a liquid amount per liquid drop, which is used as a multiplier in the calculating step, may be decreased. In a case where different amounts of liquid drop are assigned to the nozzles 110, the minimum amount of liquid drop may be used as a multiplier for the faulty nozzle detected in the middle of the recording process.

In addition, in a case of performing the complementary printing (interpolation printing) for supplementing the liquid drops supposed to be ejected from the faulty nozzle with liquid drops ejected from the nozzles 110 in the vicinity of the faulty nozzle while detecting the faulty nozzle before or in the middle of the recording process, it is preferable that the amount of liquid drop supposed to be ejected from the faulty nozzle be not included in the amount of unused liquid Nu1. In addition, in a case where the proportion of faulty nozzles detected in the middle of the recording process exceeds a predetermined value (for example, 50%), a user may be notified that the proportion exceeds the predetermined value or the recording process may be stopped according to an instruction from the user. In addition, in a case where the recording process is stopped, it is preferable that the liquid usage amount Ua1 before the stopping be calculated and the residual amount Ra1 after the recording process be calculated by subtracting the calculated liquid usage amount Ua1 from the current residual amount Ra0.

Meanwhile, when the amount of unused liquid Nu1 is calculated while detecting the faulty nozzle after the recording process is performed, even when the ejection abnormality occurs near the end of the recording process, it is assumed that the ejection abnormality occurs at the start of the recording process and thus the amount of unused liquid Nu1 is estimated to be larger than the actual one. Accordingly, the calculated value of the liquid usage amount Ua1 obtained by subtracting the amount of unused liquid Nu1 from the scheduled usage amount Pu1 becomes lower than the actual value, and thus the residual amount Ra1 after the recording process becomes larger than the actual one. In this case, the recording process may be continuously performed as if there is remaining ink even though there is no remaining ink. Therefore, particularly in a case where it is determined whether the residual amount is less than the out-of-ink value Ep on the basis of the residual amount obtained using a software counter or the like, it is preferable that the amount of unused liquid Nu1 be calculated while detecting the faulty nozzle before the recording process is performed.

Note that, whether to perform a maintenance operation such as suction cleaning on the basis of the result of the detection, which is performed by the ejection abnormality detecting section 10 before the recording process is performed, to perform the complementary printing, or to continue the recording process without change may be determined depending on the type of the recording sheet P or may be determined according to an instruction from the user.

Meanwhile, as illustrated in FIG. 56, the plurality of nozzles 110 constituting the nozzle arrays 110N in the ink jet head 100 respectively communicate with the pressure chambers 141 to which ink is supplied from the elongated reservoir 143. Therefore, the closer the pressure chamber 141 is to an end in a longitudinal direction of the reservoir 143, the more unlikely ink is to be supplied to the pressure chamber 141, and when liquid drops are continuously ejected from the nozzle 110 that communicates with the pressure chamber 141, there may be a supply shortage of liquid.

In order to compensate such a supply shortage of liquid, the usage percentage of the nozzle 110 that is close to an end of the nozzle array 110N may be set to be low. For example, in FIG. 56, the usage percentages of the nozzles 110 (N1 and N8) which are most close to the ends of the nozzle array 110N are set to 20%, the usage percentages of the nozzles 110 (N2 and N7) which are positioned on the further inner side are set to 40%, the usage percentages of the nozzles 110 (N3 and N6) which are positioned on the still further inner side are set to 60%, and the usage percentages of the nozzles 110 (N4 and N5) on the center are set to 80%.

In this case, when it is assumed that the original number of liquid drops that each nozzle 110 can eject to the recording sheet P with one passage is ten, the maximum numbers of liquid drops that the nozzles 110, of which the usage percentages are set as above, eject are 2 (N1 and N8), 4 (N2 and N7), 6 (N3 and N6), and 8 (N4 and N5), respectively. Note that, in FIG. 56, liquid drops which are not ejected due to the usage percentage limitation are shown by dotted circles on the recording sheet P.

In addition, the following description will be made assuming that the numbers of liquid drops (shown by full circles on recording sheet P in FIG. 56) that the nozzles 110, of which the usage percentages are set as above, should to eject with one passage on the basis of the typing data are respectively N1=2, N2=3, N3=5, N4=8, N5=6, N6–6, N7=4, and N8=2. In this case, if N4 and N8 of the nozzles 110 are faulty nozzles, liquid drops, which are scheduled to be ejected (N4=8 and N8=2), are not ejected from these nozzles 110 in the recording process.

In the case of FIG. 56, the number of scheduled liquid ejections to be performed by the ink jet head 100 with one passage is 2 (N1)+3 (N2)+5 (N3)+8 (N4)+6 (N5)+6 (N6)+4 (N7)+2 (N8)=36. Therefore, when the scheduled usage amount Pu1 is calculated assuming that a liquid amount per liquid drop is 1, scheduled usage amount Pu1=36(number of scheduled ejections)×1(liquid amount per liquid drop)=36.

In this case, the total number of faulty nozzles is 8(number of scheduled ejections of faulty nozzle N4)+2(number of scheduled ejections of faulty nozzle N8)=10. Therefore, when the amount of unused liquid Nu1 is calculated using the first method, the amount of unused liquid Nu1 is 10(total number of faulty ejections)×1(liquid amount per liquid drop)=10. Accordingly, the liquid usage amount Ua1 calculated using the first method is 36(scheduled usage amount Pu1)−10(amount of unused liquid Nu1)=26.

In addition, when the amount of unused liquid Nu1 is calculated using the second method assuming that there is the detection of the faulty nozzle before the recording process is performed, the amount of unused liquid Nu1 is 2(number of faulty nozzles)/8(total number of nozzles 110)×36(scheduled usage amount Pu1)=9. Accordingly, the liquid usage amount Ua1 calculated using the second method is 36(scheduled usage amount Pu1)−9(amount of unused liquid Nu1)=27.

Furthermore, when the amount of unused liquid Nu1 is calculated using the third method assuming that there is the detection of the faulty nozzle before the recording process is performed, since the number of scheduled ejections in the recording process of the faulty nozzles is 8(number of scheduled ejections of faulty nozzle N4)+2(number of scheduled ejections of faulty nozzle N8)=10, the amount of unused liquid Nu1 is 10(number of scheduled ejections of faulty nozzles)×1(liquid amount per liquid drop)=10. Accordingly, the liquid usage amount Ua1 calculated using the third method is 36(scheduled usage amount Pu1)−10 (amount of unused liquid Nu1)=26.

In addition, as a fourth method, a calculation method may be used in which the ejection abnormality detecting section 10 detects the faulty nozzle before, after, or in the middle of the recording process and the liquid usage amount Ua1 is calculated by multiplying the scheduled usage amount Pu1 by a proportion of the sum of usage ratios of the normal nozzles 110 to the sum of usage ratios of all of the nozzles 110 as a correction value. In this case, the sum of usage ratios of the normal nozzles 110 is 0.2(N1)+0.4(N2)+0.6(N3)+0.8(N5)+0.6(N6)+0.4(N7)=3. In addition, the sum of usage ratios of all of the nozzles 110 is 0.2(N1)+0.4(N2)+0.6(N3)+0.8(N4)+0.8(N5)+0.6(N6)+0.4(N7)+0.2(N8)=4. Accordingly, the correction value is ¾(0.75), and thus the liquid usage amount Ua1 is 36(scheduled usage amount Pu1)×0.75(correction value)=27.

Note that, the first method has the same meaning as a method in which the liquid usage amount Ua1 is calculated by multiplying the scheduled usage amount Pu1 by number of scheduled ejections of normal nozzles 110/number of all of scheduled ejections, as a correction value. In addition, the second method has the same meaning as a method in which the liquid usage amount Ua1 is calculated by multiplying the scheduled usage amount Pu1 by number of normal nozzles 110/number of all of nozzles 110, as a correction value.

Next, the function of the printer 1 according to the sixth embodiment is described.

When the residual amount Ra1 of liquid (ink) which is calculated by the control portion 6 using a software counter is less than a predetermined threshold value (for example, the near-end value Ne), the printer 1 according to the sixth embodiment notifies the user that the residual amount Ra1 is less than the predetermined threshold value. Then, in calculation of the liquid usage amount Ua1 in the recording process, the calculation unit 6*b* calculates the amount of unused liquid Nu1 on the basis of a state of ejection abnormality detected by the ejection abnormality detecting section 10, and the liquid usage amount Ua1 is obtained by subtracting the amount of unused liquid Nu1 from the scheduled usage amount Pu1.

Here, in a case where the residual amount Ra1 after the recording process is calculated by subtracting the scheduled usage amount Pu1 from the current residual amount Ra0, if there is a liquid drop that is not ejected from the nozzle 110 due to the ejection abnormality, the residual amount Ra1 is underestimated by the amount of unused liquid. Therefore, if the ink cartridge 31 is replaced when the residual amount in the ink cartridge 31 is less than the near-end value Ne, liquid may be wastefully used as much as the residual amount Ra1 is underestimated.

In this point, in the sixth embodiment, since the liquid usage amount Ua1 is calculated by subtracting the amount of unused liquid Nu1 not ejected due to the ejection abnormality from the scheduled usage amount Pu1 and the liquid usage amount Ua1 is subtracted from the current residual amount Ra0, even if the ejection abnormality occurs in the nozzle 110, the residual amount Ra1 after the recording process is accurately calculated.

According to the sixth embodiment described above, the effect as follows can be obtained.

(1) Since the usage amount of liquid is calculated on the basis of the number of liquid ejections to be performed in the recording process and a state of the ejection abnormality in the nozzle 110, it is possible to accurately calculate a usage amount of liquid while taking the amount of liquid not ejected due to the ejection abnormality into account.

(2) According to the first method, since the liquid usage amount Ua1 is calculated by subtracting the amount of unused liquid Nu1, which is calculated by multiplying the total number of faulty ejections by a liquid amount per liquid drop, from the scheduled usage amount Pu1, which is calculated by multiplying the number of scheduled ejections by a liquid amount per liquid drop, it is possible to accurately calculate a usage amount of liquid taking the number of ejection operations in each of which the ejection abnormality occurs into account.

(3) According to the second method, since the liquid usage amount Ua1 is calculated by subtracting the amount of unused liquid Nu1, which is calculated on the basis of a proportion of the number of faulty nozzles in each of which ejection abnormality occurs to the total number of the nozzles 110, from the scheduled usage amount Pu1, which is calculated by multiplying the number of scheduled ejections by a liquid amount per liquid drop, it is possible to calculate a usage amount of liquid in a simple manner taking the number of faulty nozzles in each of which ejection abnormality occurs into account.

(4) According to the third method, since the liquid usage amount Ua1 is calculated by subtracting the amount of unused liquid Nu1, which is calculated on the basis of the number of scheduled ejections of faulty nozzles, from the scheduled usage amount Pu1, which is calculated by multiplying the number of scheduled ejections by a liquid amount per liquid drop, it is possible to accurately calculate a usage amount of liquid taking the number of faulty nozzles and the number of scheduled ejections of the faulty nozzles into account.

(5) Since the ejection abnormality detecting section 10 detects the ejection abnormality when the liquid ejecting unit is arranged in a position in which the liquid receiving portion 73 can receive the liquid drops ejected from the nozzles 110, even when a liquid drop is ejected from the nozzle 110 accompanying a detection operation, it is possible to prevent the liquid drop from adhering to the recording sheet P.

(6) Since the ejection abnormality detecting section 10 detects the ejection abnormality on the basis of vibration waveforms of the pressure chamber 141 that vibrates due to driving of the actuator 120, it is possible to detect the ejection abnormality while driving the actuator 120 to cause a liquid drop to be ejected from the nozzle 110 and it is also possible to detect the ejection abnormality while vibrating the pressure chamber 141 with no liquid drop ejected from the nozzles 110.

(7) According to the above-described liquid amount calculation method, since the usage amount of liquid is calculated on the basis of the number of liquid ejections to be performed in the recording process and a state of the ejection abnormality in the nozzle 110, it is possible to accurately calculate a usage amount of liquid taking the amount of liquid not ejected due to the ejection abnormality into account.

Further, the embodiments described above may be changed as follows.

In a case where the detection of the faulty nozzle is performed after the recording process is performed in the second method or the third method, the calculation unit 6*b* may update the residual amount in the ink cartridge 31 as follows. First, the calculation unit 6*b* calculates the scheduled usage amount Pu1 by multiplying the number of liquid ejections to be performed using the nozzles 110 in a recording process of a predetermined unit by a liquid amount per liquid drop, before the recording process is performed. Then, a value (Ra0−Pu1) obtained by subtracting the calculated scheduled usage amount Pu1 from the current residual amount Ra0 in the ink cartridge 31 is used as the current residual amount. Thereafter, the residual amount Ra1 after the recording process is calculated by adding the amount of unused liquid Nu1, which is calculated by the calculation unit 6*b* on the basis of the result of the detection of the faulty nozzle that is performed after the recording process is performed, to the value (Ra0−Pu1).

As with the above, in a case where the detection of the faulty nozzle is performed in the middle of the recording process in the second method or the third method, the calculation unit 6*b* may calculate the value (Ra0−Pu1) as the current residual amount before the recording process is performed. Thereafter, at a time when the detection of the faulty nozzle is performed, the residual amount after the recording process may be calculated by adding the amount of unused liquid Nu1, which is calculated by the calculation unit 6*b* on the basis of the result of the detection of the faulty nozzle, to the value (Ra0−Pu1). Separately from the actuator 120 that vibrates the pressure chamber 141 to eject a liquid drop, an actuator (for example, piezoelectric element) that detects vibration of the pressure chamber 141 to detect the ejection abnormality may be provided.

Even if a cause of the ejection abnormality of the nozzles 110 is bubble mixture, the maintenance method may be changed according to positions or the number of detected ejection abnormality nozzles 110. For example, if the plurality of ejection abnormality nozzles 110 of which the cause is the bubble mixture exist in positions near each other, it is highly possible that the ejection abnormality may not be solved without performing the suction cleaning since relatively large bubbles are mixed. On the contrary, even if the bubble mixture is the cause, if the number of ejection abnormality nozzles 110 is small or bubbles are dispersed in positions separated from each other, relatively small bubbles exist near the nozzles 110 in many cases so that the bubbles can be discharged by flushing. Accordingly, if a certain number or more of ejection abnormality nozzles 110 caused by the bubble mixture exist, the maintenance operation is reserved, and the suction cleaning is performed after the recording process on the recording sheet P is ended. Meanwhile, if the ejection abnormality nozzles 110 are dispersed, it is possible to interrupt the recording process, and perform the flushing.

If the detection of the ejection abnormality followed by periodic flushing is performed at the time of inward movement in the second scanning direction −X, and the nozzles 110 suspected to have the ejection abnormality or nozzles 110 which cannot be determined as the normal nozzles 110 exist by the detection, it is possible to perform the re-detection on these nozzles 110 at the time of the outward movement in the first scanning direction +X after the direction is changed in the end portion on the 1-digit side. In this case, it is preferable to use drive waveforms for the periodic flushing in the first detection, and to use waveforms for the test in the second detection. According to the configuration, it is possible to securely detect the ejection abnormality nozzles by the waveforms for the test in the re-detection, while appropriately performing the periodic flushing.

When the detection of the ejection abnormality followed by the periodic flushing is performed at the time of the inward movement in the second scanning direction −X, and the flushing or the wiping is performed at the time of the outward movement in the first scanning direction +X after the direction is changed in the end portion on the 1-digit side, it is possible to perform the re-detection of the ejection abnormality in order to check whether the ejection abnormality of the nozzles 110 is solved or not at the time of the next inward movement in the second scanning direction −X in the non-recording area NA on the 1-digit side. Accordingly, it is possible to check if the detected abnormal nozzles 110 are restored to the normal state or not. In addition, if the ejection abnormality nozzles 110 are detected again in the re-detection, the flushing or the wiping may be performed at the time of the next outward movement in the first scanning direction +X. Accordingly, it is possible to securely suppress the occurrence of the ejection abnormality in the printing operation thereafter.

When the pressure chamber 141 is vibrated followed by the ejection operation of the liquid drops to the recording sheet P, it is possible to detect the ejection abnormality nozzles 110 by detecting the residue vibration. In this case, since it is possible to detect the ejection abnormality in the recording area PA, it is possible to promptly perform the flushing or the wiping as the maintenance operation at the time of the movement from the recording area PA to the non-recording area NA.

Otherwise, if the ejection abnormality is detected followed by the ejection operation of the liquid drops onto the recording sheet P, and the nozzles 110 suspected to perform the abnormal ejection or nozzles 110 which cannot be determined as the normal nozzles 110 exist, it is possible to perform the re-detection of the ejection abnormality on these nozzles 110 in positions corresponding to the liquid receiving portion 73. According to the configuration, the liquid ejection operation is performed only on the nozzles 110 suspected to have the abnormality, and the detection by the ejection abnormality detecting section 10 is performed. Therefore, ink drops do not have to be ejected from the nozzles 110 which were normal in the recording operation. Accordingly, the unnecessary ejection of the ink is avoided, and thus it is possible to reduce the consumption amount of the ink. Moreover, the load of the ejection abnormality detecting section 10 or the control portion 6 can be reduced.

It is possible to generate the waveforms for the test (for example, the waveform (A) or the waveform (B) illustrated in FIGS. 51A and 51B) that do not eject the liquid drops on the nozzles 110 that do not eject the liquid drops in the recording process or the periodic flushing, and perform the detection of the ejection abnormality. Further, even if the detection that is not followed by the ejection of the liquid drops is performed in this manner, it is preferable to perform the detection when the ink jet head 100 is arranged in a position corresponding to the liquid receiving portion 73. According to the configuration, even if the liquid drops are erroneously ejected when the pressure chamber 141 is vibrated, the ejected liquid drops can be received by the liquid receiving portion 73. Therefore, the recording sheet P or the inside of the apparatus is not contaminated.

It is possible to include a pressurizing mechanism for pressurizing and supplying liquid drops from the receiving portion that receives the liquid drops ejected by the ink jet head 100, such as the ink cartridge that receives the ink to the ink jet head 100. In this case, it is possible to perform the pressurization cleaning for discharging liquid drops from the nozzles 110 by driving the pressurizing mechanism as the maintenance operation. The pressurization cleaning is preferable since, if it is performed when the ink jet head 100 is arranged in the position corresponding to the liquid receiving portion 73 or the like, the recording sheet P or the inside of the apparatus is not contaminated by the liquid drop discharged from the nozzles 110. Also, according to the pressurization cleaning, all the nozzles 110 can be concurrently cleaned, and the cleaning mechanism 91 does not have to be provided for the cleaning. Otherwise, it is possible to perform stronger cleaning by driving the pressurizing mechanism together at the time of performing the suction cleaning.

Further, since the time required for performing the pressurization cleaning is longer than the threshold value Tng, it is preferable to reserve the performance thereof in the middle of the recording process, and to perform the pressurization cleaning after the recording process is ended. However, the time for performing the pressurization cleaning or the suction cleaning is equal to or shorter than the threshold value Tng, it is possible to perform the cleaning operation by interrupting the recording process.

The cleaning mechanism 91 may have a cap for suction that encloses all the nozzles 110 at the same time. According to the configuration, it is possible to clean all the nozzles 110 by performing the suction cleaning once. Therefore, even if the ejection abnormality nozzles 110 exist throughout the plurality of nozzle arrays 110N, it is possible to reduce the time required for the maintenance operation.

In addition, if the cleaning mechanism 91 includes a cap for suction that encloses all the nozzles 110 at the same time, it is possible to detect the ejection abnormality by ejecting the liquid drop toward the cap. In this case, since the cap functions as the liquid receiving portion, the flushing unit 74 may not be included. In addition, if the cleaning mechanism 91 includes the cap for suction that encloses all the nozzles 110, it is possible to suppress the drying of the nozzles 110 by capping the nozzles 110 with the same cap. Therefore, the caps 93 for moisturization may not be included.

It is possible to arrange the maintenance mechanism 72 in the non-recording area NA on the 80-digit side, or to arrange elements of the maintenance mechanism 72 in the non-recording areas NA on both sides of the recording area PA. For example, while the cleaning mechanism 91 that has the cap for suction that can enclose all the nozzles 110 at the same time in the non-recording area NA on the 1-digit side is arranged, the flushing unit 74 may be arranged in the non-recording area NA on the 80-digit side. According to this configuration, it is possible to perform the detection of the ejection abnormality followed by the ejection of the liquid drops in any one of the non-recording areas NA.

The wiping member 82 is not limited to a belt-shaped member that can absorb liquid. For example, a blade-shaped wiping member (wiping member) is formed with elastomer or the like that does not absorb liquid, and a distal end portion of the wiping member that can be elastically deformed may be called the wiping portion. However, if the wiping member is the member that can absorb liquid, it is preferable since the liquid is not scattered by the wiping to the surroundings.

A section and a method for detecting the ejection abnormality of the nozzles and the cause of the ejection abnormality in the liquid ejecting apparatus are not limited to the method of detecting and analyzing the vibration patterns of the residue vibration in the vibration plate described above. Modification examples of the method of detecting the ejection abnormality are as follows. For example, there is a method of causing an optical sensor such as a laser sensor to perform irradiation and reflection directly on meniscuses of the ink in the nozzles, detecting a vibration state of the meniscuses by a light receiving element, and specifying the cause of the clogging from the vibration state.

Otherwise, whether the ejection abnormality exists or not is detected by using a general optical dot omission detecting apparatus that detects whether flying liquid drops are included in the detection scope of the sensor. Also, there is a method of assuming that the ejection abnormality occurring after a predetermined drying time in which dot omission possibly occurs has passed since the ejection operation is caused by the drying, and assuming that the ejection abnormality occurring before the drying is caused by the attachment of foreign substances or the bubble mixture.

In addition, there is a method of adding a vibration sensor to the optical dot omission detecting apparatus, determining whether the vibrations that can cause bubbles to be mixed are added, and assuming that the cause of the ejection abnormality is the bubble mixture if such vibrations are added.

Moreover, the dot omission detecting section does not have to be limited to an optical type, and a heat sensing-type detecting apparatus that detects a temperature change of a heat sensing portion by receiving the ejection of ink drops, a detection apparatus that detects the change of the charge amount of detection electrodes that eject and impact ink drops by charging the ink drops, or an apparatus of detecting electrostatic capacity that changes by the passage of the ink drops between electrodes may be used. In addition, as a method of detecting the attachment of paper dust, a method of detecting a state of a nozzle surface by a camera or the like as image information, and a method of detecting whether paper dust attachment exists or not by scanning a portion near a nozzle surface with an optical sensor such as a laser sensor are considered.

The ejection abnormality detecting section 10 only has to detect at least whether the ejection abnormality exists in the nozzles 110, and it does not have to detect the cause thereof. For example, if a certain number or more of ejection abnormality nozzles 110 exist in a predetermined scope, it is assumed that the bubble mixture is the cause of the ejection abnormality, so the suction cleaning is selected as the maintenance operation. Meanwhile, if the number of nozzles performing the ejection abnormality is equal to or less than a certain number, or the nozzles are dispersed, the flushing or the wiping may be selected as the maintenance operation.

The liquid ejecting apparatus may be changed to a so-called full line-type liquid ejecting apparatus that does not include the carriage 32, but includes a long and fixed liquid ejecting unit corresponding to the entire width (length in main scanning direction) of the recording medium. The liquid ejecting unit in this case may have a printing scope to range the entire width of the recording sheet P by performing the parallel arrangement of a plurality of unit heads in which the nozzles are formed, or may have a printing scope to range the entire width of the recording sheet P by arranging multiple nozzles in a single long head so as to range the entire width of the recording sheet P. In this case also, since the printing for one line by the liquid ejecting unit and the intermittent transportation of the recording medium are alternately performed, it is possible to perform the maintenance operation such as the wiping, for example, while the recording medium is transported.

The ejection target liquid (liquid drop) ejected from the liquid ejecting unit (according to the embodiments described above, the ink jet head 100) of the liquid ejecting apparatus is not limited to the ink, but may be, for example, liquid (including dispersion liquid such as suspension or emulsion) including various kinds of materials as follows. That is, examples are a filter material of a color filter, a luminescent material for forming an EL light-emitting layer in an organic electroluminescence (EL) apparatus, a fluorescent material for forming a fluorescent substance on an electrode in an electron emission apparatus, a fluorescent material for forming a fluorescent substance in a plasma display panel (PDP) apparatus, a migrating body material for forming a migrating body in an electrophoresis display apparatus, a bank material for forming a bank on a surface of a substrate W, various kinds of coating materials, a liquid electrode material for forming an electrode, a particle material that configures a spacer for configuring a minute cell gap between two substrates, a liquid metal material for forming metal wiring, a lens material for forming a micro lens, a resist material, a light diffusing material for forming a light diffusing body, and various kinds of experimental liquid material to be used in a biosensor such as a DNA chip or a protein chip.

The recording medium (liquid receiving body) to be a target to which the liquid drops are ejected is not limited to paper such as a recording sheet, and may be other media such as a film, a fabric, and a nonwoven fabric, or a workpiece such as various kinds of substrates including a glass substrate, a silicon substrate, or the like.

The entire disclosure of Japanese Patent Application No. 2016-020847, filed Feb. 5, 2016 is expressly incorporated by reference herein.

What is claimed is:

1. A liquid ejecting apparatus comprising:

a liquid ejecting unit that has a plurality of nozzles and performs a recording process by ejecting liquid drops from the nozzles to a recording medium;

an ejection abnormality detecting unit that detects ejection abnormality in the nozzles during the recording process;

a control portion electrically connected to the ejection abnormality detecting unit within the liquid ejecting apparatus, the control portion comprising:

a counting unit that counts the number of liquid ejections to be performed using the nozzles in the recording process as a number of scheduled ejections prior to performing the recording process, wherein the number of scheduled ejections is based on input data for the recording process; and a calculation unit that calculates a usage amount of liquid in the recording process as a liquid usage amount on the basis of the number of scheduled ejections which is counted by the counting unit and a state of the ejection abnormality which is detected by the ejection abnormality detecting unit, wherein the ejection abnormality detecting unit detects a nozzle in which ejection abnormality occurs, as a faulty nozzle, and wherein the calculation unit calculates a usage amount of liquid to be used in the recording process as a scheduled usage amount by multiplying the number of scheduled ejections in the recording process by a liquid amount per liquid drop, calculates an amount of unused liquid by multiplying the scheduled usage amount by a proportion of the number of the faulty nozzles, which are detected by the ejection abnormality detecting unit before the recording process is performed, to the total number of nozzles, and calculates the liquid usage amount by subtracting the amount of unused liquid from the scheduled usage amount.

2. The liquid ejecting apparatus according to claim 1, further comprising:

a liquid receiving portion that can receive liquid drops ejected from the liquid ejecting unit in a non-recording area that is on the outside of a recording area in which the recording medium is arranged, wherein the liquid ejecting unit reciprocates between the recording area and the non-recording area and performs the recording process by ejecting liquid drops onto the recording medium when entering the recording area, and wherein the liquid ejecting unit moves to the non-recording area between ejection operations of liquid drops on the recording medium, and when the liquid ejecting unit is arranged in a position in which the liquid receiving portion can receive the liquid drops ejected from the nozzles, the ejection abnormality detecting unit detects the ejection abnormality.

3. The liquid ejecting apparatus according to claim 1, wherein the liquid ejecting unit includes a pressure chamber that communicates with the nozzles, and an actuator that causes liquid drops to be ejected from the nozzles by causing the pressure chamber to vibrate, and wherein the ejection abnormality detecting unit detects the ejection abnormality on the basis of vibration waveforms of the pressure chamber that vibrates due to driving of the actuator.

4. The liquid ejecting apparatus according to claim 1, wherein the liquid ejecting unit includes a pressure chamber and an actuator to vibrate the pressure chamber so that the liquid drop is ejected from the nozzle, and the ejection abnormality detecting unit detects ejection abnormality in the nozzle based on a vibration of the pressure chamber.

5. The liquid ejecting apparatus according to claim 1, further comprising:

a display portion, wherein the liquid ejecting unit ejects a liquid stored in a liquid supply source as the liquid drops from the nozzles, wherein the calculation unit calculates a residual amount from the liquid usage amount and a previously calculated residual amount before the recording process, and wherein the control portion causes the display portion to display a message related to the liquid supply source based on the calculated residual amount of the liquid in the liquid supply source.

6. The liquid ejecting apparatus according to claim 1, further comprising:

a terminal portion designed to electrically connected to a memory part of the liquid supply source, the terminal portion being electrically connected to the control portion, wherein control portion obtains a residual amount in the liquid supply source from the memory part through the terminal portion, and wherein the calculation unit calculates a current residual amount from the liquid usage amount and the obtained residual amount in the liquid supply source.

7. A liquid usage amount calculation method for a liquid ejecting apparatus that performs a recording process by ejecting liquid drops to a recording medium from a plurality of nozzles of a liquid ejecting section using liquid contained in a liquid supply source, the liquid ejecting apparatus comprising a control portion electrically connected to an ejection abnormality detecting unit within the liquid ejecting apparatus, the method comprising:

counting, through a counting unit of the control portion, a number of scheduled ejections to be performed using the nozzles in the recording process prior to performing the recording process, wherein the number of scheduled ejections is based on input data for the recording process;

calculating, through a calculating unit of the control portion, a scheduled usage amount of liquid in the recording process on the basis of the number of scheduled ejections;

calculating a value to be used as a current residual amount by subtracting the calculated scheduled usage amount from current liquid residual amount in the liquid supply source before the recording process;

detecting ejection abnormality in the liquid ejecting section with the ejection abnormality detecting unit;

calculating an unused amount of liquid based on a state of the detected ejection abnormality; and calculating the current residual amount by adding the unused amount of liquid to the value after the detecting, wherein, in the calculating of the unused amount of liquid, the unused amount of liquid is calculated by multiplying the number of scheduled ejections in the recording process of faulty nozzles, which are detected in the detecting of the ejection abnormality, by a liquid amount per liquid drop, wherein the calculating of the current residual amount by adding the unused amount to the value is performed after the recording process.

8. The liquid usage amount calculation method according to claim 7, wherein, in the calculating of the scheduled usage amount, the scheduled usage amount is calculated by multiplying the number of scheduled ejections in the recording process by a liquid amount per liquid drop.

9. The liquid usage amount calculation method according to claim 7, wherein the detecting of ejection abnormality is performed during the recording process.

10. The liquid usage amount calculation method according to claim 7, wherein the detecting of ejection abnormality is performed after the recording process.

11. The liquid usage amount calculation method according to claim 7, wherein the liquid ejecting apparatus further comprises a display portion, and wherein, in the calculating, the current residual amount is calculated to display a message related to the liquid supply source on the display portion.

* * * * *